US011114790B2

(12) United States Patent
Tsai

(10) Patent No.: US 11,114,790 B2
(45) Date of Patent: Sep. 7, 2021

(54) REVERSIBLE DUAL-POSITION ELECTRIC CONNECTOR

(71) Applicant: Chou Hsien Tsai, New Taipei (TW)

(72) Inventor: Chou Hsien Tsai, New Taipei (TW)

( * ) Notice: Subject to any disclaimer, the term of this patent is extended or adjusted under 35 U.S.C. 154(b) by 0 days.

(21) Appl. No.: 16/324,978

(22) PCT Filed: Aug. 14, 2017

(86) PCT No.: PCT/CN2017/097378
§ 371 (c)(1),
(2) Date: Jul. 16, 2019

(87) PCT Pub. No.: WO2018/028709
PCT Pub. Date: Feb. 15, 2018

(65) Prior Publication Data

US 2019/0348785 A1 Nov. 14, 2019

(30) Foreign Application Priority Data

Aug. 12, 2016 (CN) ..... 201620871985.X
Sep. 29, 2016 (CN) ..... 201621090863.3
(Continued)

(51) Int. Cl.
*H01R 13/08* (2006.01)
*H01R 13/26* (2006.01)
(Continued)

(52) U.S. Cl.
CPC ..... *H01R 13/08* (2013.01); *H01R 13/26* (2013.01); *H01R 13/64* (2013.01); *H01R 27/00* (2013.01);
(Continued)

(58) Field of Classification Search
CPC ..... H01R 24/60
See application file for complete search history.

(56) References Cited

U.S. PATENT DOCUMENTS 9,647,377 B1 * 5/2017 Peng ..... H01R 13/405
9,985,393 B2 * 5/2018 Zhao ..... H01R 12/58
(Continued)

FOREIGN PATENT DOCUMENTS

CN 204243365 U 4/2015
CN 104810657 A 7/2015
(Continued)

*Primary Examiner* — Ross N Gushi
(74) *Attorney, Agent, or Firm* — WPAT, PC

(57) ABSTRACT

A reversible dual-position electrical connector includes: an insulation seat provided with a base seat and a tongue; two rows of terminals, wherein the two rows of terminals are embedded into and plastic injection molded with the insulation seat, the terminal is integrally provided with, from front to rear, a connection portion, a contact, an extension and a pin, the contact is in flat surface contact with the tongue, elastically non-movable and exposed from two connection surfaces, and a bent segment is formed between the connection portion and the contact, so that the connection portion is lower than the two connection surfaces and embedded into the tongue; an inner insulating structure embedded and plastic injection molded with the insulation seat, wherein the contacts and the extensions of the two rows of terminals are in flat surface contact with and rest against the inner insulating structure.

20 Claims, 58 Drawing Sheets

(30) Foreign Application Priority Data

| | | |
|---|---|---|
| Dec. 9, 2016 | (CN) | 201621348388.5 |
| Jan. 11, 2017 | (CN) | 201720034153.7 |
| Apr. 28, 2017 | (CN) | 201720469039.7 |
| Jun. 30, 2017 | (CN) | 201720781911.1 |

(51) Int. Cl.
*H01R 13/64* (2006.01)
*H01R 27/00* (2006.01)
*H01R 31/06* (2006.01)

(52) U.S. Cl.
CPC ..... *H01R 31/065* (2013.01); *H01R 2201/06* (2013.01)

(56) References Cited

U.S. PATENT DOCUMENTS

| | | | | |
|---|---|---|---|---|
| 2017/0324188 | A1* | 11/2017 | Guo | H01R 13/405 |
| 2018/0013243 | A1* | 1/2018 | Yao | H01R 13/6594 |

FOREIGN PATENT DOCUMENTS

| | | | |
|---|---|---|---|
| CN | 204732558 | U | 10/2015 |
| CN | 204885479 | U | 12/2015 |
| CN | 105244654 | A | 1/2016 |
| CN | 105305132 | A | 2/2016 |
| CN | 205039347 | U | 2/2016 |
| CN | 105552618 | A | 5/2016 |
| CN | 105703124 | A | 6/2016 |
| CN | 106025630 | A | 10/2016 |

* cited by examiner

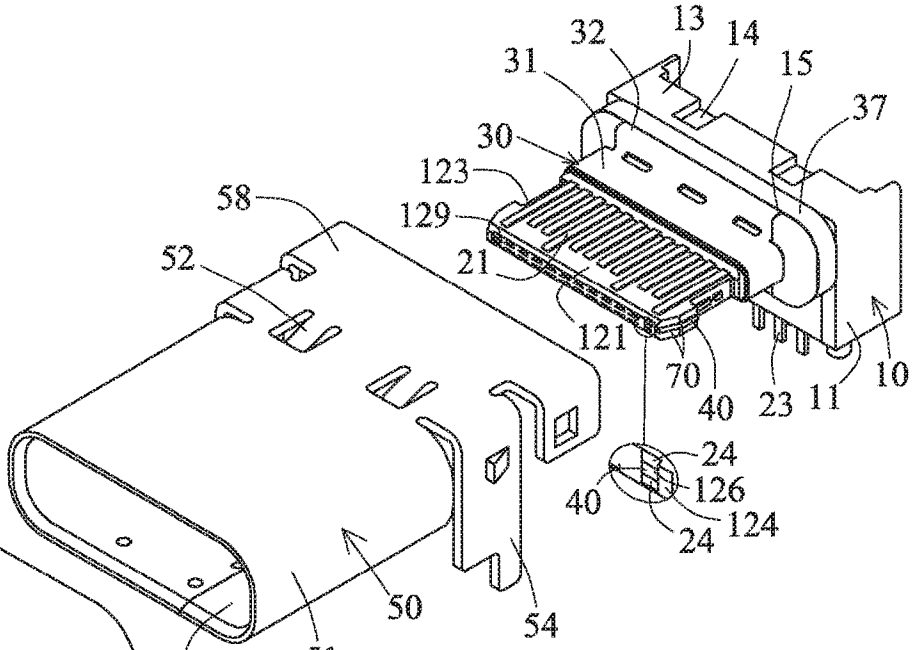
FIG. 136
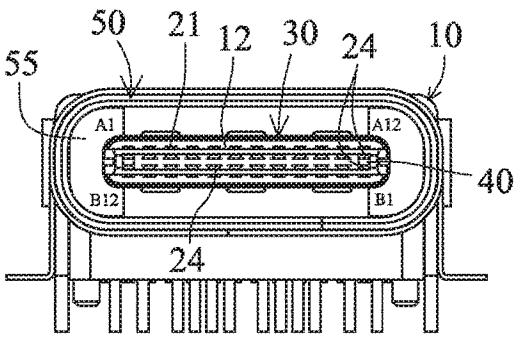
FIG. 137
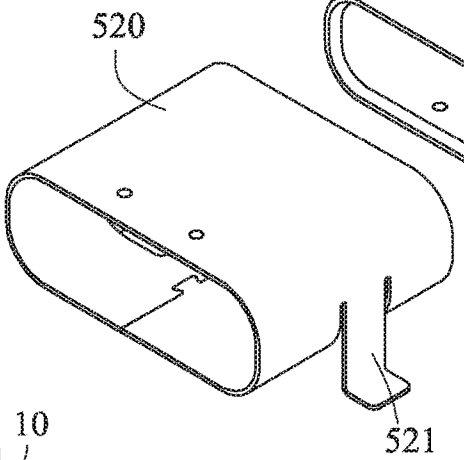
FIG. 134
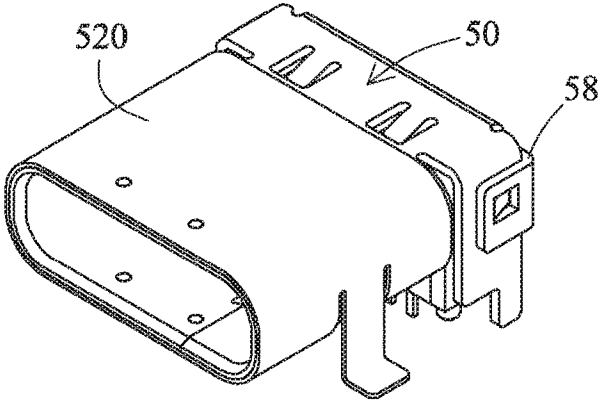
FIG. 135
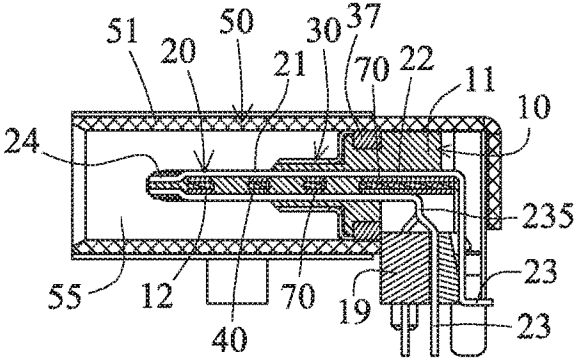

Replacement Sheet

Replacement Sheet
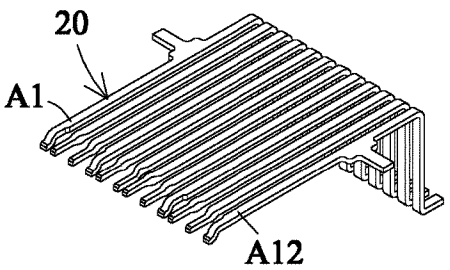
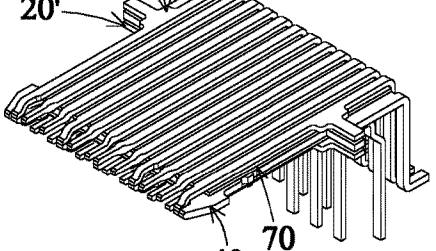
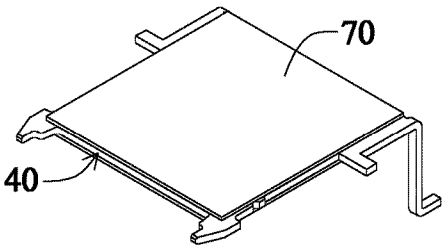
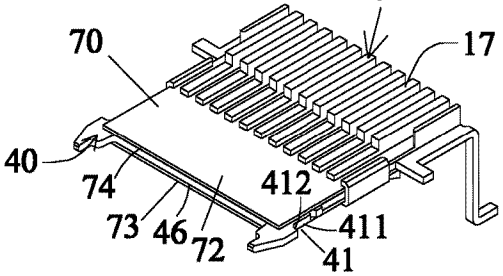
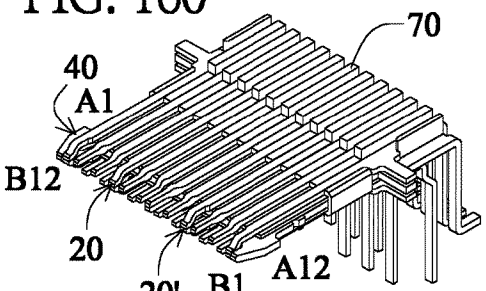
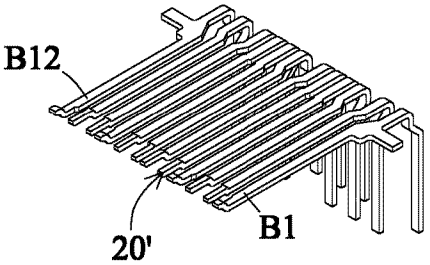
FIG. 158
FIG. 159
FIG. 160
FIG. 161
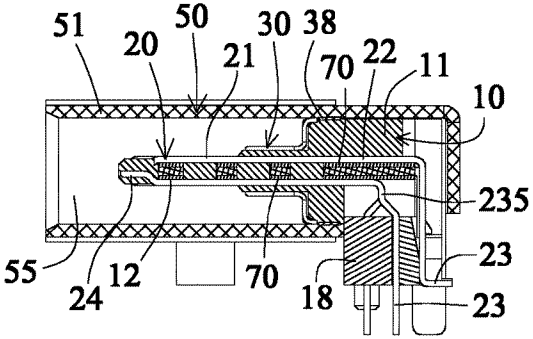
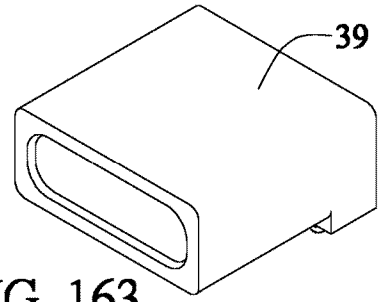
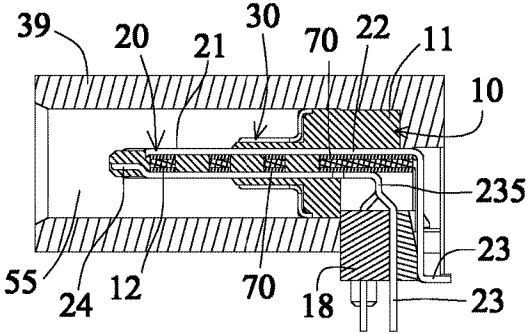
FIG. 162
FIG. 163
FIG. 164

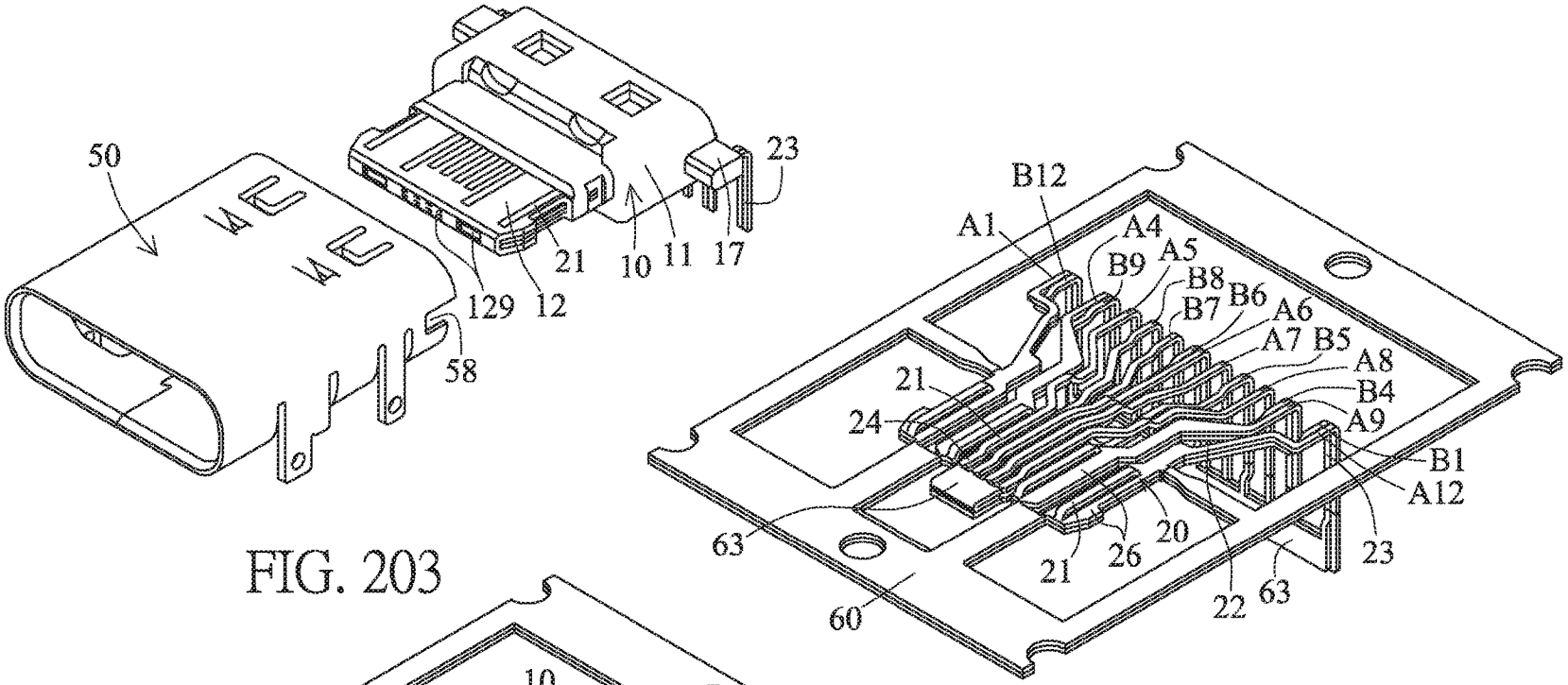
FIG. 203
FIG. 204
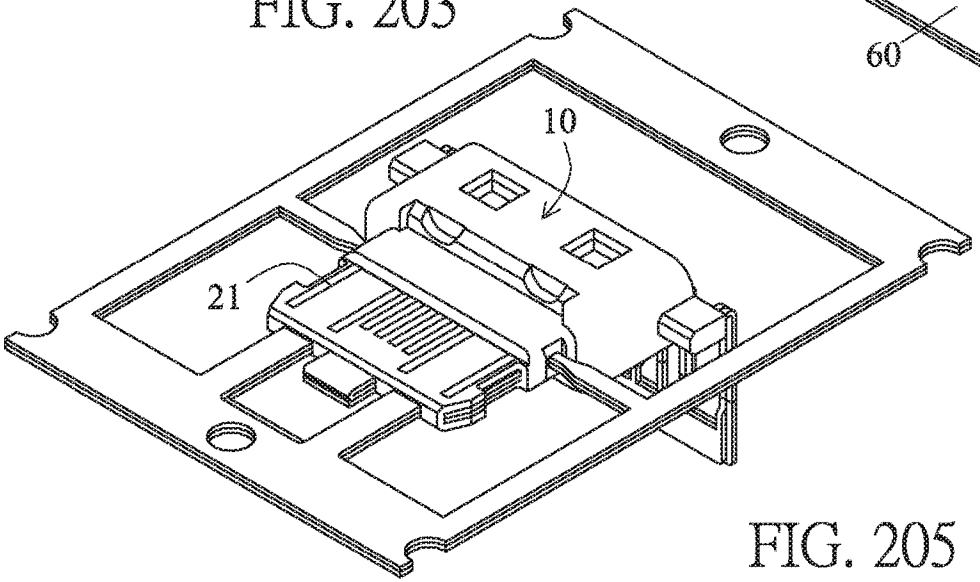
FIG. 205

REVERSIBLE DUAL-POSITION ELECTRIC CONNECTOR

CROSS-REFERENCE TO RELATED APPLICATIONS

This application is a national stage application of PCT Patent Application No. PCT/CN2017/097378, filed on Aug. 14, 2017, which claims priorities to China Patent Application Nos. CN201620871985.X, filed on Aug. 12, 2016; CN201621090863.3, filed on Sep. 29, 2016; CN201621348388.5, filed on Dec. 9, 2016; CN201720034153.7, filed on Jan. 11, 2017; CN201720469039.7, filed on Apr. 28, 2017; and CN201720781911.1, filed on Jun. 30, 2017, the contents of which are incorporated herein by reference.

BACKGROUND OF THE INVENTION

Field of the Invention

The invention relates to an electrical connector, and more particularly to a reversible dual-position electrical connector.

Description of the Related Art

At present, a USB TYPE-C electrical connector has become the mainstream specification of the interface of the electronic product. A USB TYPE-C electrical connection socket specified by USB Association has a tongue disposed at a middle height of the connection slot, connection points of one row of terminals are disposed on each of two surfaces of the tongue, and two rows of connection points have circuits with serial numbers sequentially and reversely arranged. The USB TYPE-C electrical connectors are classified into a high-function type USB TYPE-C 3.1 connector having two rows of terminals (each row has 12 terminals), and a low-function type USB TYPE-C 2.0 connector having two rows of terminals (each row has 5 to 8 terminals).

Because the USB TYPE-C electrical connector has the very small volume and size, and many terminals arranged densely, it has to be manufactured in a particularly precise manner, and it is very difficult to integrally injection mold two rows of terminals of the USB TYPE-C electrical connection socket with the insulation seat. In addition, the two rows of terminals have many pins, and it is very difficult to arrange the pins into two rows of vertical insert pins or one row of flush horizontal pins. Thus, the current solution in the industry is to divide the insulation seat into upper and lower seats, wherein the two rows of terminals are respectively embedded into, injection molded with and fixed to the upper and lower seats, so that the manufacturing is labor consuming and needs the high cost. The pins of the two rows of terminals are designed into four rows of front-to-rear vertical insert pins or front and rear (two) rows of horizontal pins, wherein the four rows of front-to-rear vertical insert pins need to be manufactured in a labor consuming manner, and it is difficult to perform repair welding on the front row of pins when the front and rear (two) rows of horizontal pins are designed.

BRIEF SUMMARY OF THE INVENTION

The main object of the invention is to provide a reversible dual-position electrical connector, wherein two rows of terminals are embedded into and plastic injection molded with an insulation seat, and the manufacturing can be simplified.

The main object of the invention is to provide a reversible dual-position electrical connector, wherein the pins of one pair of terminals of the two rows of terminals having vertically aligned contacts and the same circuit are combined together or adjacent and close to each other, so that the number of pins can be decreased, and it is beneficial to arrange the pins within the width of the insulation seat.

The main object of the invention is to provide a reversible dual-position electrical connector, wherein the pins of the two rows of terminals are arranged in one row, wherein the corresponding contacts of rear sections of the extensions of at least one pair or two pairs of terminals (ground terminal, power terminal, high differential terminal, low-high differential terminal and detection terminal) are turned to left and right sides and transversally and outwardly extended, so that the arrangement width of the pins of each row of terminals is greater than the arrangement width of the contacts, and that the gaps between the arranged pins are enlarged to be larger than the gaps between the horizontal or longitudinal pins by at least 0.6 or 0.8 mm.

To achieve the above-identified object, the invention provides a reversible dual-position electrical connector including: an insulation seat provided with a base seat and a tongue, wherein a front end of the base seat is projectingly provided with the tongue, and two larger-area plate surfaces of the tongue are two connection surfaces; two rows of terminals, wherein the two rows of terminals are embedded into and plastic injection molded with the insulation seat, the terminal is integrally provided with, from front to rear, a connection portion, a contact, an extension and a pin, the contact is in flat surface contact with the tongue, is elastically non-movable and is exposed on the two connection surfaces, the pin extends out of a rear end of the base seat, the extension is disposed between the pin and the contact, a bent segment is formed between the connection portion and the contact, so that the connection portion is lower than the two connection surfaces and embedded into the tongue, the contacts of the two rows of terminals are respectively exposed on the two connection surfaces of the tongue and are vertically aligned, and the two rows of contacts have connection points with the same serial numbers arranged reversely; at least one insulating layer embedded and plastic injection molded with the insulation seat, the contacts and the extensions of the two rows of terminals are in flat surface contact with and rest against the at least one insulating layer, the bent segments of the two rows of terminals are bent toward a middle of the insulation seat so that the connection portions are disposed in front of the at least one insulating layer; and a metal housing covering the insulation seat and resting against and positioning with the base seat, wherein the metal housing is formed with a connection slot, the tongue is disposed at a middle height of the connection slot, the two connection surfaces of the tongue form two symmetrical spaces, and the connection slot is to be bidirectionally and dual-positionally inserted by and positioned with an electrical connector.)

The above-mentioned and other objects, advantages and features of the present invention will become more apparent from the following detailed description of the preferred embodiments with reference to the accompanying drawings.

BRIEF DESCRIPTION OF THE SEVERAL VIEWS OF THE DRAWINGS

FIG. 119 is a top view showing the 16th embodiment of the invention.

FIG. 120 is a cross-sectional side view showing the 17th embodiment of the invention.

FIG. 121 is a front view showing the 17th embodiment of the invention.

FIG. 122 is a top view showing the 17th embodiment of the invention.

FIG. 123 is a cross-sectional side view showing the 18th embodiment of the invention.

FIG. 124 is a front view showing the 18th embodiment of the invention.

FIG. 125 is a top view showing the 18th embodiment of the invention.

FIG. 126 is a front view showing the 19th embodiment of the invention.

FIG. 127 is a side view showing the 19th embodiment of the invention.

FIG. 128 is a bottom view showing the 19th embodiment of the invention.

FIG. 129 is a cross-sectional side view showing the 20th embodiment of the invention.

FIG. 130 is a front view showing the 20th embodiment of the invention.

Figure 131:
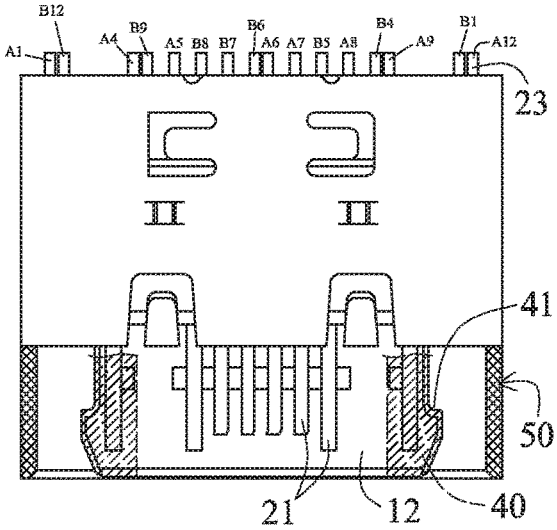

FIG. 131 is a cross-sectional top view showing the 20th embodiment of the invention.

Figure 132:
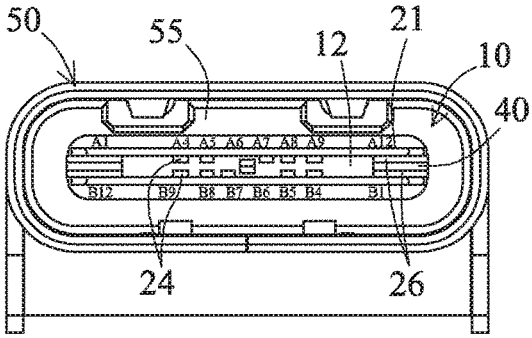

FIG. 132 is a front view showing the first modification of the 20th embodiment of the invention.

Figure 133:
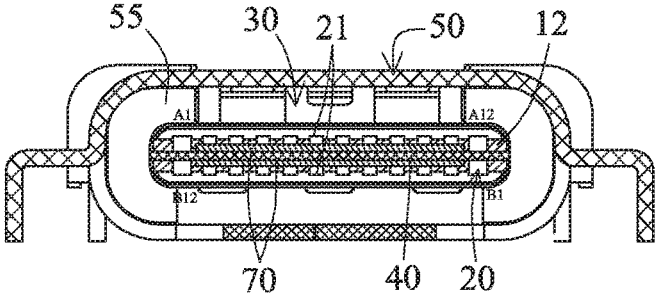

FIG. 133 is a front view showing the 21st embodiment of the invention.

FIG. 134 is a pictorial view showing the 22nd embodiment of the invention.

FIG. 135 is a cross-sectional side view showing the 22nd embodiment of the invention.

FIG. 136 is a front view showing the 22nd embodiment of the invention.

FIG. 137 is a pictorially exploded view showing the 22nd embodiment of the invention.

Figure 138:
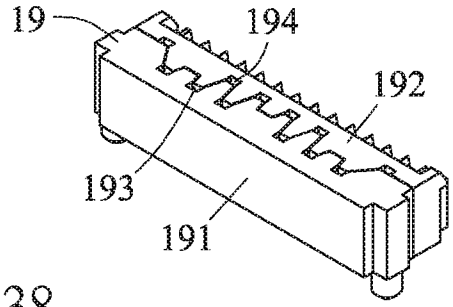

FIG. 138 is a pictorially exploded view showing the 22nd embodiment of the invention.

Figure 139:
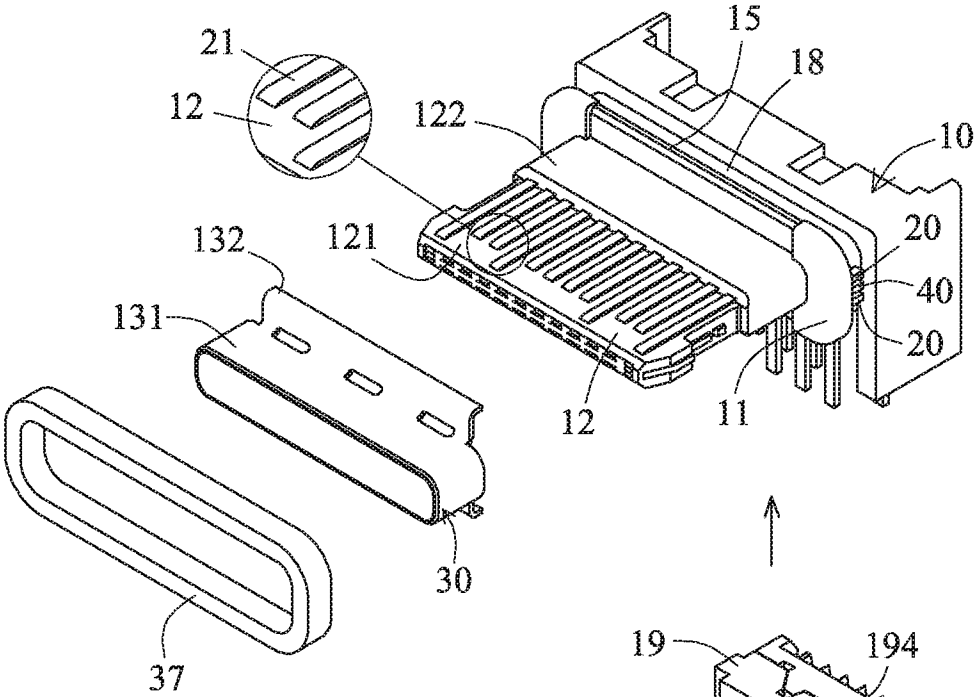
Figure 139:
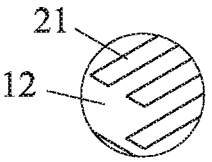

FIG. 139 is a pictorial view showing another implementation of the 22nd embodiment of the invention.

Figure 140:
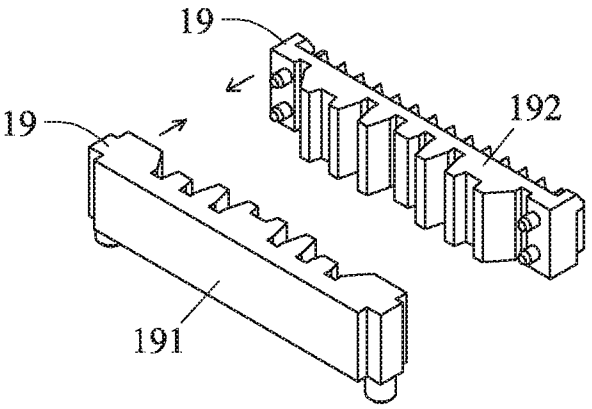

FIG. 140 is a pictorially exploded view showing the pin positioning seat of the 22nd embodiment of the invention.

Figure 141:
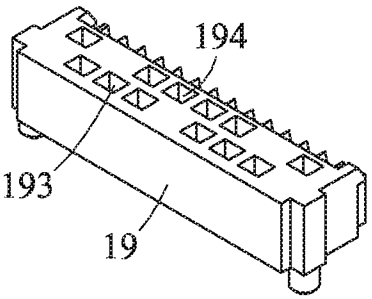

FIG. 141 is a pictorial view showing another implementation of the pin positioning seat of the 22nd embodiment of the invention.

Figure 142:
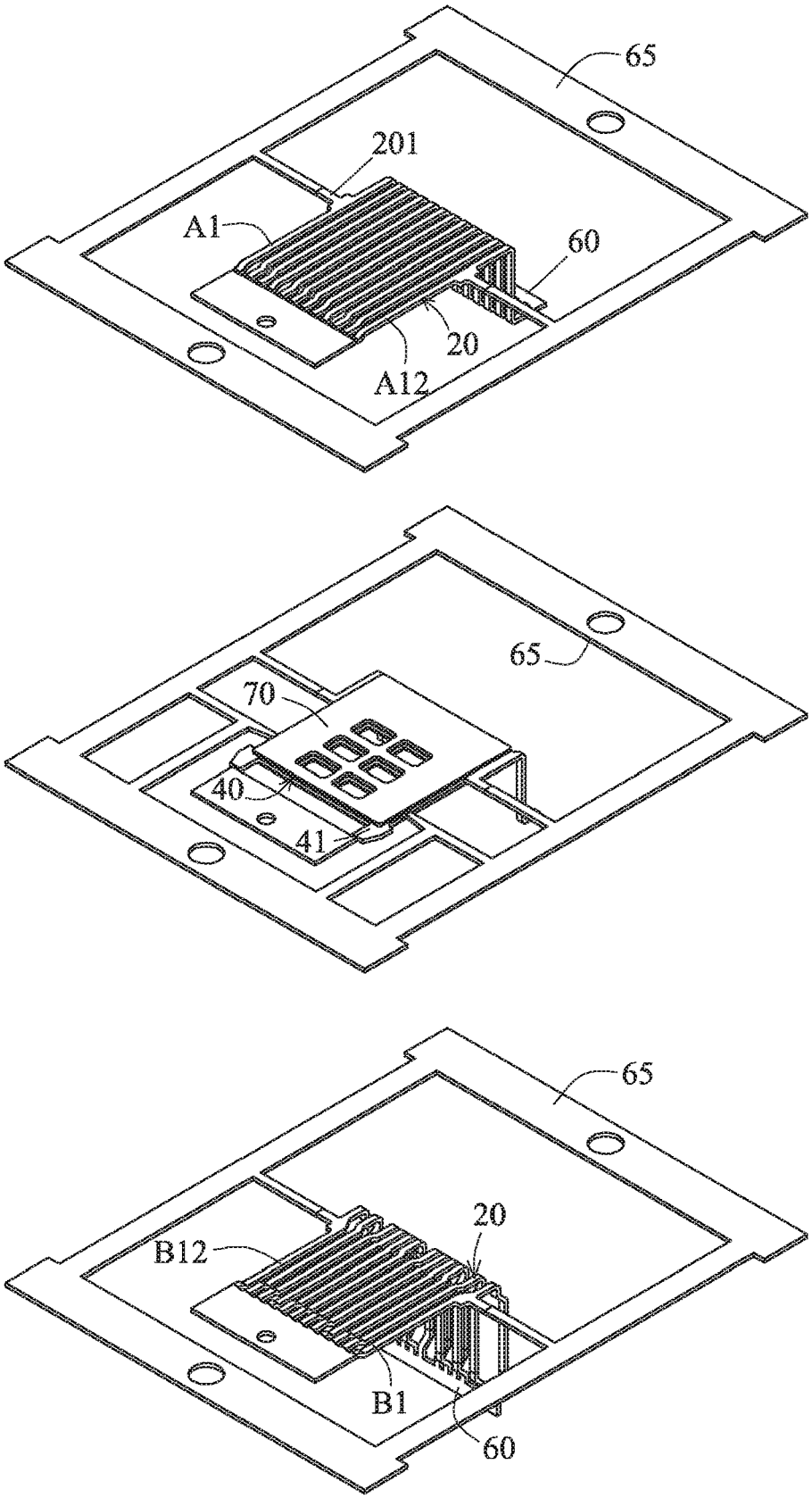

FIG. 142 is a pictorial view showing the manufacturing process of the 22nd embodiment of the invention.

Figure 143:
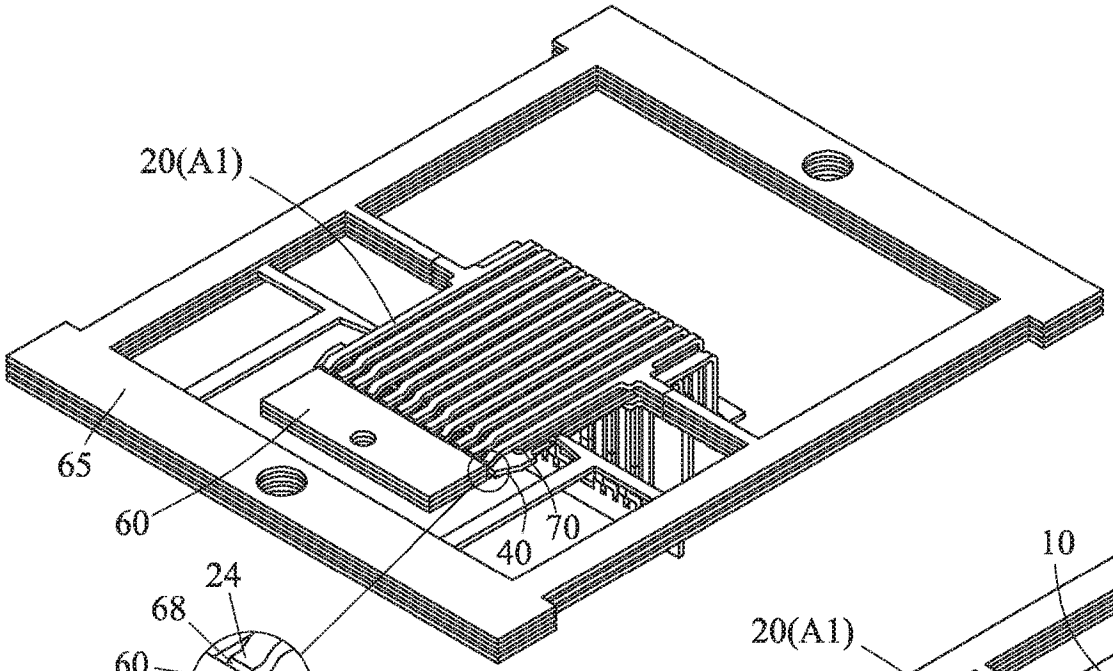

FIG. 143 is a pictorial view showing the manufacturing process of the 22nd embodiment of the invention.

Figure 143A:
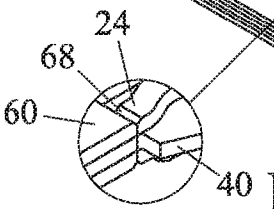
Figure 143A:
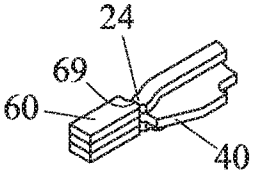

FIG. 143A is a pictorial view showing another implementation of the manufacturing process of the 22nd embodiment of the invention.

Figure 144A:
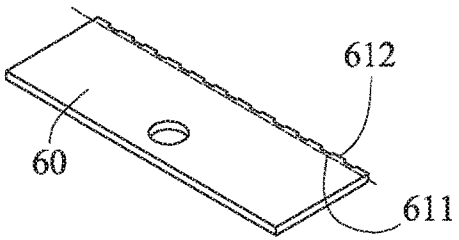
Figure 144:
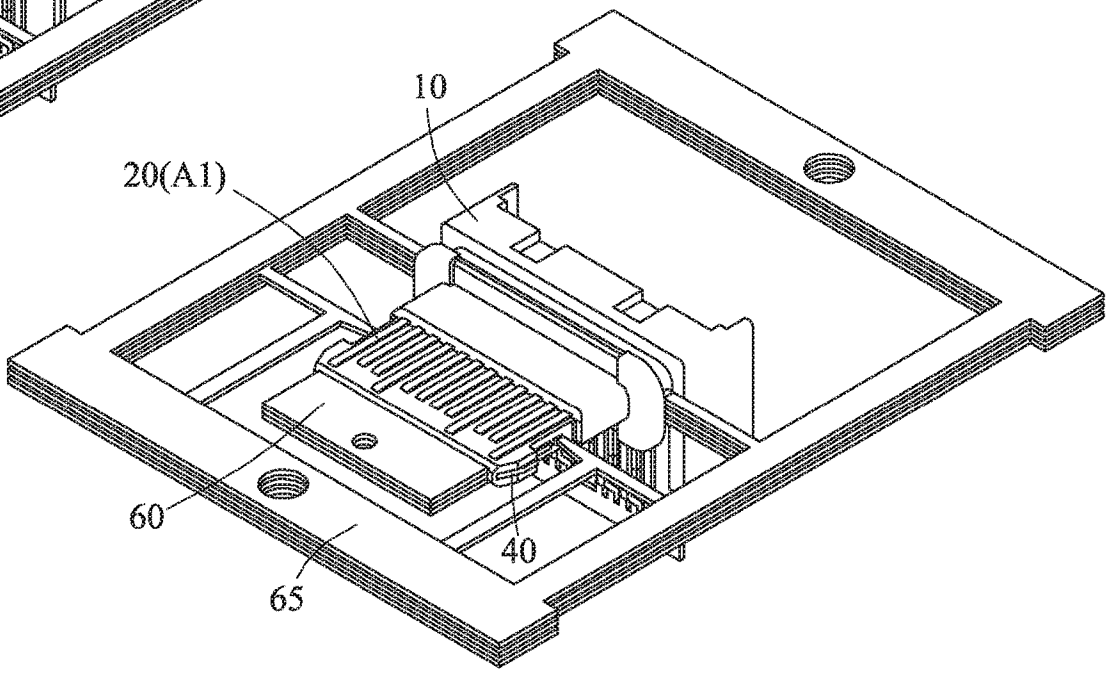

FIG. 144 is a pictorial view showing the manufacturing process of the 22nd embodiment of the invention.

FIG. 144A is a schematic view showing the alignment line for embedding the tongue in the manufacturing process of the 22nd embodiment of the invention.

Figure 145:
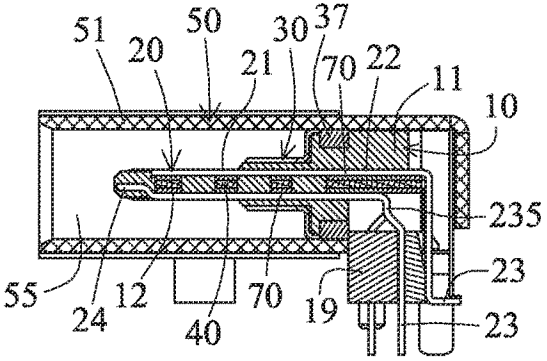

FIG. 145 is a cross-sectional side view showing the first modification of the 22nd embodiment of the invention.

Figure 146:
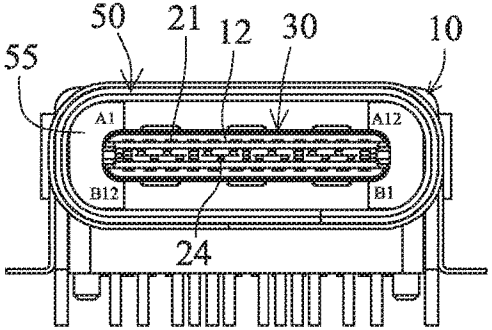

FIG. 146 is a front view showing the first modification of the 22nd embodiment of the invention.

Figure 147:
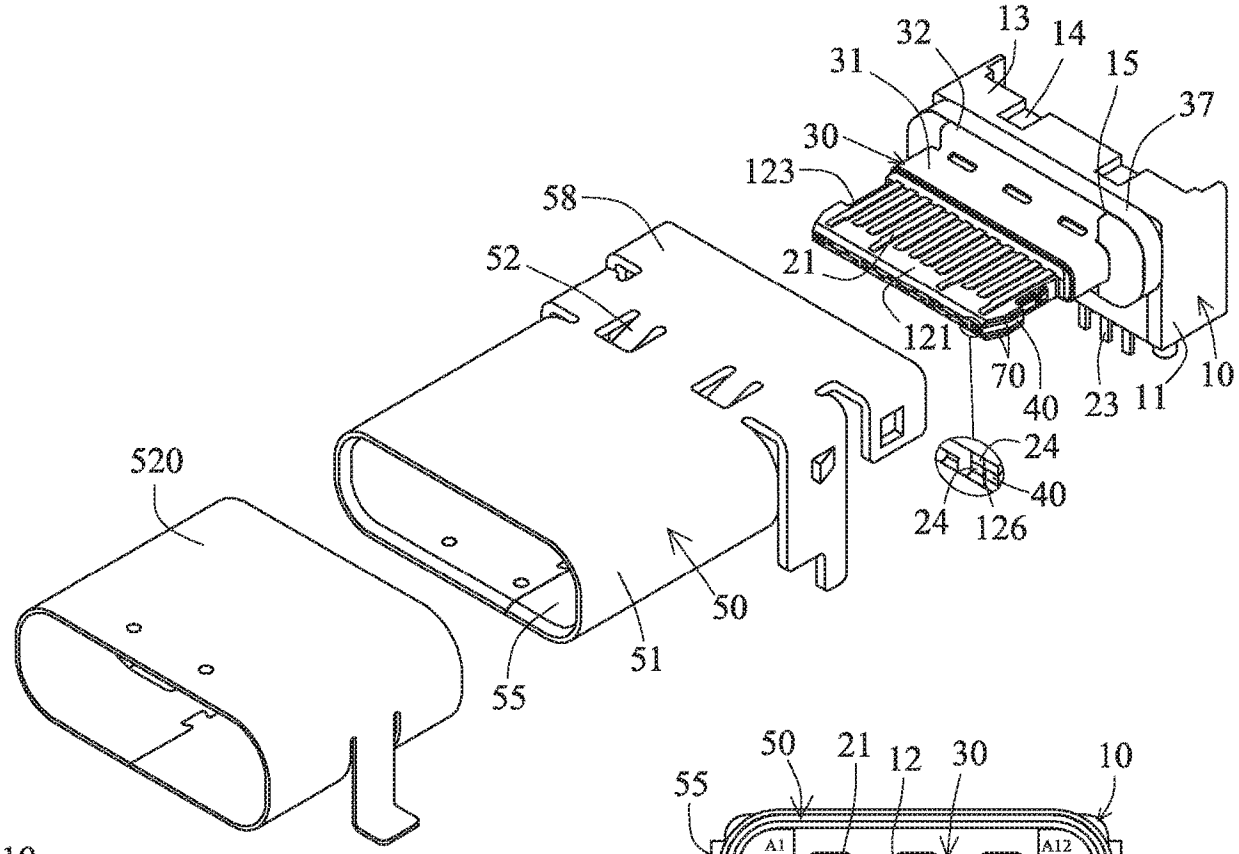

FIG. 147 is a pictorially exploded view showing the first modification of the 22nd embodiment of the invention.

Figure 148:
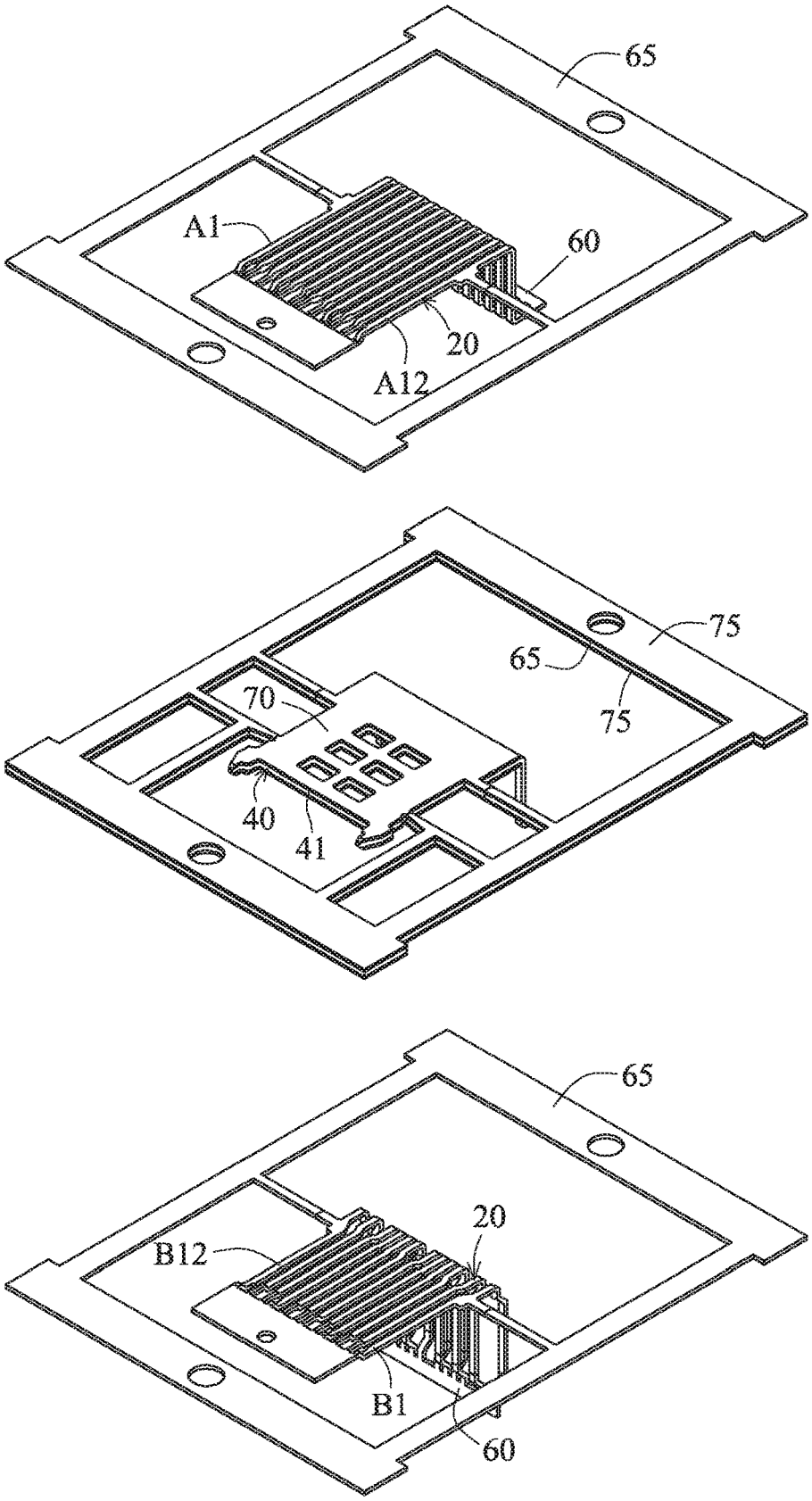

FIG. 148 is a pictorial view showing the manufacturing process of the first modification of the 22nd embodiment of the invention.

Figure 149:
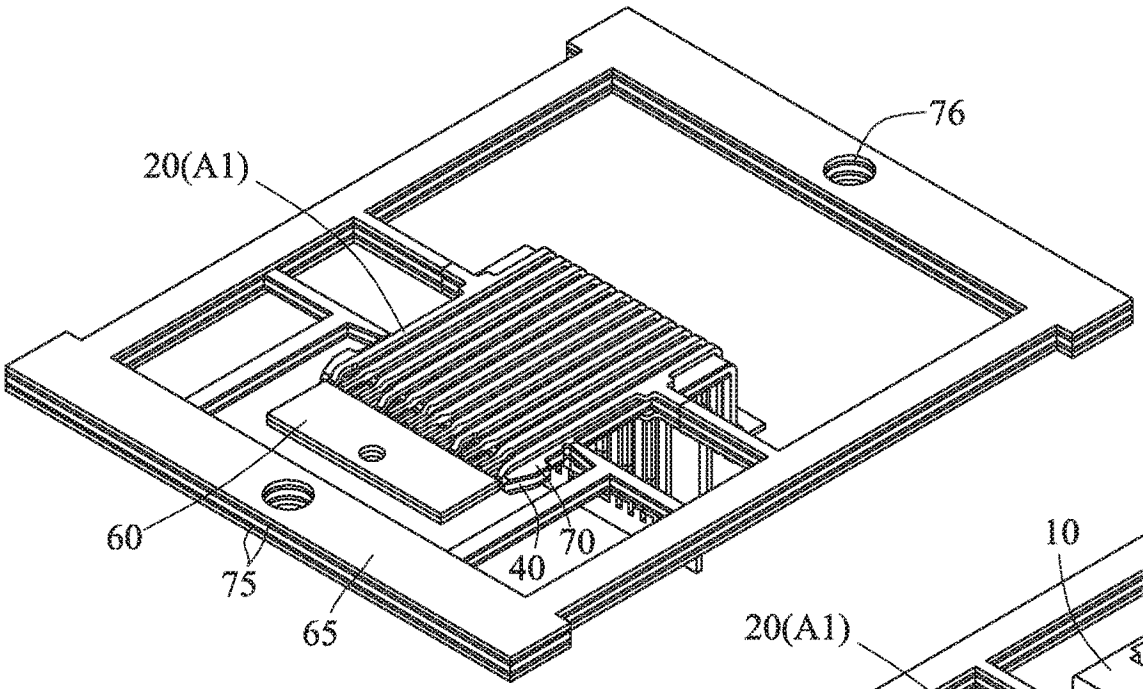

FIG. 149 is a pictorial view showing the manufacturing process of the first modification of the 22nd embodiment of the invention.

Figure 150:
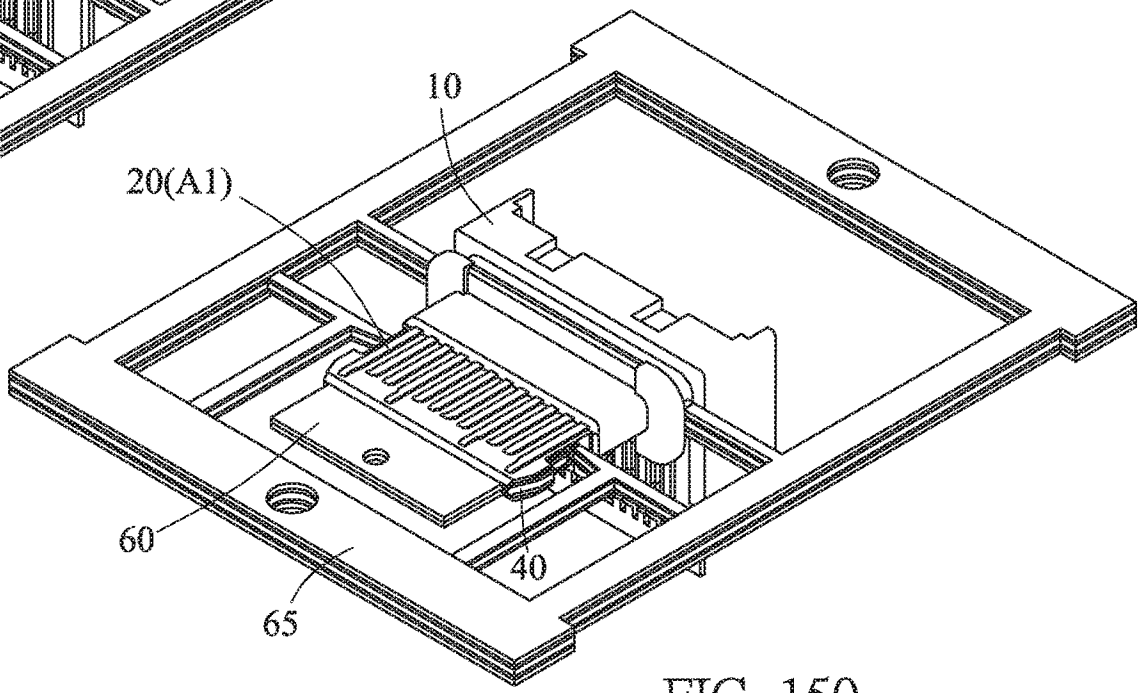

FIG. 150 is a pictorial view showing the manufacturing process of the first modification of the 22nd embodiment of the invention.

Figure 151:
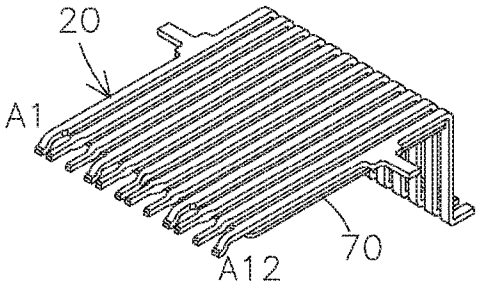
Figure 151:
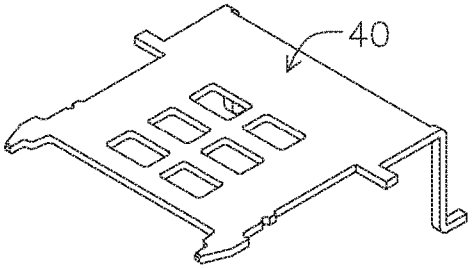
Figure 151:
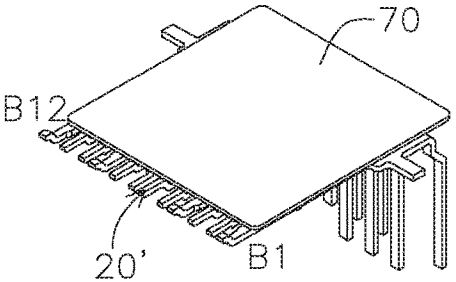

FIG. 151 is a pictorially exploded view showing the second modification of the 22nd embodiment of the invention.

Figure 152:
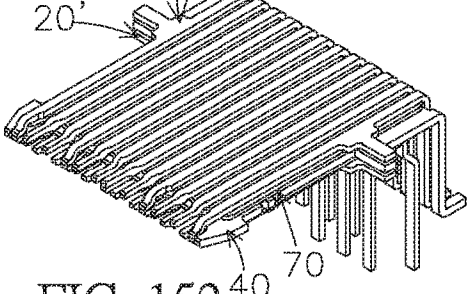

FIG. 152 is a pictorially assembled view showing the second modification of the 22nd embodiment of the invention.

Figure 153:
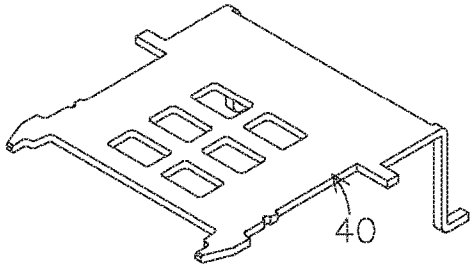

FIG. 153 is a pictorial view showing the metal partition plate of the third modification of the 22nd embodiment of the invention.

Figure 154:
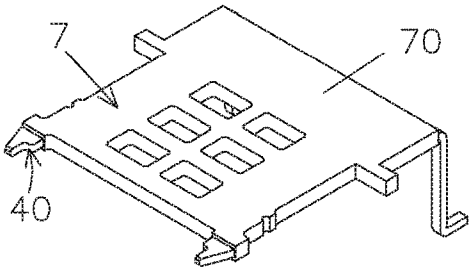

FIG. 154 is a pictorial view showing the metal partition plate of the third modification of the 22nd embodiment of the invention combined with the insulating layer.

Figure 155:
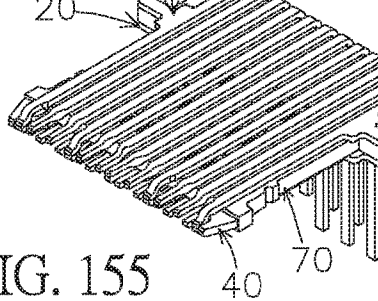

FIG. 155 is a pictorially assembled view showing the third modification of the 22nd embodiment of the invention.

Figure 156:
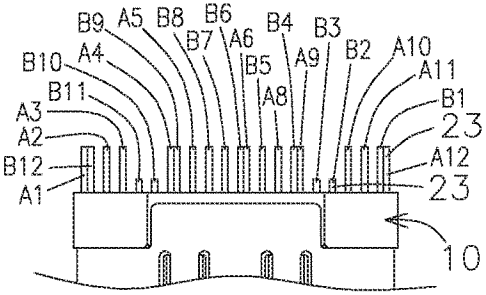

FIG. 156 is a top view showing the fourth modification of the 22nd embodiment of the invention.

Figure 157:
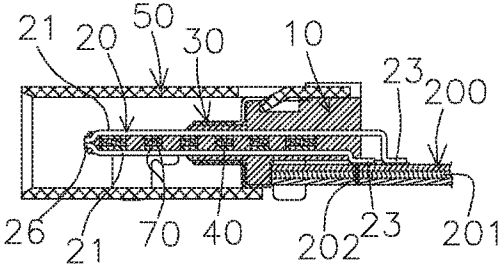

FIG. 157 is a cross-sectional side view showing the fourth modification of the 22nd embodiment of the invention.

FIG. 158 is a pictorially exploded view showing the fifth modification of the 22nd embodiment of the invention.

FIG. 159 is a pictorially assembled view showing the fifth modification of the 22nd embodiment of the invention.

FIG. 160 is a pictorial view showing the sixth modification of the 22nd embodiment of the invention.

FIG. 161 is a pictorially assembled view showing the sixth modification of the 22nd embodiment of the invention.

FIG. 162 is a cross-sectional side view showing the seventh modification of the 22nd embodiment of the invention.

FIG. 163 is a pictorial view showing the eighth modification of the 22nd embodiment of the invention.

FIG. 164 is a cross-sectional side view showing the eighth modification of the 22nd embodiment of the invention.

Figure 165:
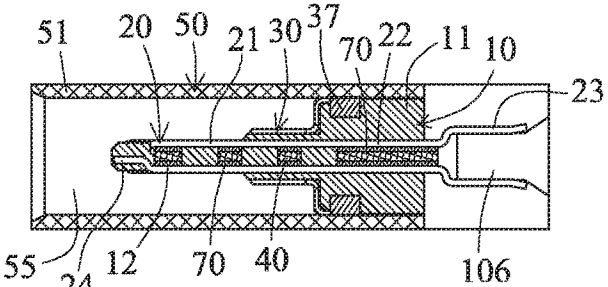

FIG. 165 is a cross-sectional side view showing the ninth modification of the 22nd embodiment of the invention.

Figure 166:
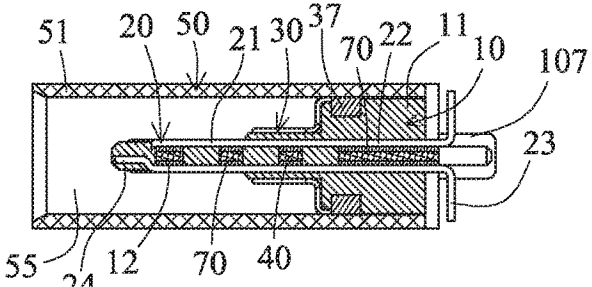

FIG. 166 is a cross-sectional side view showing the tenth modification of the 22nd embodiment of the invention.

Figure 167:
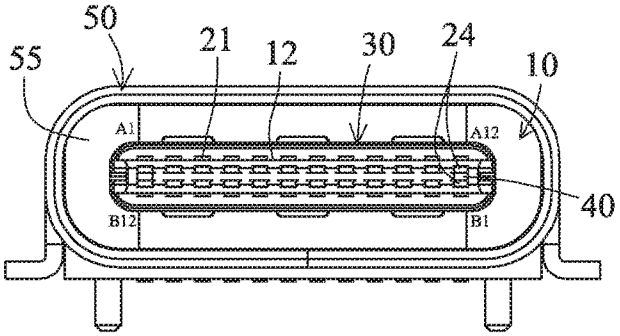

FIG. 167 is a front view showing the eleventh modification of the 22nd embodiment of the invention.

Figure 168:
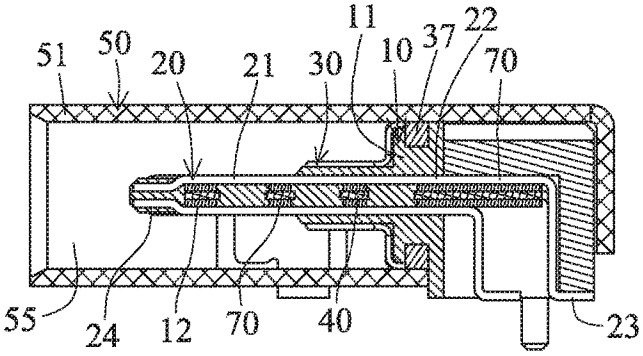

FIG. 168 is a cross-sectional side view showing the eleventh modification of the 22nd embodiment of the invention.

Figure 169:
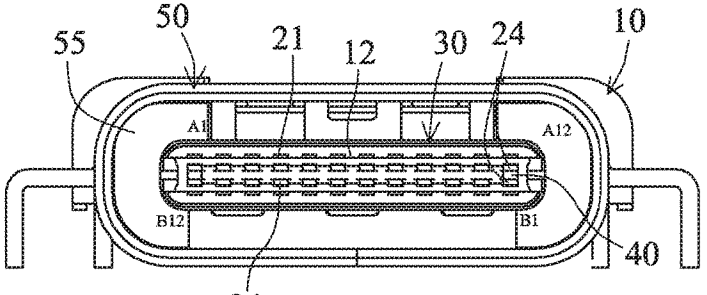

FIG. 169 is a front view showing the twelfth modification of the 22nd embodiment of the invention.

Figure 170:
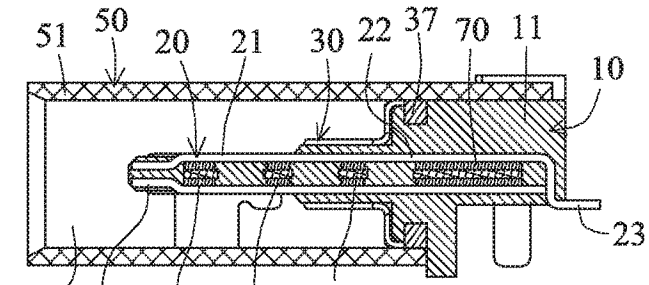

FIG. 170 is a cross-sectional side view showing the twelfth modification of the 22nd embodiment of the invention.

Figure 171:
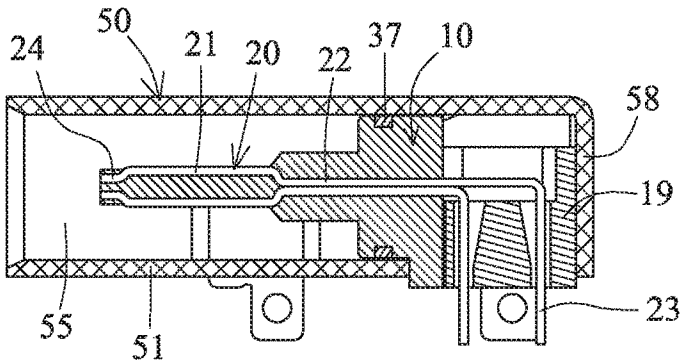

FIG. 171 is a cross-sectional side view showing the 23rd embodiment of the invention.

Figure 172:
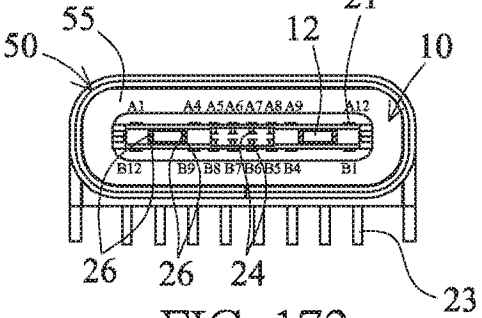

FIG. 172 is a front view showing the 23rd embodiment of the invention.

Figure 173A:
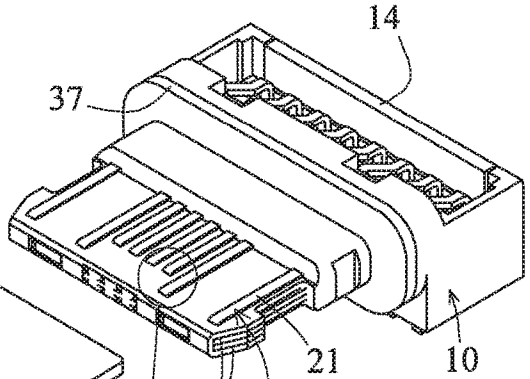
Figure 173A:
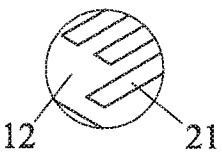
Figure 173:
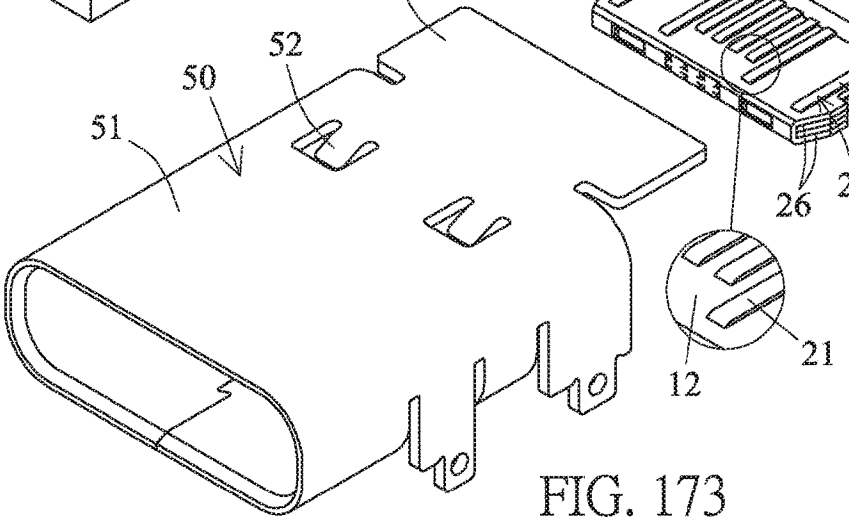

FIG. 173 is a pictorially exploded view showing the 23rd embodiment of the invention.

FIG. 173A is a pictorial view showing another implementation of the 23rd embodiment of the invention.

Figure 174:
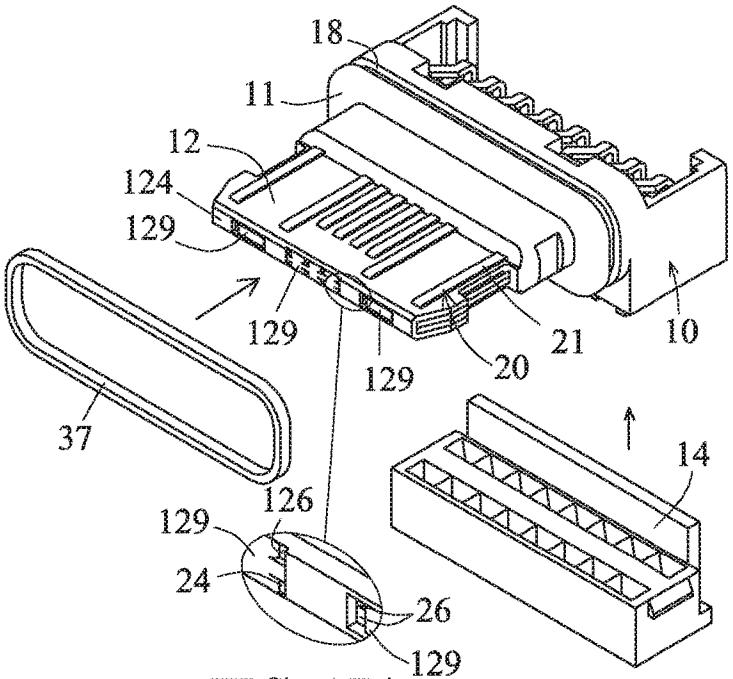

FIG. 174 is a pictorially exploded view showing the 23rd embodiment of the invention.

Figure 175:
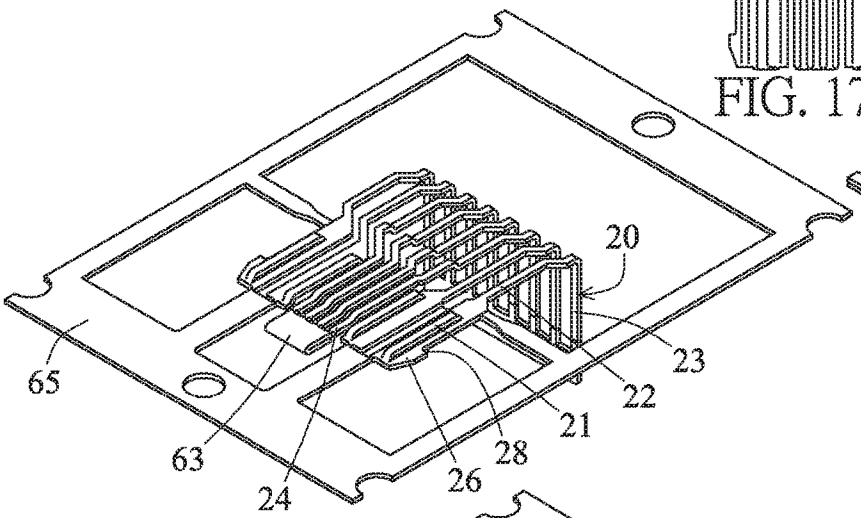
Figure 175:
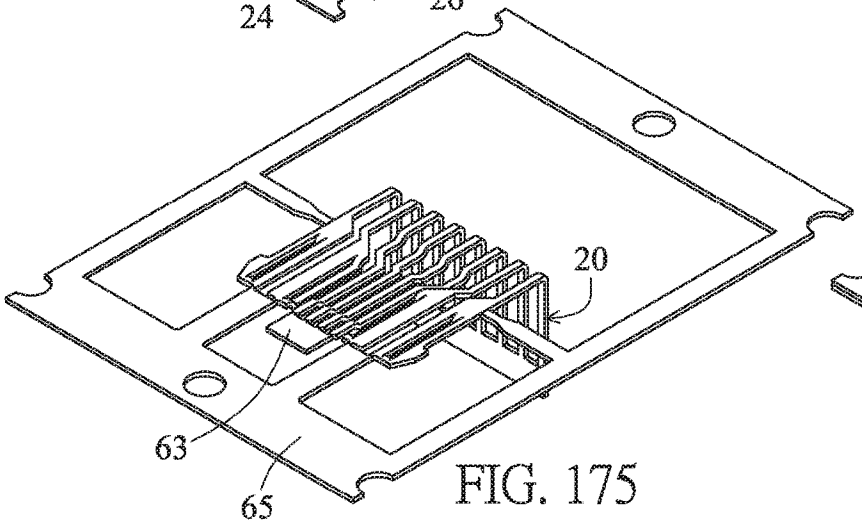

FIG. 175 is a pictorial view showing the manufacturing process of the 23rd embodiment of the invention.

Figure 176A:
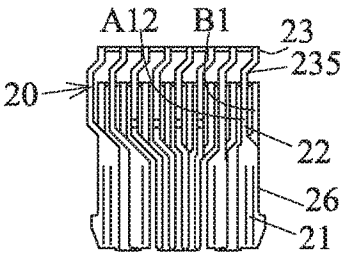
Figure 176:
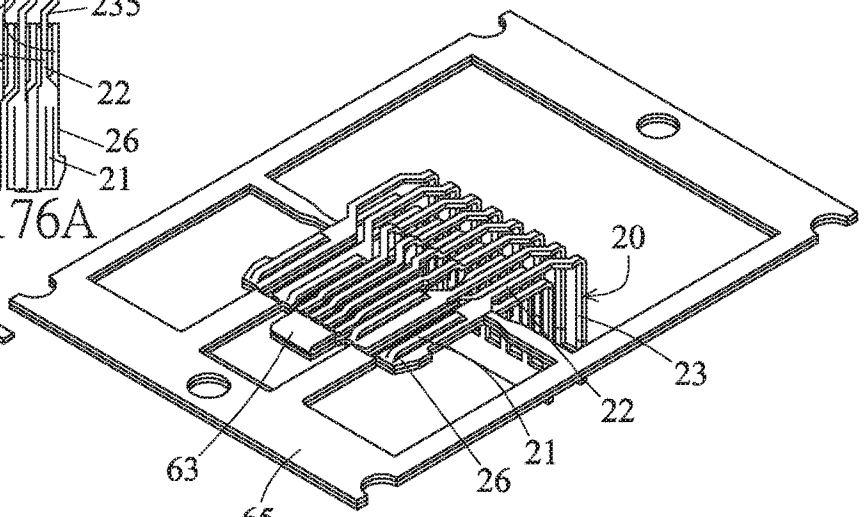

FIG. 176 is a pictorial view showing the manufacturing process of the 23rd embodiment of the invention.

FIG. 176A is a top view showing the manufacturing process of the 23rd embodiment of the invention.

Figure 177:
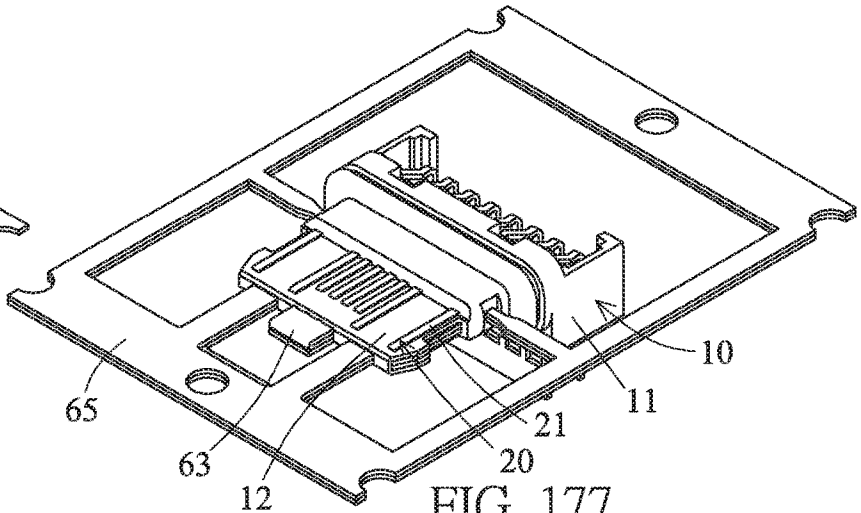

FIG. 177 is a pictorial view showing the manufacturing process of the 23rd embodiment of the invention.

Figure 178:
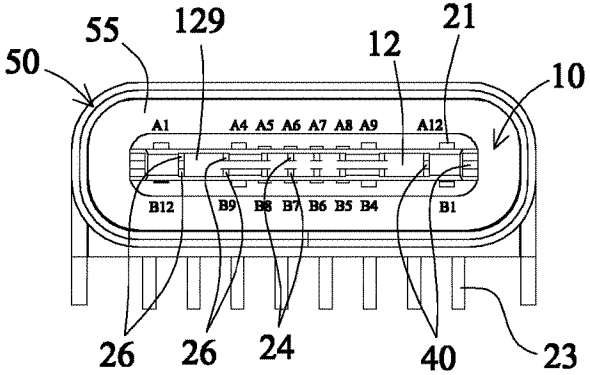

FIG. 178 is a front view showing the first modification of the 23rd embodiment of the invention.

Figure 179:
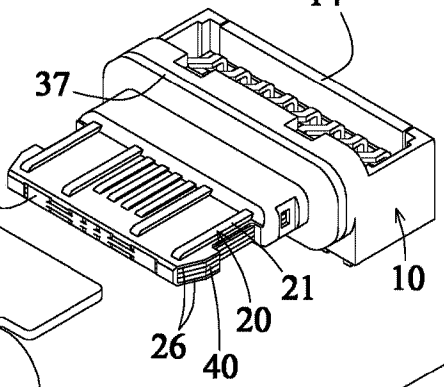
Figure 179:
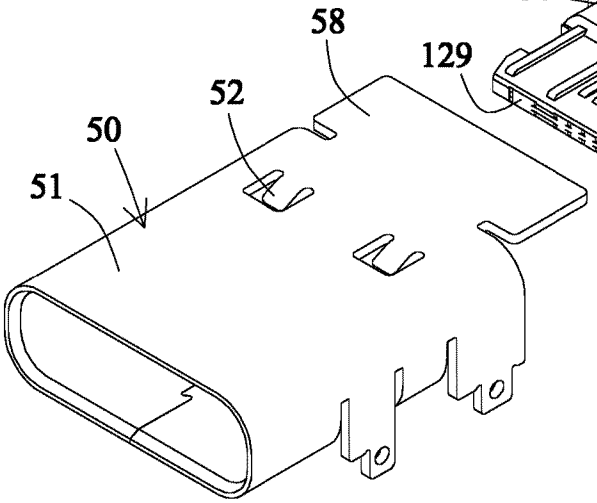

FIG. 179 is a pictorially exploded view showing the first modification of the 23rd embodiment of the invention.

Figure 180:
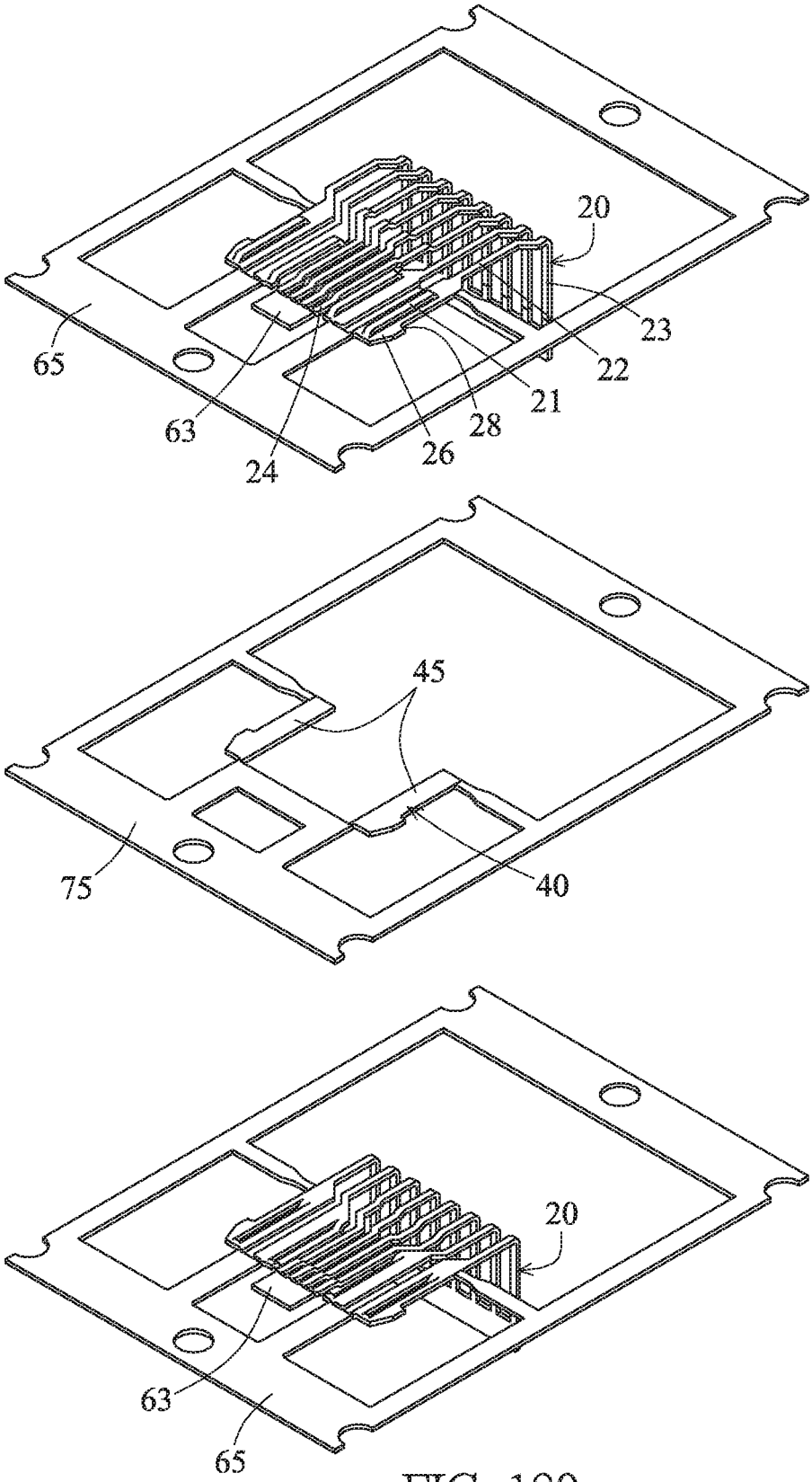

FIG. 180 is a pictorial view showing the manufacturing process of the first modification of the 23rd embodiment of the invention.

Figure 181:
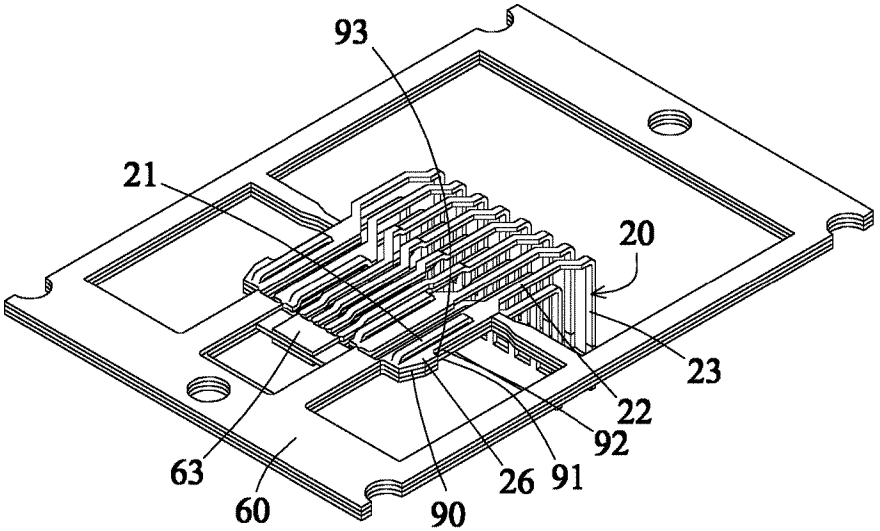

FIG. 181 is a pictorial view showing the manufacturing process of the first modification of the 23rd embodiment of the invention.

Figure 182:
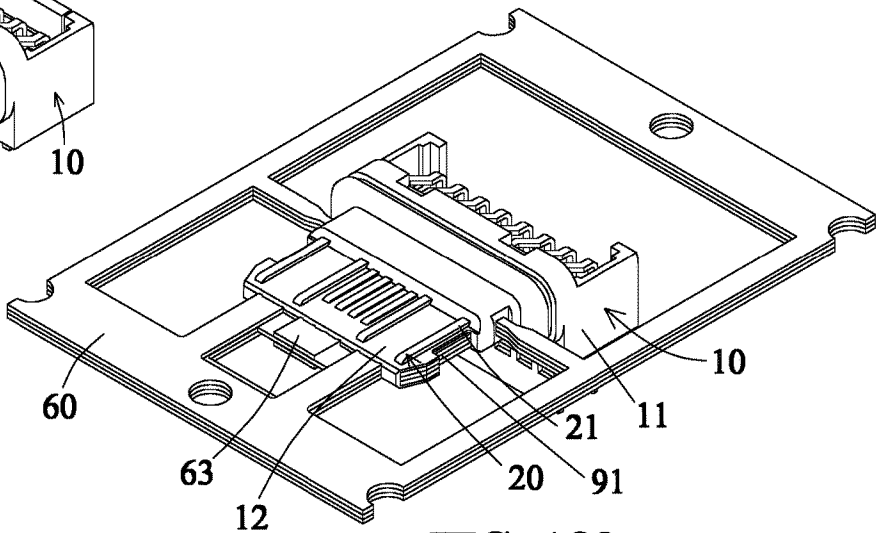

FIG. 182 is a pictorial view showing the manufacturing process of the first modification of the 23rd embodiment of the invention.

Figure 183:
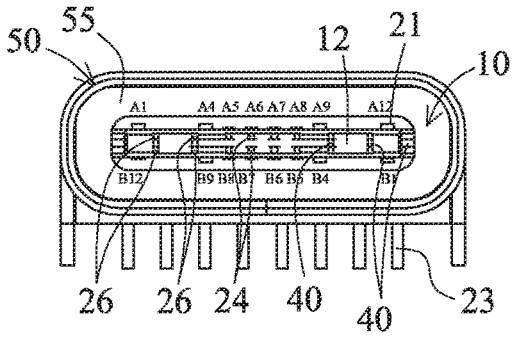

FIG. 183 is a front view showing the second modification of the 23rd embodiment of the invention.

Figure 184:
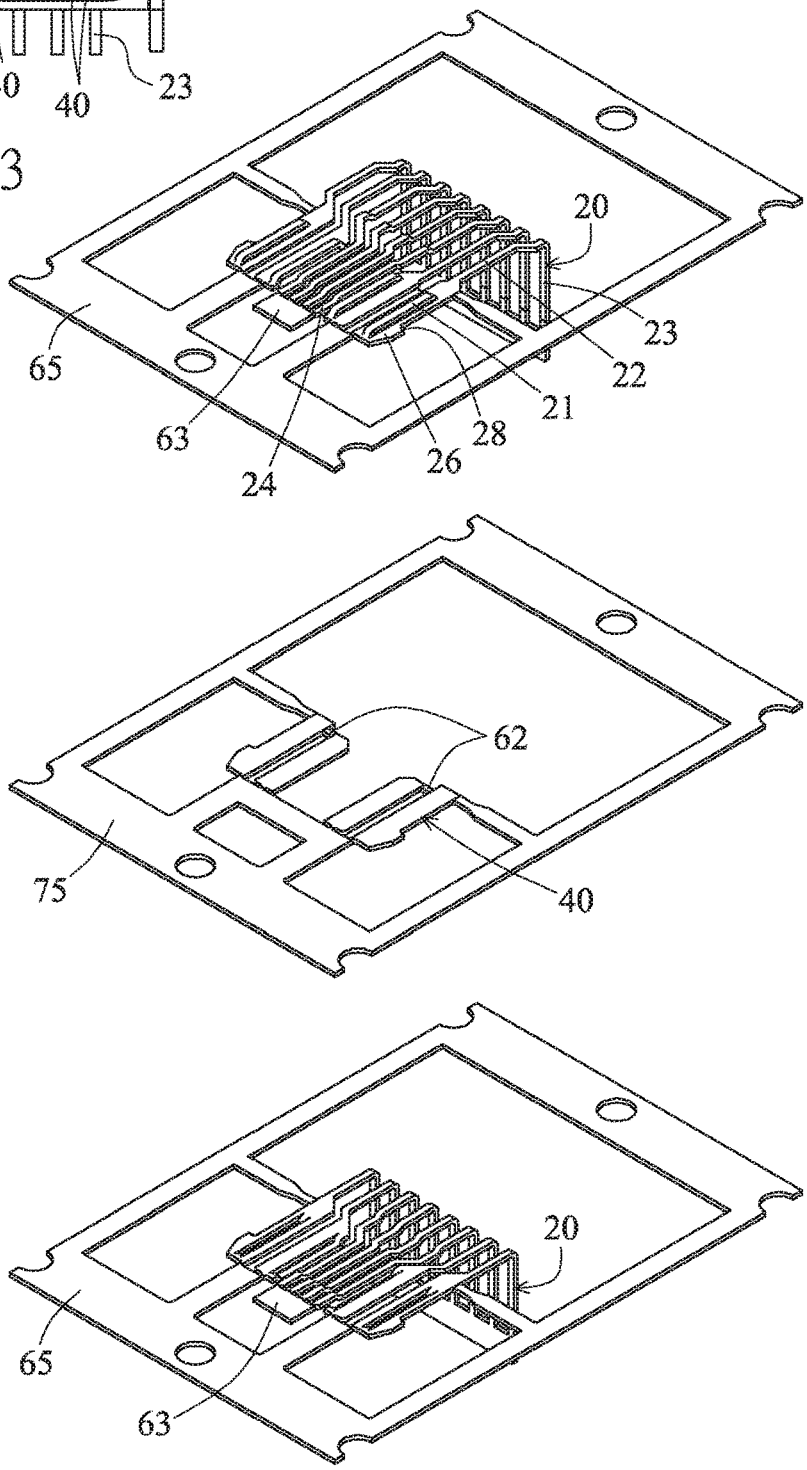

FIG. 184 is a pictorially exploded view showing the second modification of the 23rd embodiment of the invention.

Figure 185:
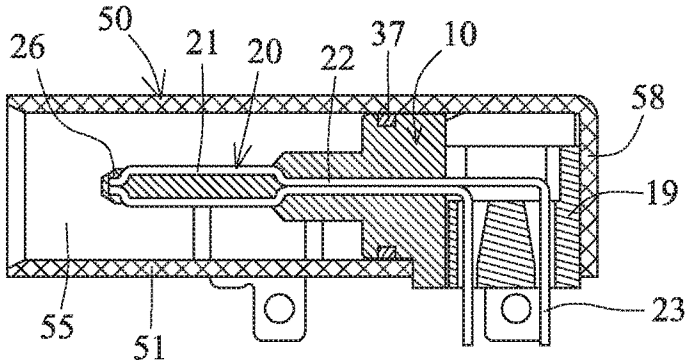

FIG. 185 is a cross-sectional side view showing the third modification of the 23rd embodiment of the invention.

Figure 186:
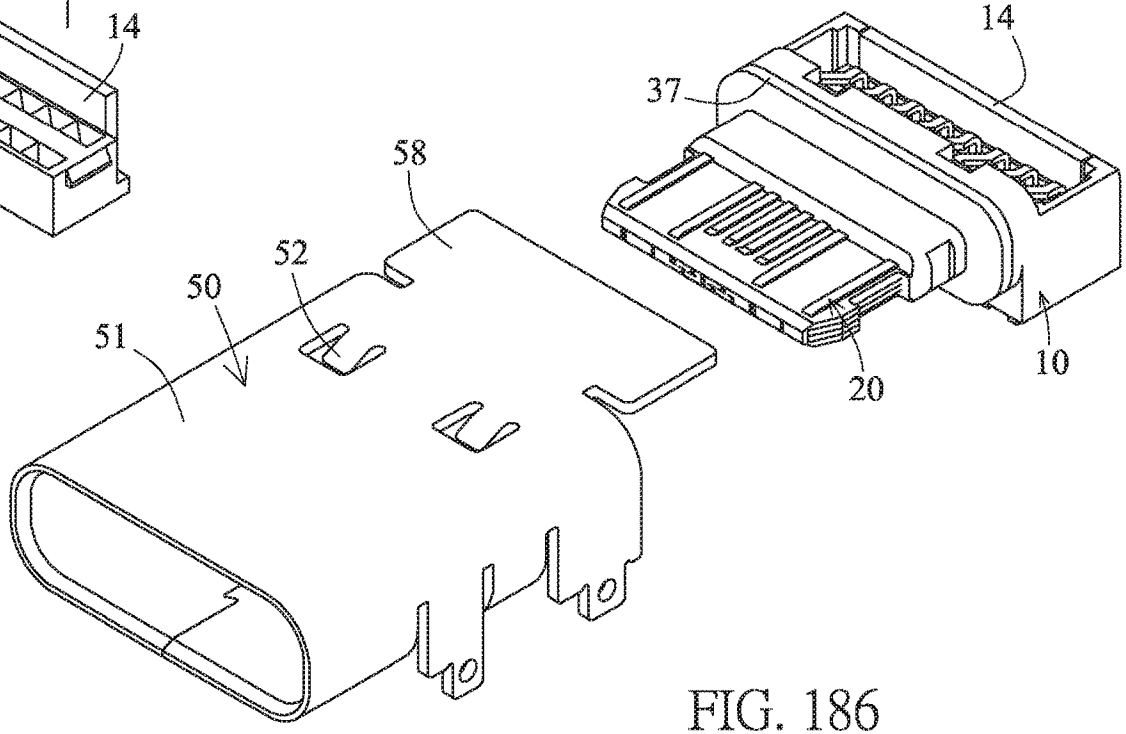

FIG. 186 is a pictorially exploded view showing the third modification of the 23rd embodiment of the invention.

Figure 187:
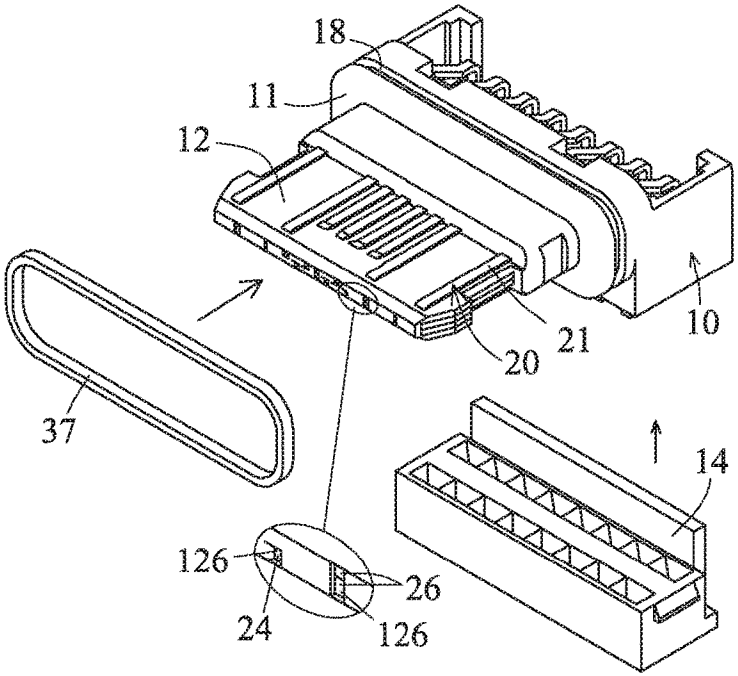

FIG. 187 is a pictorially exploded view showing the third modification of the 23rd embodiment of the invention.

Figure 188:
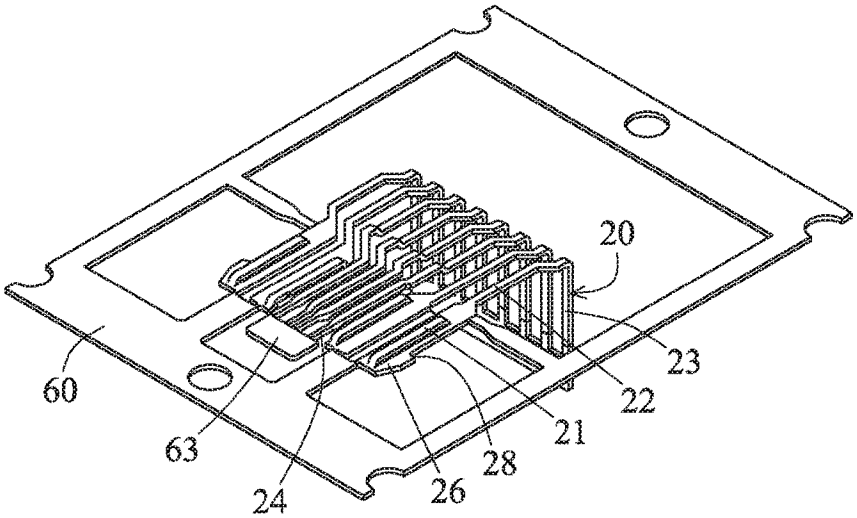
Figure 188:
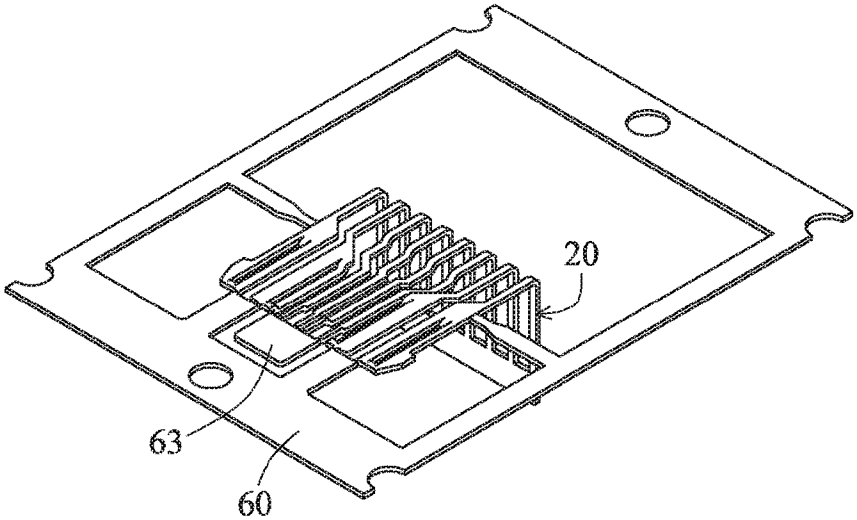

FIG. 188 is a pictorial view showing the manufacturing process of the third modification of the 23rd embodiment of the invention.

Figure 189:
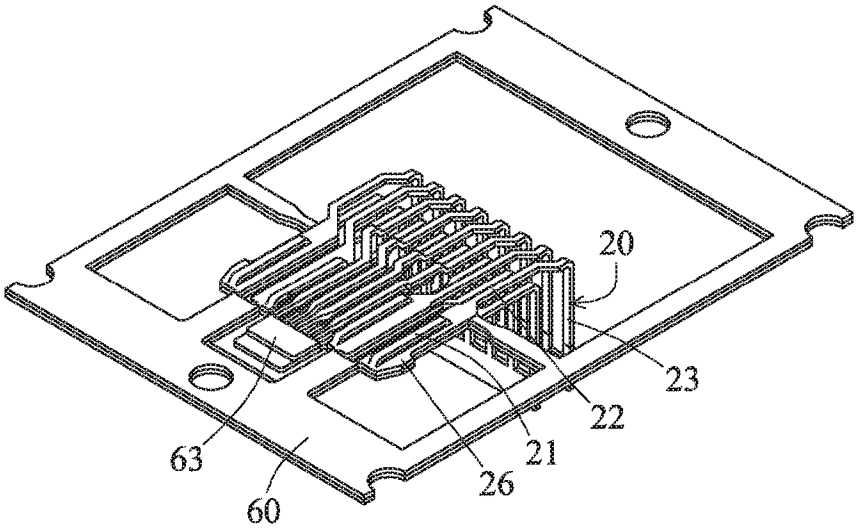

FIG. 189 is a pictorial view showing the manufacturing process of the third modification of the 23rd embodiment of the invention.

Figure 190:
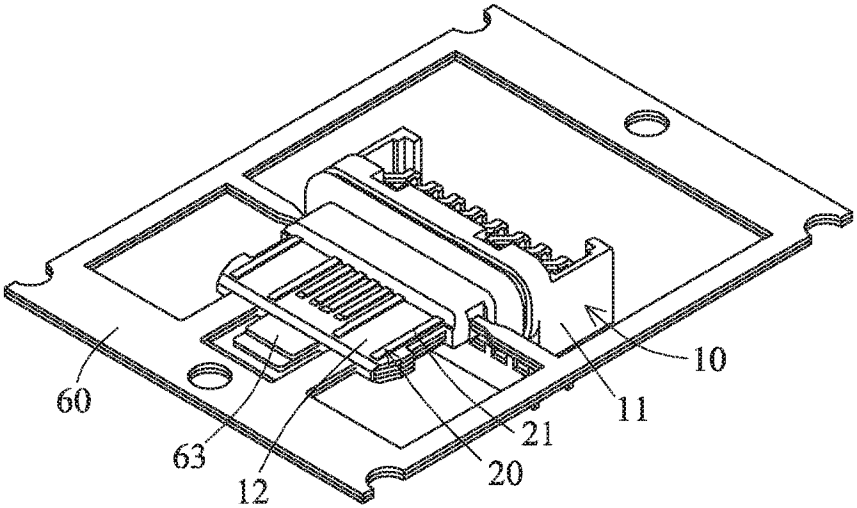

FIG. 190 is a pictorial view showing the manufacturing process of the third modification of the 23rd embodiment of the invention.

Figures 191, 192, 193, 194, 195, 196, 197, 198:
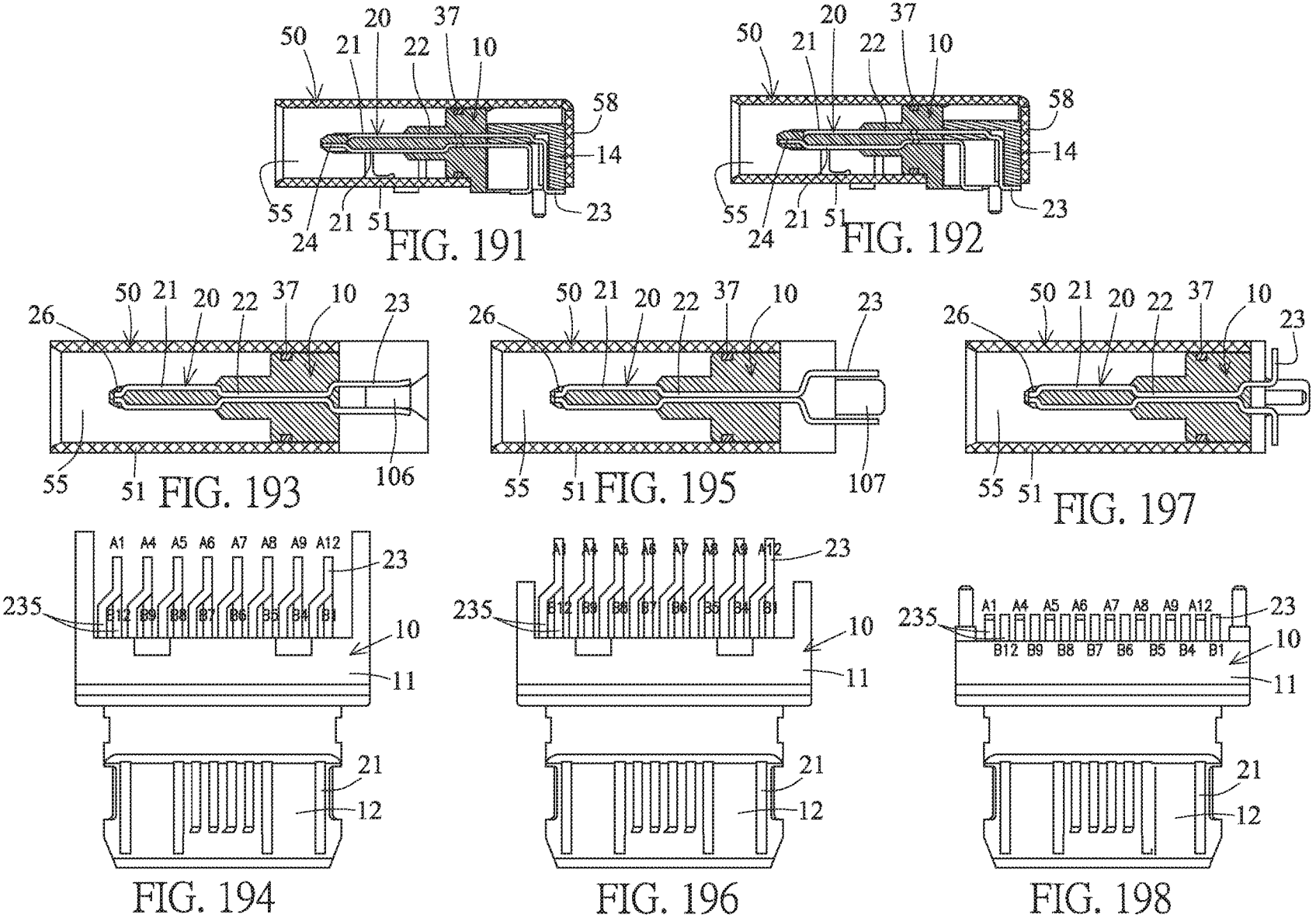

FIG. 191 is a cross-sectional side view showing the fourth modification of the 23rd embodiment of the invention.

FIG. 192 is a cross-sectional side view showing the fifth modification of the 23rd embodiment of the invention.

FIG. 193 is a cross-sectional side view showing the sixth modification of the 23rd embodiment of the invention.

FIG. 194 is a top view showing the sixth modification of the 23rd embodiment of the invention with the metal housing being removed.

FIG. 195 is a cross-sectional side view showing the seventh modification of the 23rd embodiment of the invention.

FIG. 196 is a front view showing the seventh modification of the 23rd embodiment of the invention with the metal housing being removed.

FIG. 197 is a cross-sectional side view showing the eighth modification of the 23rd embodiment of the invention.

FIG. 198 is a front view showing the eighth modification of the 23rd embodiment of the invention with the metal housing being removed.

Figure 199:
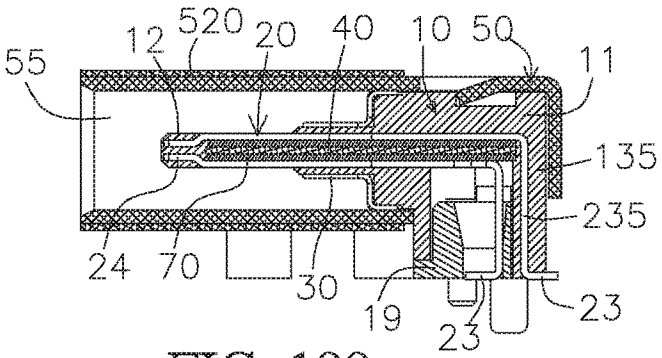

FIG. 199 is a cross-sectional side view showing the 24th embodiment of the invention.

Figure 200:
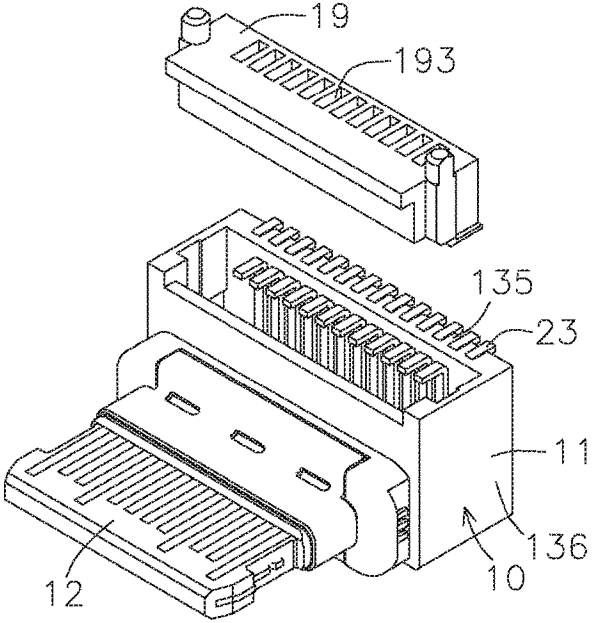

FIG. 200 is a pictorially exploded view showing the 24th embodiment of the invention.

Figure 201:
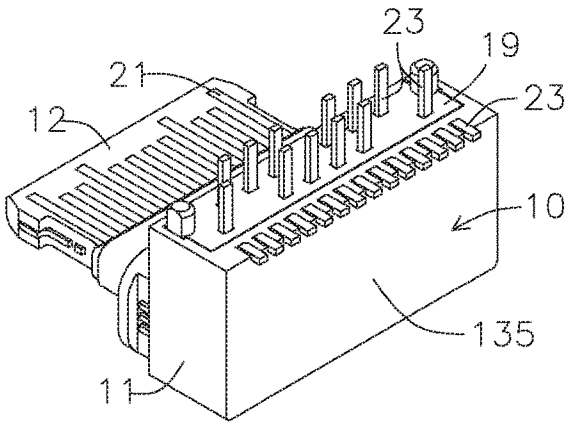

FIG. 201 is a pictorially assembled view showing the first modification of the 24th embodiment of the invention.

Figure 202:
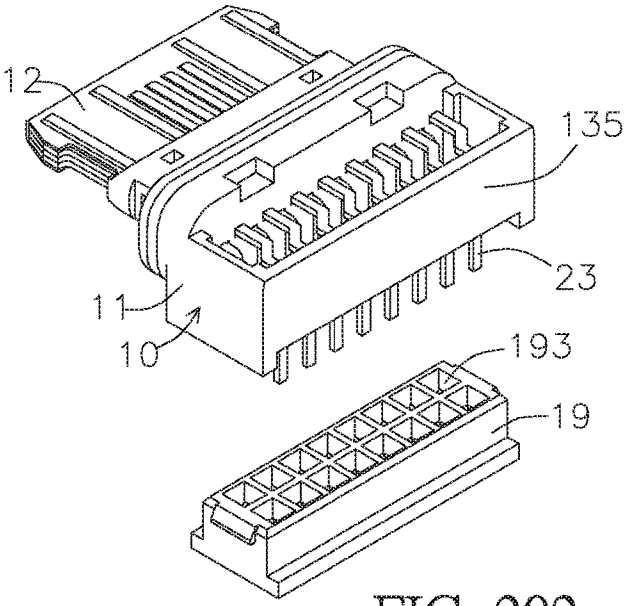

FIG. 202 is a pictorially exploded view showing the 25th embodiment of the invention.

FIG. 203 is a pictorially exploded view showing the 26th embodiment of the invention.

FIG. 204 is a pictorial view showing the manufacturing process of the 26th embodiment of the invention.

FIG. 205 is a pictorial view showing the manufacturing process of the 26th embodiment of the invention.

Figure 206:
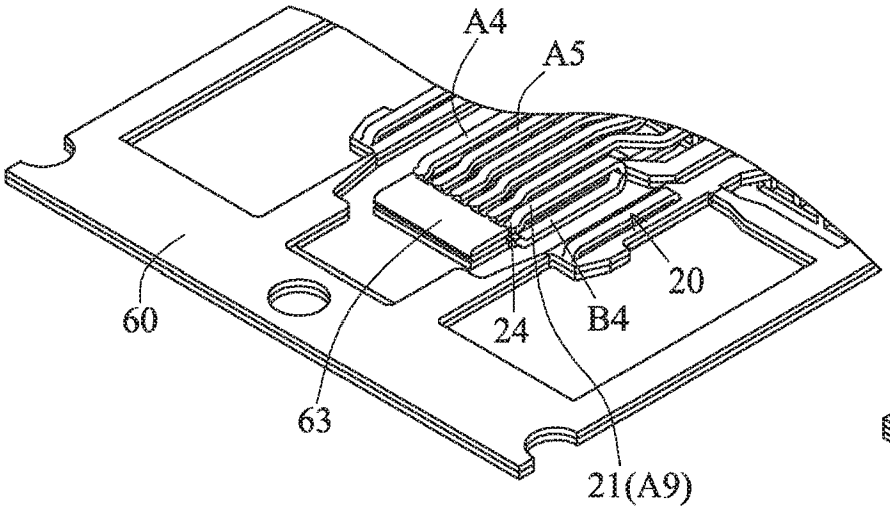

FIG. 206 is a pictorial view showing the first modification of the 26th embodiment of the invention.

Figure 207:
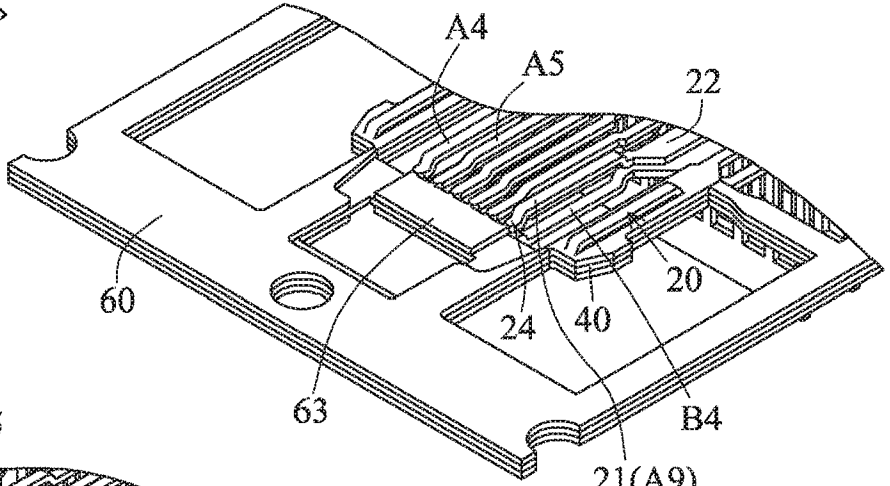

FIG. 207 is a pictorial view showing the second modification of the 26th embodiment of the invention.

Figure 208:
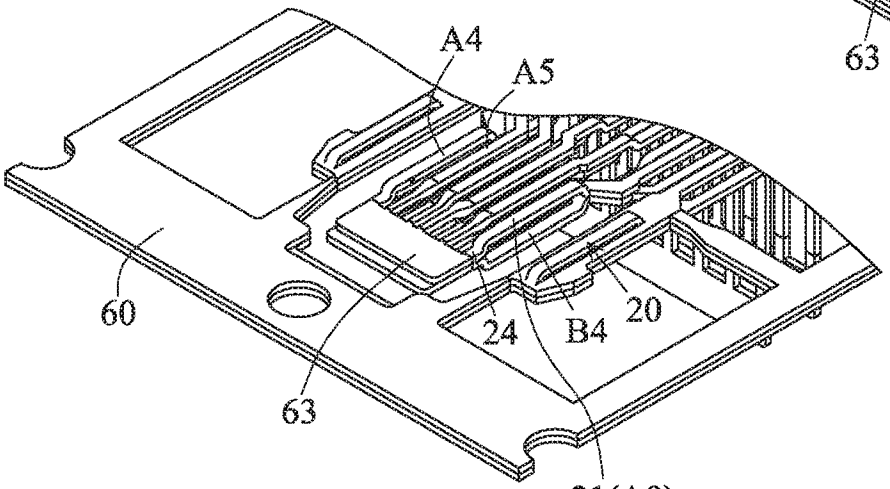

FIG. 208 is a pictorial view showing the third modification of the 26th embodiment of the invention.

Figure 209:
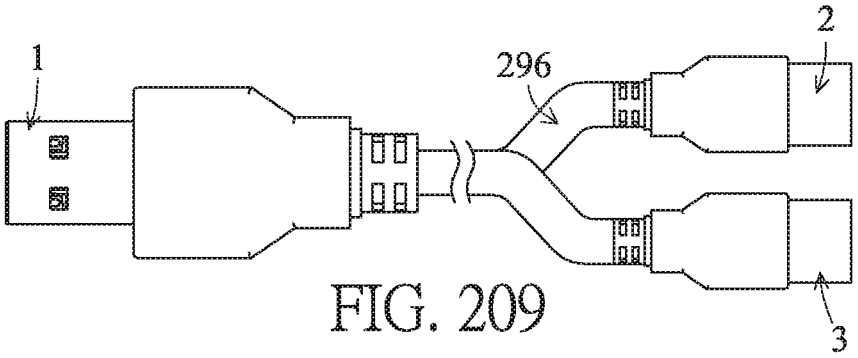

FIG. 209 is a top view showing the 27th embodiment of the invention.

Figure 210:
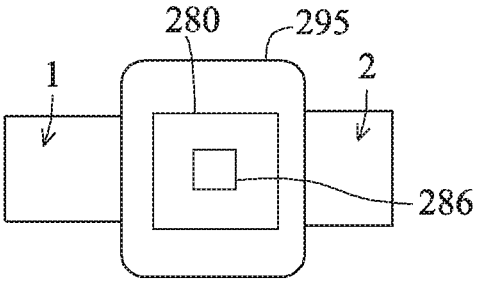

FIG. 210 is a top view showing the 28th embodiment of the invention.

DETAILED DESCRIPTION OF THE INVENTION

Referring to FIGS. 1 to 7, the first embodiment of the invention provides a plate-depressed type bidirectional duplex USB TYPE-C 3.1 electrical connection socket including an insulation seat 10, two rows of terminals 20, a ground shielding member 30, a metal partition plate, or metal snapping plate, 40, an inner insulating structure 7 and a metal housing 50.

The insulation seat 10 is made of a plastic material and integrally provided with a base seat 11 and a tongue 12, the front end of the base seat 11 is projectingly provided with the tongue 12, the inner end of the tongue 12 is connected to the base seat 11, the thickness of the base seat 11 is greater than that of the tongue 12, the top and bottom surfaces of the tongue 12 are two connection surfaces with larger plate surfaces, the rear section of the tongue 12 is thicker than the front section of the tongue 12 so that the rear sections 122 of the two connection surfaces project much more than the front sections 121 of the two connection surfaces, the left and right sides of the tongue 12 are provided with concave portions 123, the left and right sides of the rear section of the base seat 11 are provided with convex portions 13, the top surface of the front section of the base seat 11 is provided with two engagement holes 14 and an accommodating hole 16, and the top and bottom surfaces of the front section extending to tongue 12 are provided with concave surfaces 15.

Figure 2:
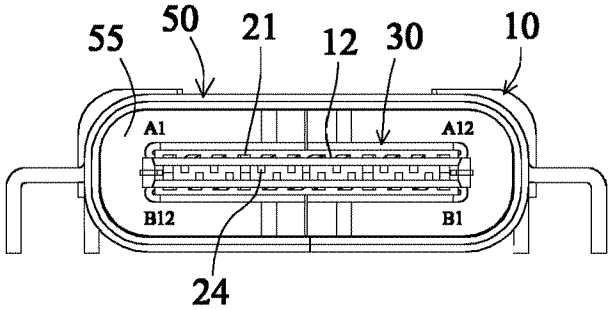
FIG. 2 is a front view showing the first embodiment of the invention.

The two rows of terminals 20, a metal partition plate 40, an inner insulating structure land the insulation seat 10 are embedded into and plastic injection molded with. Each of the two rows of terminals 20 has 12 terminals. As shown in FIG. 2, the upper row of terminals is represented by "A", the connection points with the circuit serial numbers sequentially arranged, from left to right, as A1, A2, A3 . . . A12, the lower row of terminals is represented by "B", and the connection points with the circuit serial numbers sequentially arranged, from left to right, as B12, B11, B10 . . . B1. Each terminal 20, exclusive of A7 without the backwardly extending pin, is integrally provided with, from front to rear, a connection portion 24, a contact 21, an extension 22 and a pin 23. The contact 21 in flat surface contact with the tongue 12 is elastically non-movable and is exposed to slightly project beyond the front sections 121 of the two connection surfaces. The pin 23 extends out of the rear end of the base seat 11 and has a horizontal distal section. The extension 22 is disposed between the pin 23 and the contact 21. A bent segment is formed between the connection portion 24 and the contact 21 so that the connection portion 24 is lower than the front sections 121 of the two connection surfaces and embedded into the tongue 12, an insulating structure is disposed between the adjacent connection portions 24 to prevent a short-circuited condition, the front end of the connection portion 24 is an electroplate-layer-free section 25, and the two rows of electroplate-layer-free sections 25 are aligned. When the upper row of terminals have been manufactured, the A6 and A7 are firstly connected to a dummy material sheet 62. After the two rows of terminals 20 and the insulation seat 10 have been embedded and plastic injection molded with each other, the dummy material sheet 62 is then cut off the accommodating hole 16, so that one side of each of the extension 22 of the terminals A6 and A7 forms an electroplate-layer-free section 27. The contacts 21 of the two rows of terminals 20 are respectively exposed at the front sections 121 of the two connection surfaces of the tongue 12 and are vertically aligned. The contacts 21 of the two rows of terminals are the same contact interface and are vertically aligned. The contacts of the two rows of terminals are arranged in an equally spaced manner according to the connection points of the circuit serial numbers, and two rows of contacts have connection points with the same serial numbers arranged reversely. In addition, the contacts 21 (longer contacts 21*a* and shorter contacts 21*b*) of the two rows of terminals are respectively arranged in two rows having different lengths. That is, four long terminals and eight short terminals are provided.

In addition, the extensions 22 of two side terminals of each row of terminals 20 are connected to two material sheets 201, and each of the outer ends of the two material sheets 201 is in the form of an electroplate-layer-free section 202.

Each of the front sections of the left and right sides of the metal partition plate 40 is integrally provided with a depressed snap 41. Each of the left and right sides of the rear end thereof is provided with a pin 42, and three opening holes 43 are provided at the middle. A hollow region 46 is provided at the middle of the front section of the metal partition plate. Each of the two snap 41 is integrally provided with a depressed surface 411 and a locking surface 412, which are of metal material. The inner insulating structure 7 is provided with two insulating layers 70, which are in flat surface contact with the top and bottom surfaces of the metal partition plate 40. The inner insulating structure is provided with an upper supporting surface 72 on the upper side of the metal partition plate 40, and is provided with a lower supporting surface 73 on the lower side of the metal partition plate. An isolation region 74 is provided in front of the upper and lower supporting surface of the inner insulating structure 7, and the hollow region 46 in front of the metal partition plate corresponds to the isolation region 74. The two insulating layers 70 are mylars. However, the insulating layer may also be formed by way of painting, spraying, electrolysis, electroplating, adhesion or the like. The contacts 21 and extension 22 of the two rows of terminals 20 are respectively in flat surface contact with and rest against the two insulating layers 70. The bent segments of the two rows of terminals 20 are bent toward a middle of the insulation seat 10 so that the connection portions 24 are disposed in front of the two insulating layers 70 and the metal partition plate 40.

Each of the upper and lower supporting surfaces 72 and 73 is provided with multiple longer supporting surfaces 77 supporting multiple longer contacts 21*a*, and multiple shorter supporting surfaces 78 supporting multiple shorter contacts 21*b*. Optionally, the structure of the insulating layer 70 is only disposed on the essential isolating portions of the one row of terminals 20 and the metal partition plate 40 to limit the terminal 20 from contacting the metal partition plate to cause the short-circuit condition. In addition, the insulating layer is not provided on other portions, which do not need the isolation, and the injection molding thickness of the embedded insulation body can be increased.

The ground shielding member 30 is formed by bending or pulling and extending a metal plate sheet, and is integrally provided with a grounding ring 31 and two extension sheets 32. The grounding ring 31 is fitted with and fixed to the rear section 122 of the two connection surfaces of the tongue. The two extension sheets 32 are bonded or connected to the concave surface 15 of the base seat 11.

The metal housing 50 covers the insulation seat 10 and rests against and engages with the base seat 11. The metal housing 50 is formed by bending a metal plate sheet and has a front section provided with a four-sided main housing 51. The top of the rear section of the metal housing 50 is provided with two engaging sheets 52 engaging with two engagement holes 14 of the base seat 11, and two sides of the rear end thereof are provided with two left-right symmetrical rear plate connecting members 54. The plate surface of the four-sided main housing 51 is prodded and bent to form two left-right symmetrical front plate connecting members 53. The four-sided main housing 51 and the front end of the base seat 11 form a connection slot 55 in the four-sided main housing 51. The tongue 12 is horizontally suspended at the middle height of the connection slot 55 and extends frontwards. The insert port of the connection slot 55 faces frontwards. The connection slot 55 and the tongue 12 form a docking structure to be reversibly and dual-positionally inserted by an electrical connection plug for electrical connecting and positioning. The front end of the tongue 12 is close to the insert port of the connection slot 55. The two connection surfaces of the tongue 12 form the symmetrical spaces. The connection slot 55 has a top-bottom symmetrical and left-right symmetrical shape and has two arced sides to approach a rectangular shape.

The USB TYPE-C connection points specified by USB Association have circuit serial numbers to be described in the following: 1 and 12 represent one pair of ground terminals arranged in a left-right symmetrical manner; 4 and 9 represent one pair of power terminals arranged in a left-right symmetrical manner; 2 and 3 represent one pair of high differential signal terminals (TX+, TX−); 10 and 11 represent the other one pair of high differential signal terminals (RX+, RX−); 6 and 7 represent one pair of low differential signal terminals (D+, D−); and 5 and 8 represent detection terminals. Upon design, the vertically aligned ground terminal and power terminal can be bridged, and the vertically arranged one pair of low differential signal terminals (D+, D−) can also be bridged. Four longer contacts of each row of terminals are connection points with circuit serial numbers 1 and 12 (two grounding contacts) and 4 and 9 (two power contacts), the eight shorter contacts thereof are connection points with circuit serial numbers 2, 3, 5, 6, 7, 8, 10, 11 (one pair of low differential signal contacts, two pairs of high differential signal contacts and two detection contacts). Multiple longer contacts of the two rows of contacts, which are vertically aligned in an up-down direction are contacts with the same circuit, and multiple shorter contact of the two rows of contacts, which are vertically aligned in an up-down direction, are contacts with different circuits.

A design key point of the invention is to bridge the terminals with the same circuit, which can be bridged, in the upper and lower rows of terminals in order to decrease the number of pins, so that it is beneficial to the design of the arrangement of the pins. The details will be explained in the following.

Figure 7:
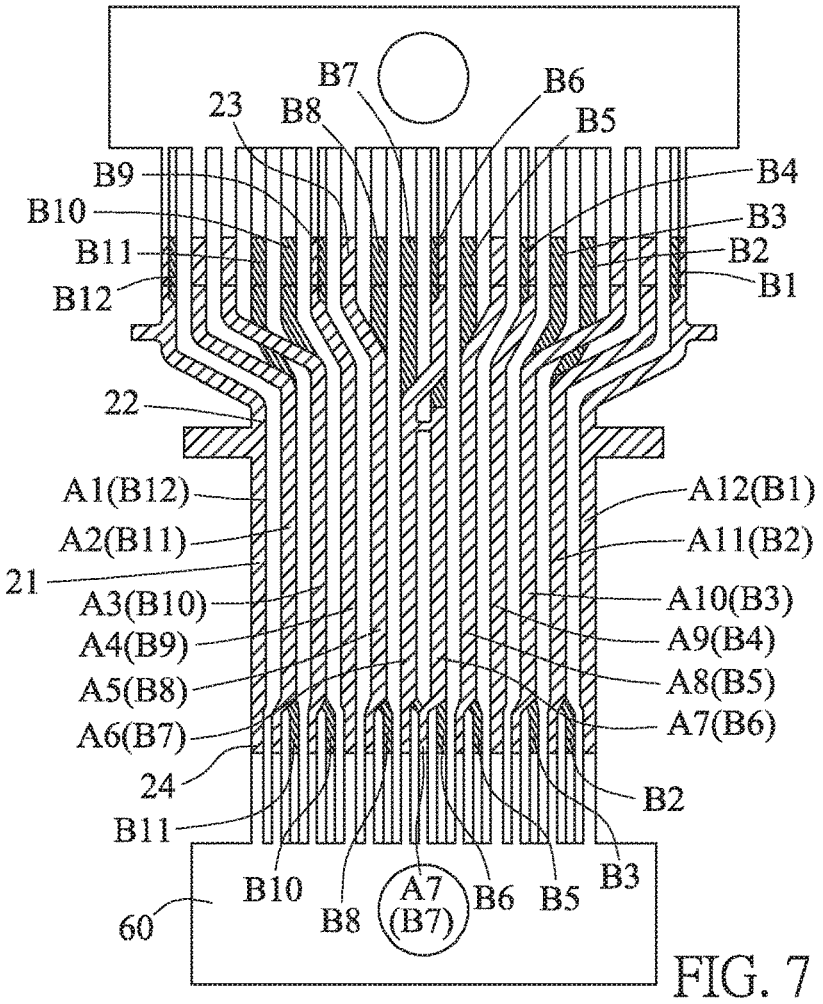
FIG. 7 is a top view showing two rows of terminals of the first embodiment of the invention.

Upon manufacturing, connection portions 24 and the pins 23 of each of the rows of terminals are connected to material tapes 60. Referring to FIGS. 2 and 7, the contacts 21 of the two rows of terminals 20 are vertically aligned, and two rows of contacts have connection points with circuit serial numbers arranged reversely. That is, the contacts 21 of A1 and B12 are vertically aligned, the contacts 21 of A2 and B11 are vertically aligned, the contacts 21 of A3 and B10 are vertically aligned, the contacts 21 of A4 and B9 are vertically aligned, the contacts 21 of A5 and B8 are vertically aligned, the contacts 21 of A6 and B7 are vertically aligned, the contacts 21 of A7 and B6 are vertically aligned, the contacts 21 of A8 and B5 are vertically aligned, the contacts 21 of A9 and B4 are vertically aligned, the contacts 21 of A10 and B3 are vertically aligned, the contacts 21 of A11 and B2 are vertically aligned, and the contacts 21 of A12 and B1 are vertically aligned. A1 and B12 are ground terminals, A12 and B1 are ground terminals, A4 and B9 are power terminals, A9 and B4 are power terminals, and the four pairs are the terminals with the same circuit. So, the connection portions 24 of the four pairs of terminals vertically rest against each other, and the pins 23 of the rear ends are horizontally flush with each other and combined together or adjacent and close to each other. A2 and B11, A3 and B10, A5 and B8, A6 and B7, A7 and B6, A8 and B5, A10 and B3 and A11 and B2 are the terminals with different circuits, so the connection portions 24 of the eight pairs of terminals are staggered in a left-to-right manner. In addition, regarding the pins of the rear ends (exclusive of A6 and B6 that are horizontally flush with each other and combined together or adjacent and close to each other), the pins of the other terminals are horizontally flush with each other and separately arranged. The five pairs of pins 23, which are horizontally flush with each other and combined together or adjacent and close to each other, have the narrower widths. That is, two pins resting against each other and combined together have the total width substantially the same as the width of the other single pin. In addition, because A7 has no pin, the connection portions 24 of A7 and B7 vertically rest against each other.

With the above-mentioned design, the two rows of terminals 20 totally having 24 terminals can be arranged with one row of 18 pins in a horizontally flush manner, so that one row of horizontally flush arrangements can be made within the range of the width of the insulation seat 10.

In addition, the pins of each pair of high differential signal terminals of the two rows of terminals are adjacent to and parallel to each other and substantially arranged in an equally-spaced manner. So, the pins of each pair of high differential signal terminals (e.g., A2/A3, B11/B10) facing each other in a vertical direction are one left pin and one right pin, biased, adjacent to and parallel to each other and substantially arranged in an equally-spaced manner.

The rear sections of the extensions 22 of the at least one pair or two pairs of terminals (ground terminal, power terminal, high differential terminal, low-high differential terminal, and detection terminal) of the two rows of terminals 20 are turned to left and right sides and transversally and outwardly extended relatively to the contacts 21, so that the arrangement width of the pins 23 of each row of terminals is greater than the arrangement widths of the contacts 21. In this embodiment, the rear sections of the extensions 22 of the upper row of terminals are turned to left and right sides and transversally and outwardly extended relatively to the contacts 21. The rear sections of the extensions 22 of the two ground terminals B1 and B12, two power terminals B4 and B9 and two pairs of high differential terminals B2/B3 and B10/B11 of the lower row of terminals are turned to left and right sides and transversally and outwardly extended relatively to the contacts 21.

Figure 8:
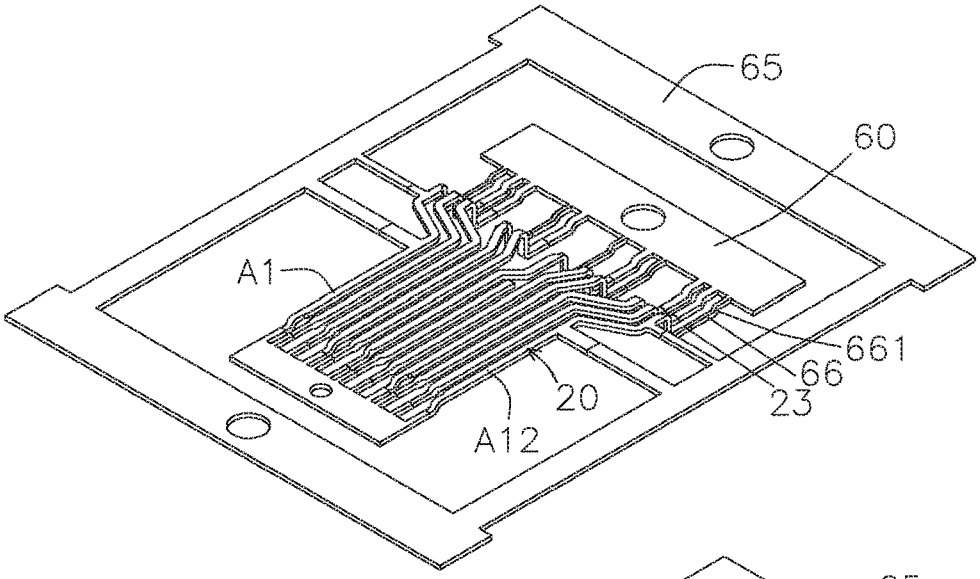
FIG. 8 is a pictorial view showing the upper row of terminals connected to the material tape of the first embodiment of the invention.
Figure 9:
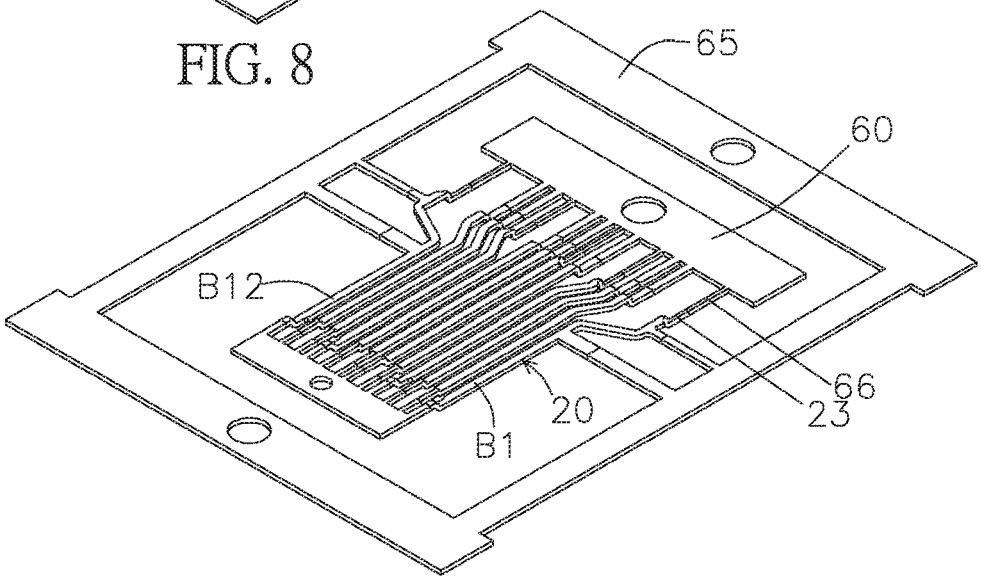
FIG. 9 is a pictorial view showing the lower row of terminals connected to the material tape of the first embodiment of the invention.
Figure 10:
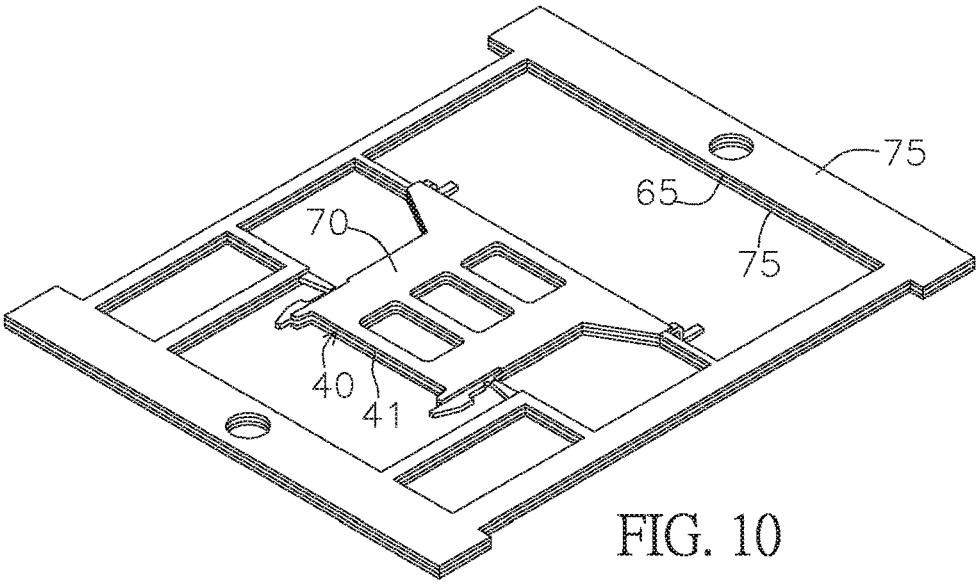
FIG. 10 is a pictorial view showing the metal partition plate and the two insulating layers connected to the material tapes according to the first embodiment of the invention.

The manufacturing processes of this embodiment will be described in the following. Referring to FIGS. 8 and 9, when the two rows of terminals 20 are manufactured by way of stamping, the front and rear ends of each of the terminals of each row of terminals 20 are connected to a material tape 60, and the two material sheets 201 of the extensions 22 of the two side terminals are connected to an outer material tape 65. Referring also to FIG. 10, the metal partition plate 40 and two insulating layers 70 are formed by stamping a metal sheet having two surfaces each adhered to a mylar layer. The metal partition plate 40 has left and right sides connected to an outer material tape 65. The distal section of each pin 23 is horizontal and connected to a material bridge 66. Each of the two rows of material bridges 66 is connected to the one material tape 60. Each of one row of material bridges 66 is provided with a bent segment 661 so that a height difference is formed between the material tape 60 and distal sections of the one row of pins 23 connected to the one row of material bridges. The two insulating layers 70 have left and right sides connected to an outer material tape 75.

Figure 11:
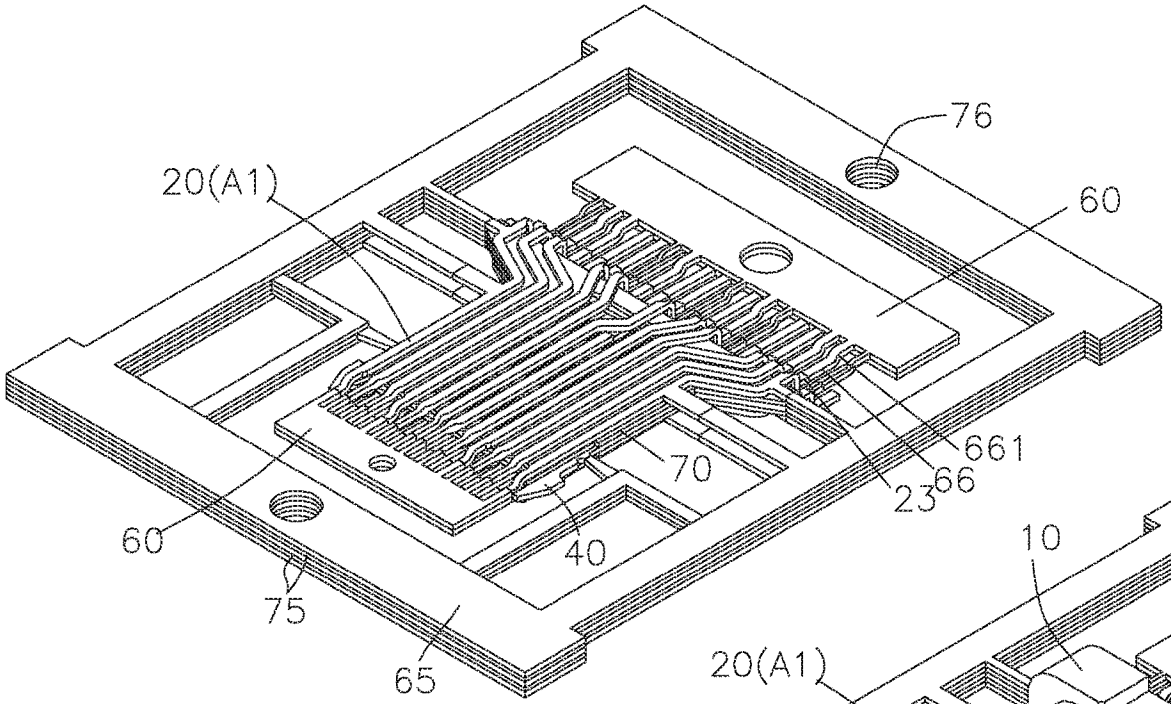
FIG. 11 is a pictorial view showing the manufacturing process of the first embodiment of the invention.
Figure 12:
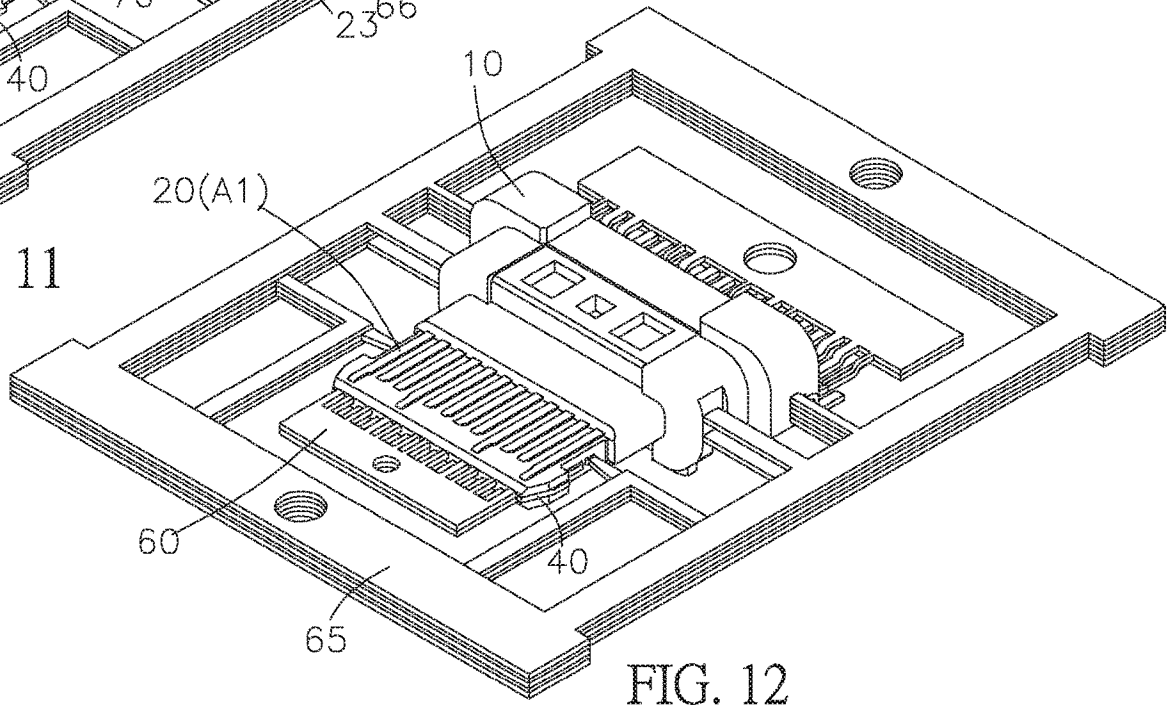
FIG. 12 is a pictorial view showing the manufacturing process of the first embodiment of the invention.
Figure 14:
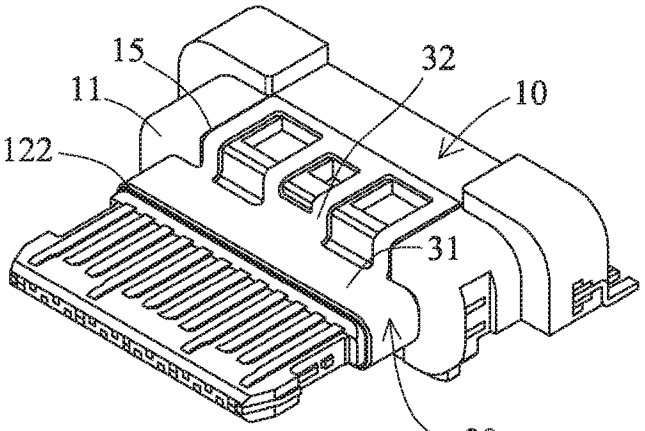
FIG. 14 is a pictorial view showing the manufacturing process of the first embodiment of the invention.
Figure 13:
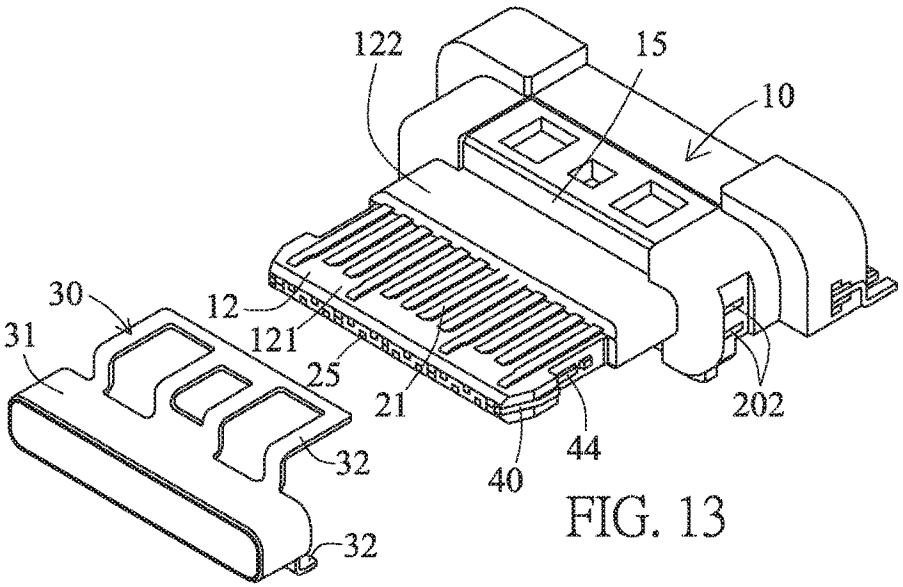
FIG. 13 is a pictorial view showing the manufacturing process of the first embodiment of the invention.
Figure 15:
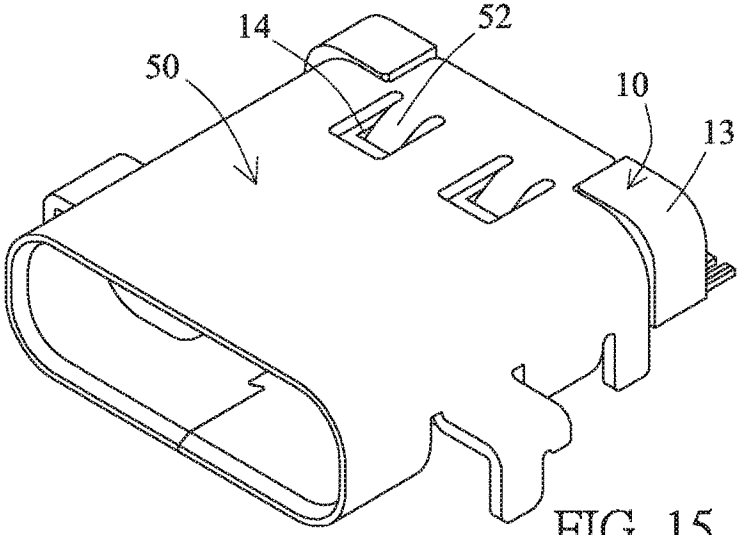
FIG. 15 is a pictorial view showing the manufacturing process of the first embodiment of the invention.

Referring to FIG. 11, under the operation of the automatic machine, the two rows of terminals 20, the two insulating layers 70 (inner insulating structure) and the metal partition plate 40 are stacked in an aligned manner through positioning holes 76, and the two rows of terminals 20 are separated from the metal partition plate 40 through the two insulating layers 70. The two rows of terminals 20 clamp and position the inner insulating structure in a top-down direction through the stacked two material tapes 60, and clamp upper and lower supporting surfaces of the inner insulating structure. Because the one row of material bridges 66 are provided with bent segments 661, the distal sections of two rows of pins 23 can be arranged at the same height. Referring to FIG. 12, the two rows of terminals 20, two insulating layers 70 and the metal partition plate 40 are embedded into the plastic material at a time to form the insulation seat 10 by way of injection molding. Referring to FIG. 13, after the material tape 60 and the outer material tape 65 have been removed, it is ready to assemble the ground shielding member 30 from front to rear, and the electroplate-layer-free sections 202 of the two material sheets 201 are exposed at the left and right sides of the base seat of the insulation seat 10. Referring to FIG. 14, the grounding ring 31 of the ground shielding member 30 is fitted with and fixed to the rear section 122 of the two connection surfaces of the tongue, the two extension sheets 32 are bonded or connected to the concave surface 15 of the base seat 11. Referring to FIG. 15, the metal housing 50 is finally assembled from front to rear to cover the insulation seat 10.

With the above-mentioned structure, the following advantages can be generalized.

1. The two insulating layers 70 are in flat surface contact with the top and bottom surfaces of the metal partition plate 40. When the two rows of terminals stacked on the top and bottom surfaces of the metal partition plate 40, the separation using the two insulating layers 70 can prevent the short-circuited condition. The two rows of terminals and the insulation seat can be embedded and plastic injection molded with each other at a time, and the manufacturing can be simplified.

2. The pins of one pair of terminals of the two rows of terminals having vertically aligned contacts and the same circuit are combined together or adjacent and close to each other, so that the number of pins can be decreased, and it is beneficial to arrange the pins within the width of the insulation seat, so that the pins of the two rows of terminals are arranged into one row of flush and horizontal pins.

Figure 16:
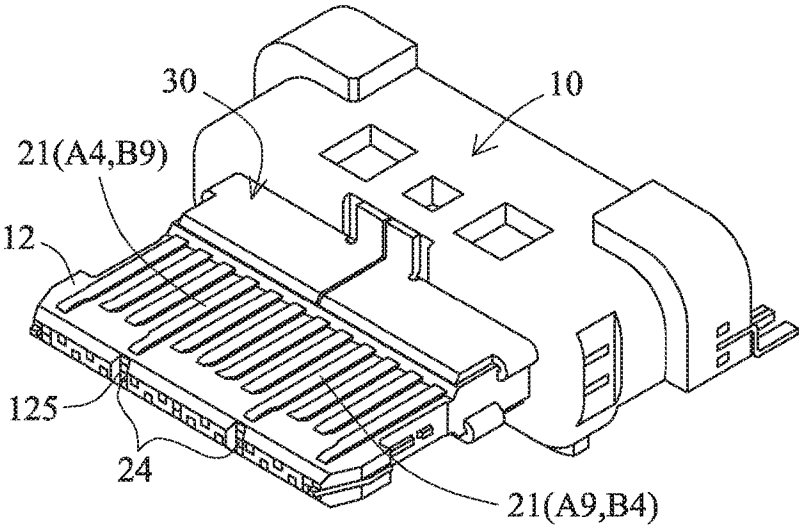
FIG. 16 is a pictorial view showing the first modification of the first embodiment of the invention.

Referring to FIG. 16 showing the first modification of this embodiment, the positions at the front end of the tongue 12 corresponding to the contacts 21 of the terminals A4, B9, A9 and B4 are provided with concave portions 125, so that the connection portions 24 of the 4 power terminals can be retracted inwardly to prevent the short-circuited condition from occurring when the plug is improperly inserted.

Figure 17:
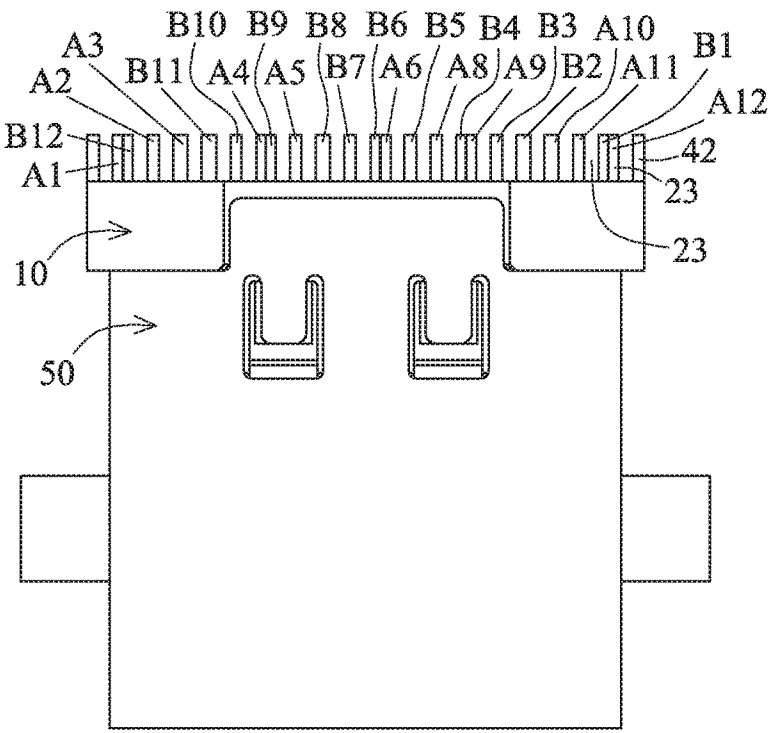
FIG. 17 is a top view showing the second modification of the first embodiment of the invention.
Figure 18:
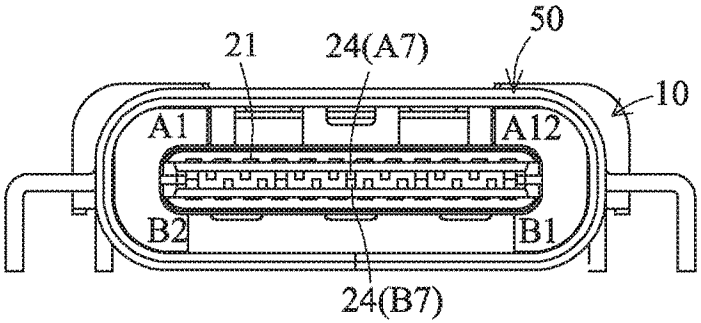
FIG. 18 is a front view showing the second modification of the first embodiment of the invention.

Referring to FIG. 17 and FIG. 18 showing the second modification of this embodiment, the difference resides in that the pins 23 of the terminals have substantially equal widths. Thus, the total width of the horizontally flush two pins resting against each other and combined together is wider than the single pin.

Figure 19:
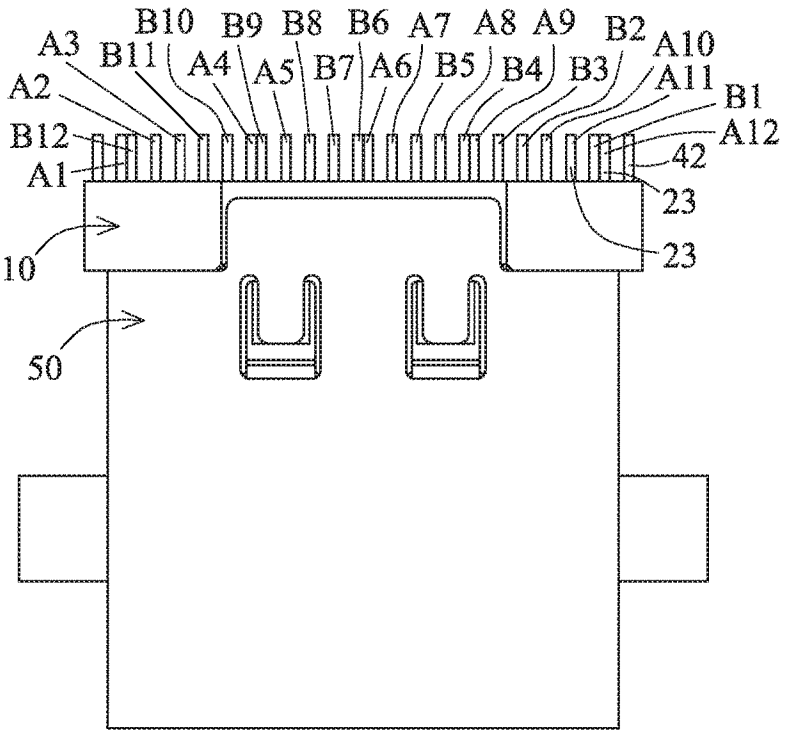
FIG. 19 is a top view showing the third modification of the first embodiment of the invention.
Figure 20:
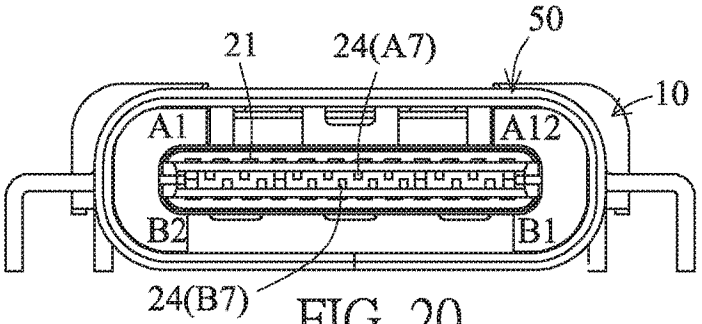
FIG. 20 is a front view showing the third modification of the first embodiment of the invention.

Referring to FIG. 19 and FIG. 20 showing the third modification of this embodiment substantially the same as the FIG. 17 and FIG. 18, the difference resides in that the connection portions 24 of the terminals A7 and B7 are staggered in a left-to-right manner, and the terminal A7 is provided with the pin 23.

Figure 21:
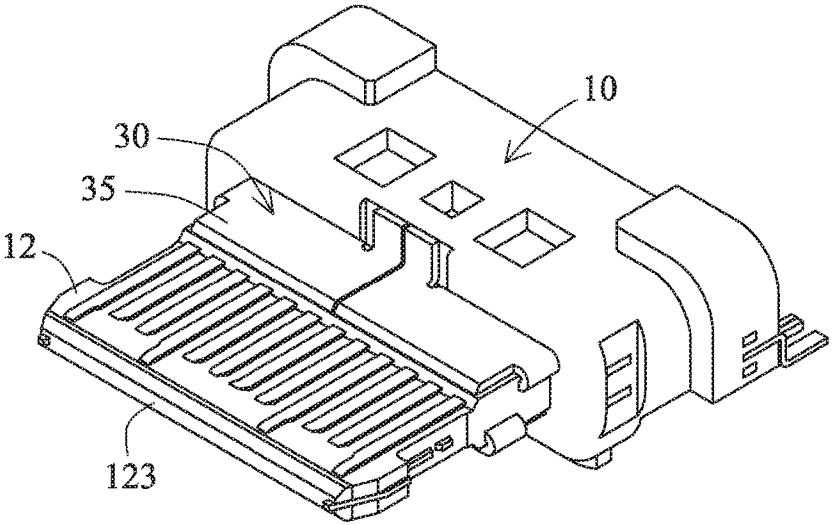
FIG. 21 is a pictorial view showing the fourth modification of the first embodiment of the invention.

Referring to FIG. 21 showing the fourth modification of this embodiment, the difference resides in that the ground shielding member 30 is provided with four ground shielding sheets 35 respectively integrally connected to the ground terminals on two sides of the two rows of terminals 20.

Figure 22:
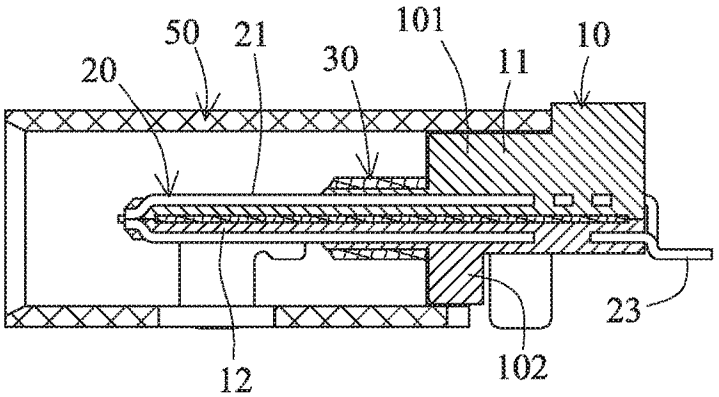
FIG. 22 is a cross-sectional side view showing the fifth modification of the first embodiment of the invention.

Referring to FIG. 22 showing the fifth modification of this embodiment, the difference resides in that the insulation seat 10 is provided with an upper seat 101 and a lower seat 102 which are vertically stacked. The upper row of terminals are embedded into, plastic-injected molded with and fixed to the upper seat 101. The lower row of terminals are embedded into, plastic-injected molded with and fixed to the upper seat 102. The metal partition plate 40 is stacked between the upper and lower seats 101 and 102, so this modification is not provided with two insulating layers 70.

Figure 23:
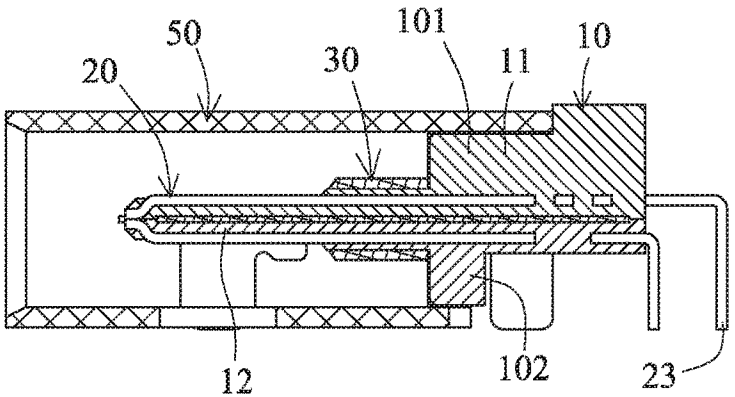
FIG. 23 is a cross-sectional side view showing the sixth modification of the first embodiment of the invention.
Figure 25:
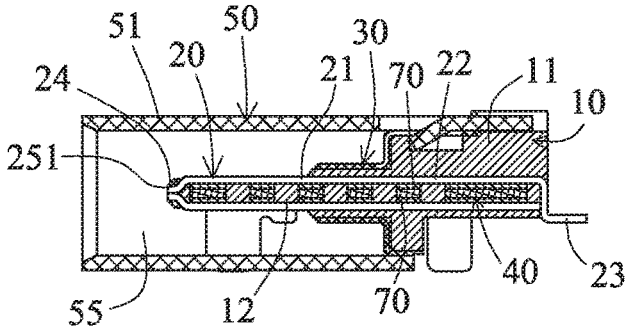
FIG. 25 is a cross-sectional side view showing the eighth modification of the first embodiment of the invention.

Referring to FIG. 23 showing the sixth modification of this embodiment substantially the same as the FIG. 22, the difference resides in that the pins 23 of the two rows of terminals 20 are in the form of front and rear rows of longitudinal insert pins.

Figure 3:
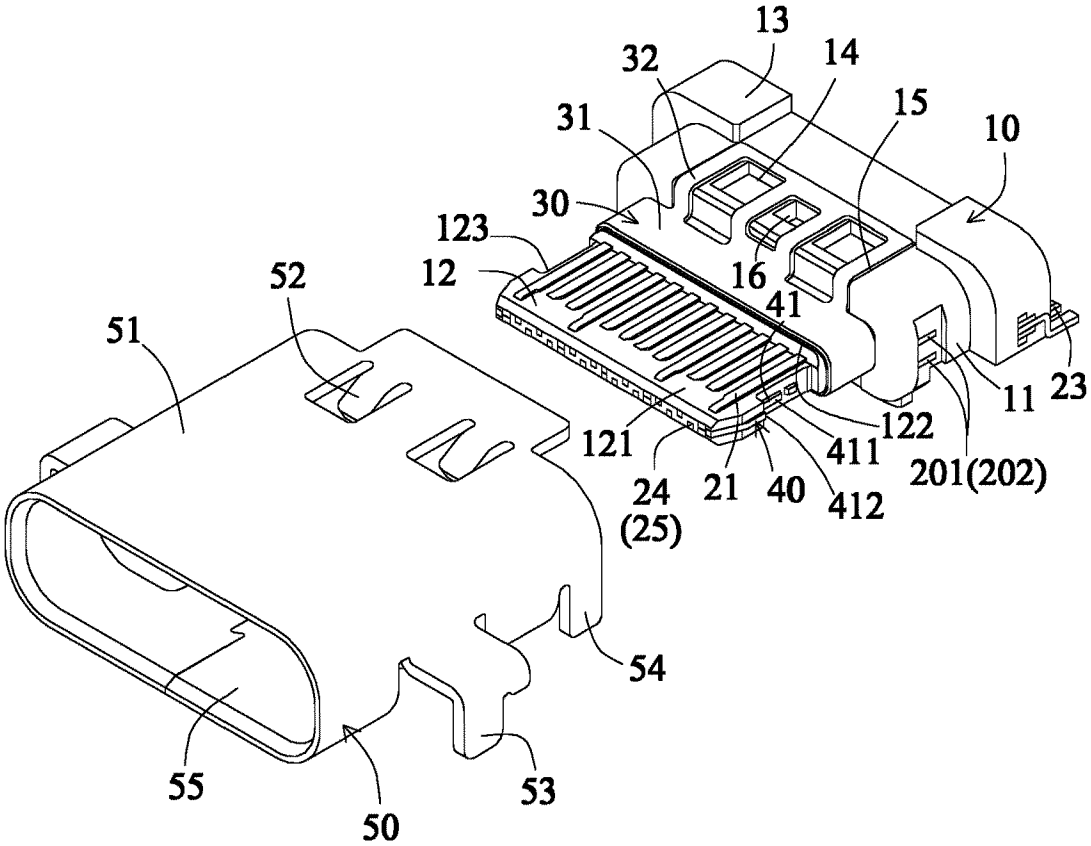
FIG. 3 is a pictorially exploded view showing the first embodiment of the invention.
Figure 1:
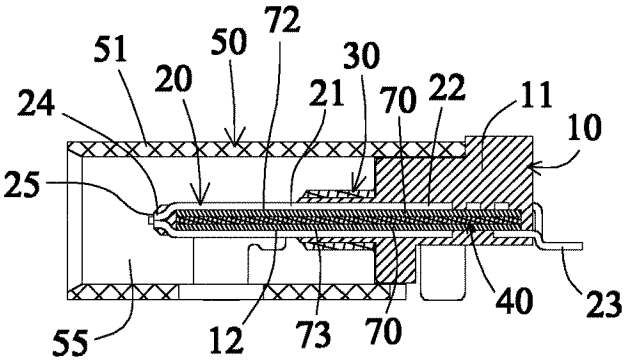
FIG. 1 is a cross-sectional side view showing the first embodiment of the invention.
Figure 24:
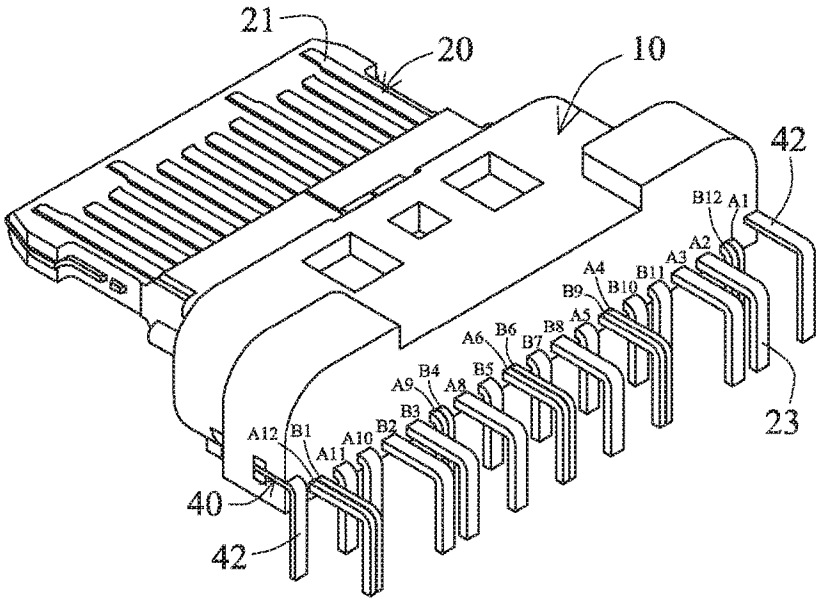
FIG. 24 is a pictorial view showing the seventh modification of the first embodiment of the invention.

Referring to FIG. 24 showing the seventh modification of this embodiment, which is substantially the same as the FIG. 1, the difference resides in that the pins 23 of the two rows of terminals 20 are in the form of front and rear rows of longitudinal insert pins.

Referring to FIGS. 25 to 32 showing the eighth modification of this embodiment which is substantially the same as the that of FIGS. 1 to 15, the difference resides in that each of two sides of the front section of the metal partition plate 40 is provided with a through hole 45, into which the plastic material can be filled upon embedding and plastic-injection molding. In addition, each of the front ends of two rows of terminals 20 provided with a rustproof layer 251 which may be a tin layer.

Figure 26:
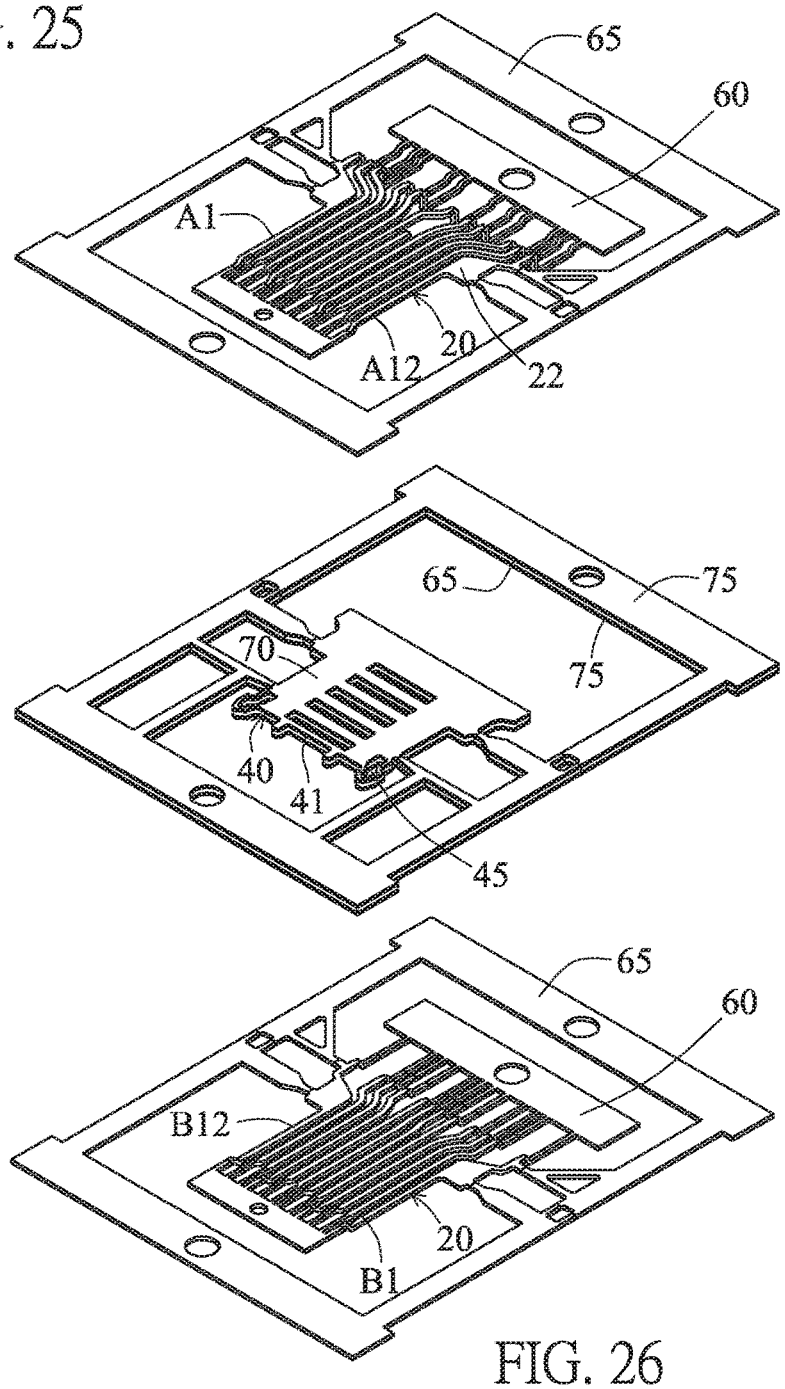
FIG. 26 is a pictorial view showing the manufacturing process of the eighth modification of the first embodiment of the invention.
Figure 27:
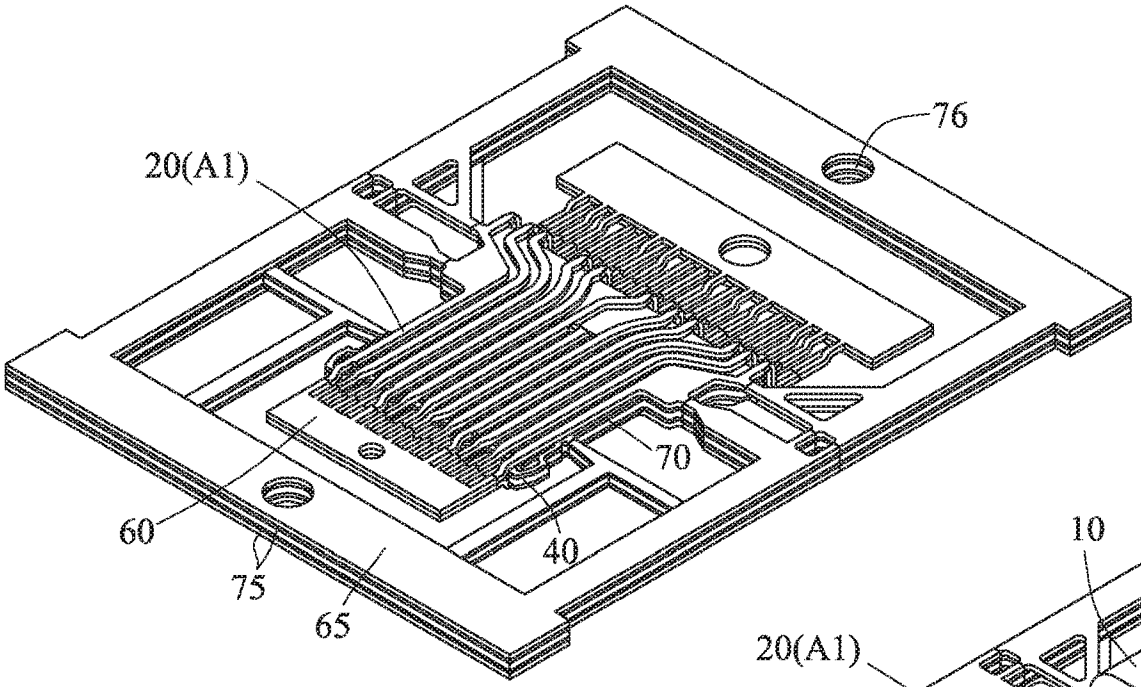
FIG. 27 is a pictorial view showing the manufacturing process of the eighth modification of the first embodiment of the invention.
Figure 28:
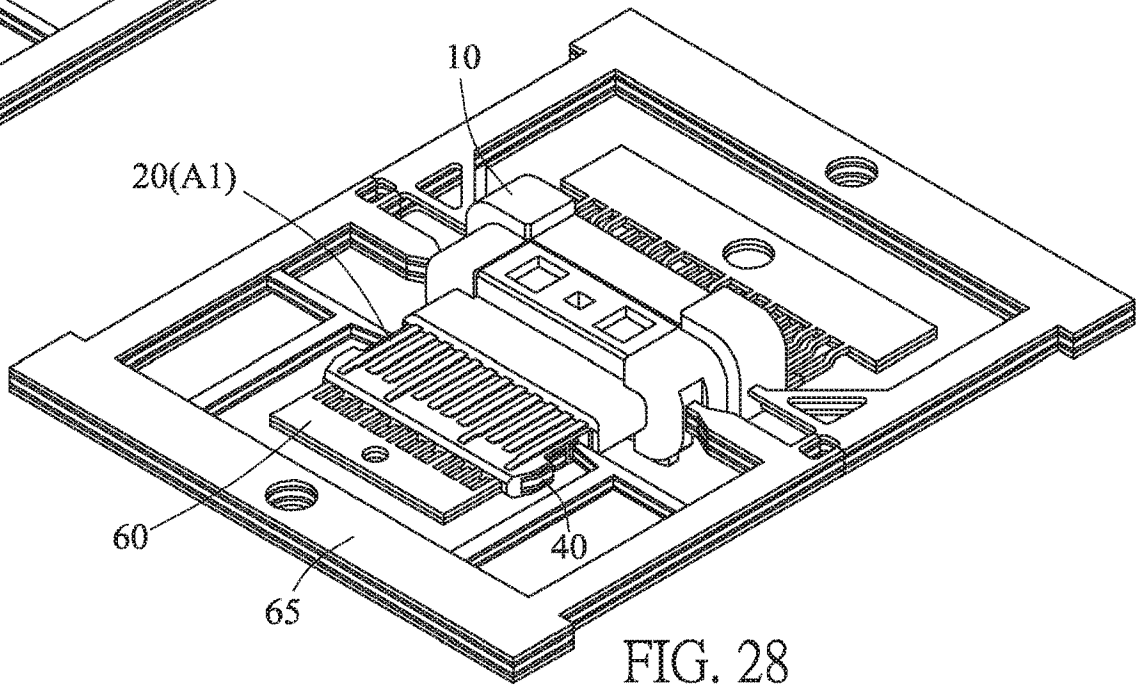
FIG. 28 is a pictorial view showing the manufacturing process of the eighth modification of the first embodiment of the invention.
Figure 30:
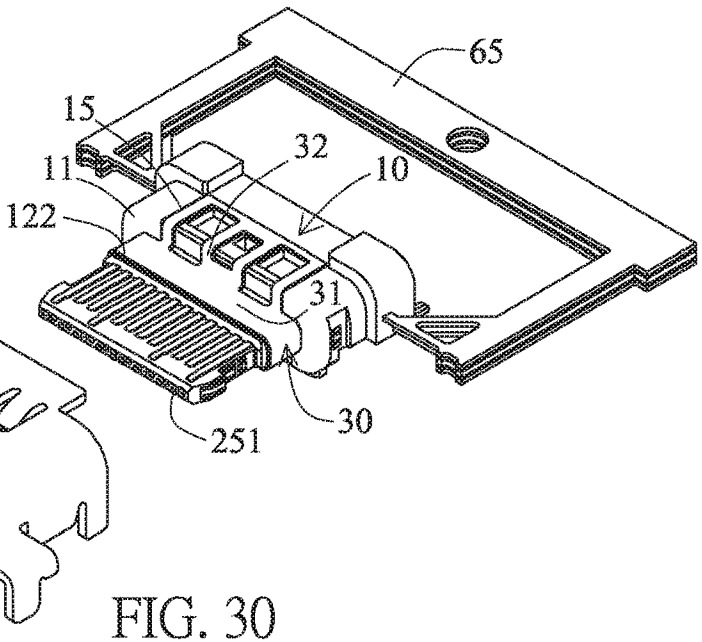
FIG. 30 is a pictorial view showing the manufacturing process of the eighth modification of the first embodiment of the invention.
Figure 32:
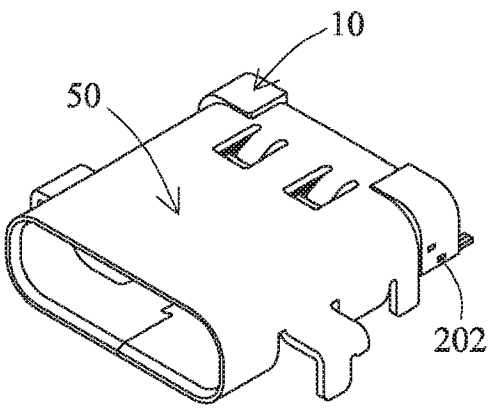
FIG. 32 is a pictorial view showing the manufacturing process of the eighth modification of the first embodiment of the invention.
Figure 29:
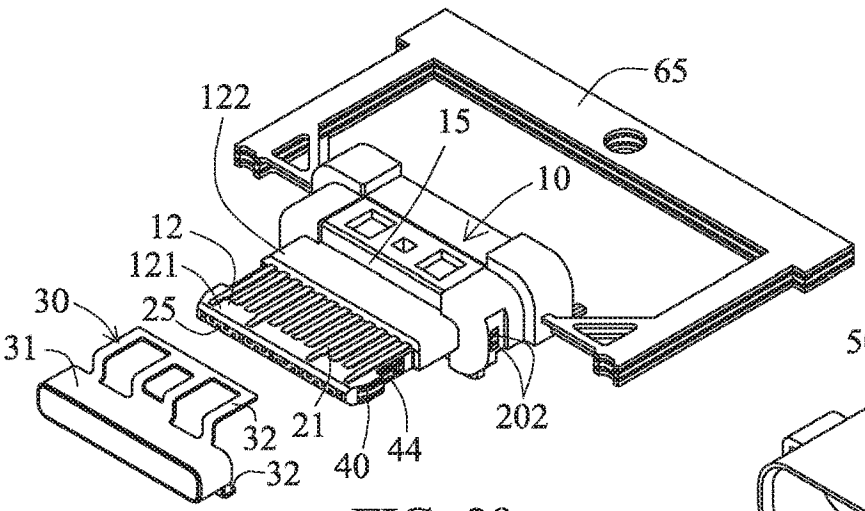
FIG. 29 is a pictorial view showing the manufacturing process of the eighth modification of the first embodiment of the invention.
Figure 31:
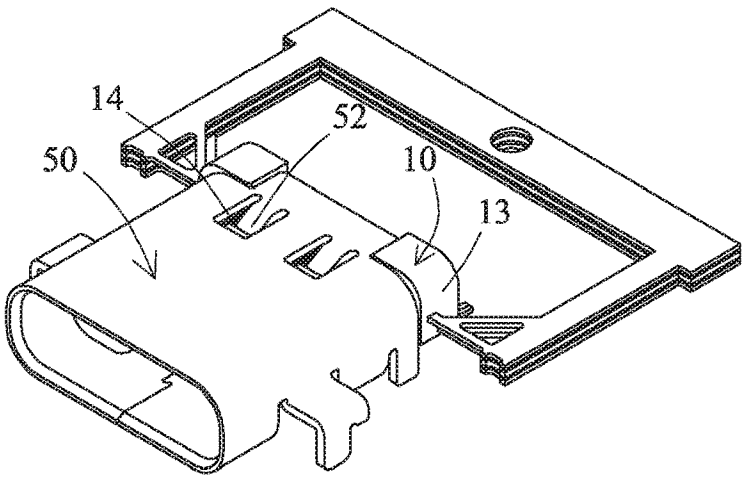
FIG. 31 is a pictorial view showing the manufacturing process of the eighth modification of the first embodiment of the invention.

Upon manufacturing of this embodiment, please refer to FIGS. 26 to 28 substantially the same as the first embodiment except for the following difference. Referring to FIG. 29, the material tape 60 and the front section of the outer material tape 65 are removed. At this time, the rear section of the outer material tape 65 is still kept to facilitate assembling of the ground shielding member 30 from front to rear. The front ends of the two rows of terminals 20 form electroplate-layer-free sections 25. Referring to FIG. 30, the grounding ring 31 of the ground shielding member 30 is fitted with and fixed to the rear section 122 of the two connection surfaces of the tongue, and the front end of the tongue is dipped with tin so that the electroplate-layer-free sections of the front ends of two rows of terminals 20 are attached with tin to form rustproof layers 251. Referring to FIG. 31, the metal housing 50 is assembled from front to rear to cover the insulation seat 10. Referring to FIG. 32, the rear section of the outer material tape 65 is finally removed.

This modification may also be implemented by not stacking the connection portions of the terminals A7 and B7 so that they do not rest against each other, and the pins are individually extended out. That is, two rows of terminals are in the form of one row of 19 horizontally flush pins.

Figure 33:
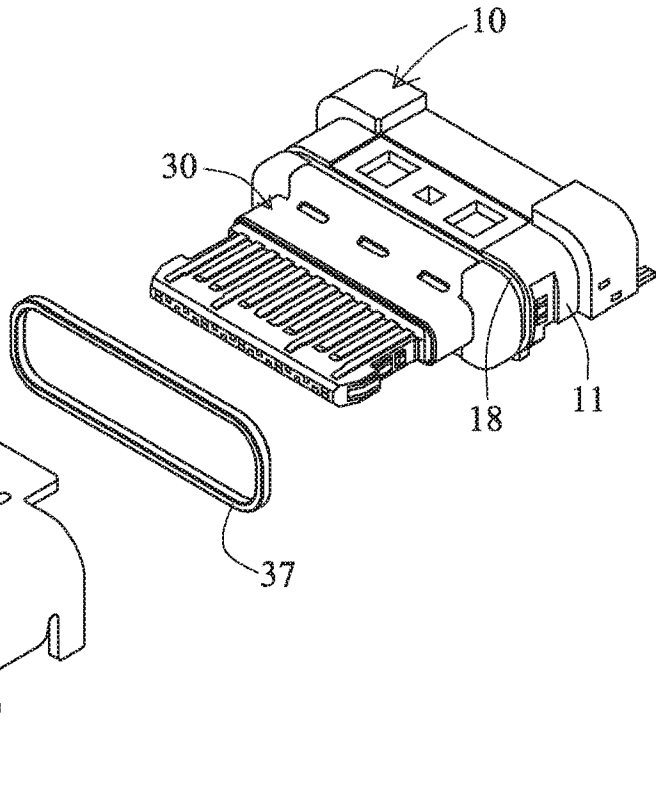
FIG. 33 is a pictorially exploded view showing the ninth modification of the first embodiment of the invention.
Figure 34:
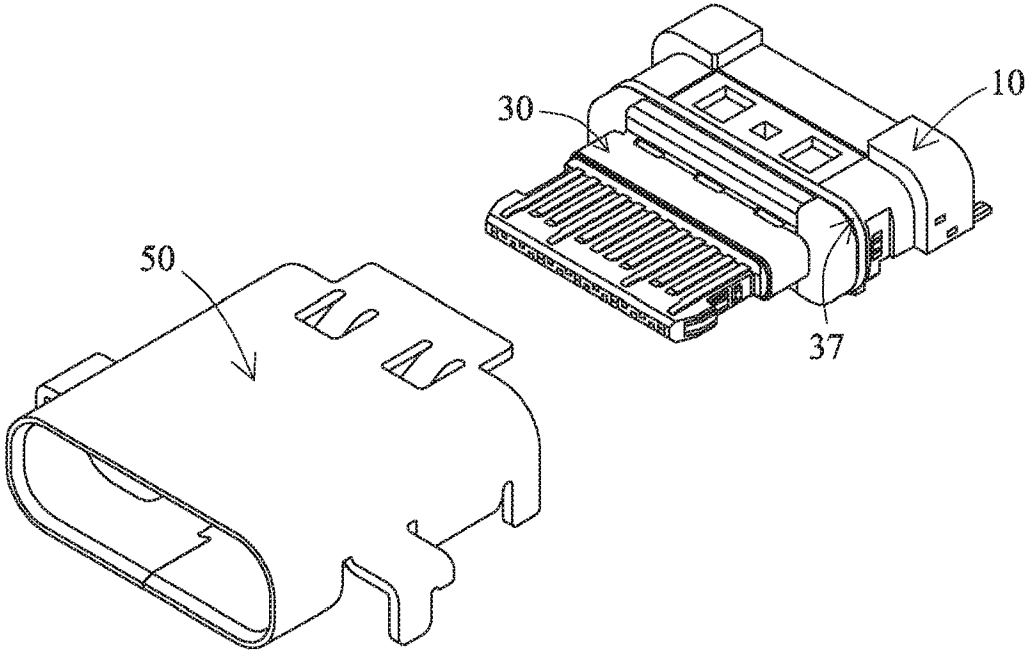
FIG. 34 is a pictorially exploded view showing the ninth modification of the first embodiment of the invention.
Figure 37:
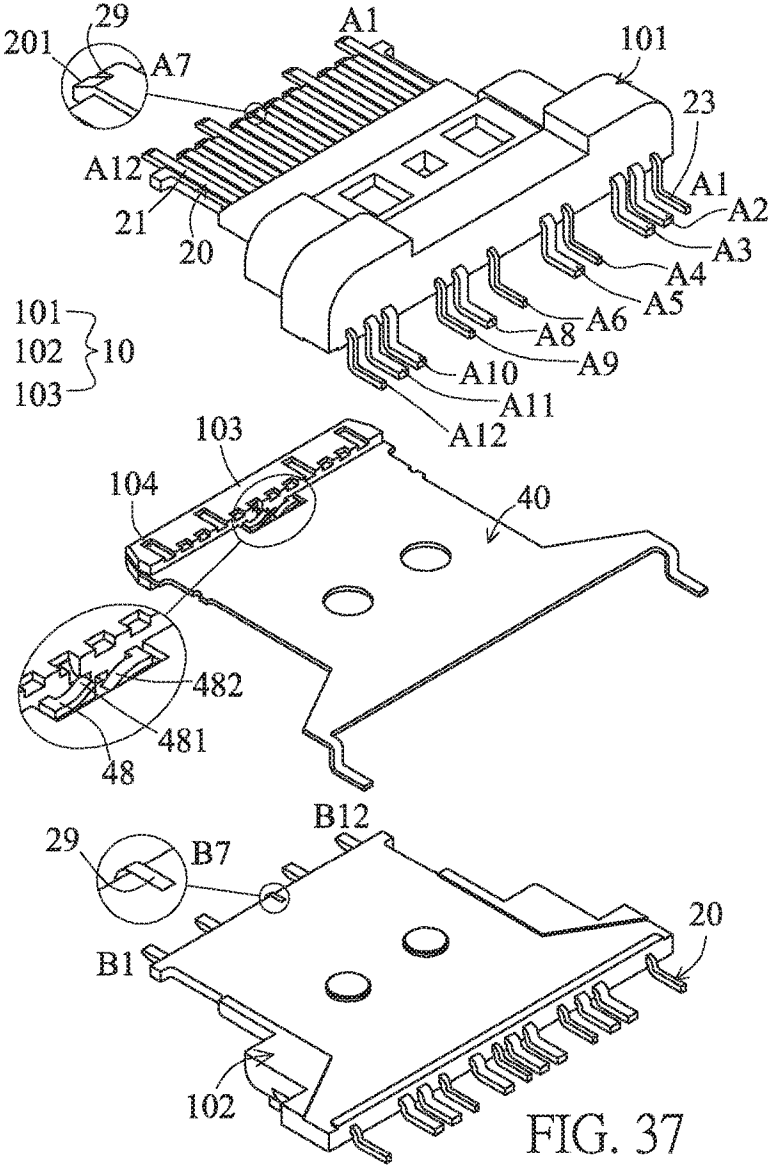
FIG. 37 is a partially pictorially exploded view showing the eleventh modification of the first embodiment of the invention.

Referring to FIG. 33 and FIG. 34, the ninth modification of this embodiment is substantially the same as the eighth modification except for the difference residing in that the base seat 11 of the insulation seat 10 is provided with an annular groove 18, and the groove 18 is fitted with a waterproof ring 37.

Figure 35:
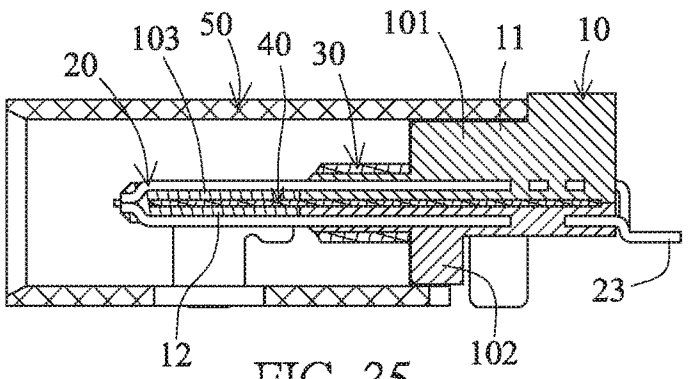
FIG. 35 is a cross-sectional side view showing the tenth modification of the first embodiment of the invention.

Referring to FIG. 35, the tenth modification of this embodiment is substantially the same as the FIG. 22, and the difference resides in that the insulation seat 10 is provided with an upper seat 101 and a lower seat 102 which are vertically stacked and a tongue's front seat 103. The upper and lower seats 101 and 102 are formed with the rear section of the tongue. The contacts 21 of the two rows of terminals 20 project and are suspended over and disposed in front of the upper and lower seats 101 and 102. After the upper and lower seats 101 and 102 are stacked, the tongue's front seat 103 is embedded and injection molded two times and the upper and lower seats 101 and the contacts 21 of the two rows of terminals 20 are combined firmly.

Figure 38:
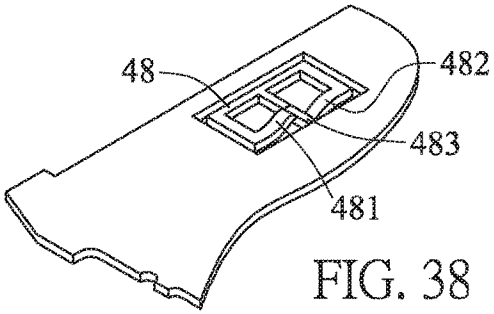
FIG. 38 is a pictorial view showing the eleventh modification of the first embodiment of the invention.

Referring to FIGS. 36 to 39, the eleventh modification of this embodiment is substantially the same as the FIG. 35, and the difference resides in that the front section of the metal partition plate 40 is embedded into, plastic-injected molded with and fixed to the tongue's front seat 103, each of the top and bottom surfaces of the metal partition plate 40 is provided with four long and eight short concave surfaces 104, the front sections of the contacts 21 of the two rows of terminals 20 are bonded or connected to the concave surface 104. Referring to FIG. 38, the plate surface of the front section of the metal partition plate 40 is firstly pressed and stamped to form a resting sheet 48, and the resting sheet 48 is provided with an upward projecting upper elastic sheet 481 and a downward projecting lower elastic sheet 482 and is firstly connected to the metal partition plate 40 through a connection sheet 483. The front section of the metal partition plate 40 is embedded into, plastic-injected molded with and fixed to the tongue's front seat 103, and then the connection sheet 483 is removed. Each the front ends of the contacts of the terminals A7 and B7 is bent to form a resting portion 29 flush with the inner surfaces of the upper and lower seats. The electroplate-layer-free section 201 is the section formed after the material tape is broken. The resting portions 29 of the terminals A7 and B7 respectively resiliently contact the upper and lower elastic sheets 481 and 482 to form electrical connection. So, the terminal A7 may be similarly provided with no pin.

The upper and lower seats 101 and 102 are provided with top-bottom preload negative angle structures to tightly rest the metal partition plate 40 at the tongue of the front end.

Figure 36:
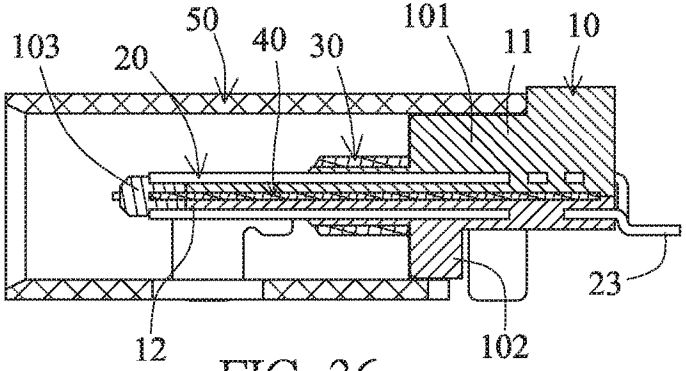
FIG. 36 is a cross-sectional side view showing the eleventh modification of the first embodiment of the invention.
Figure 40:
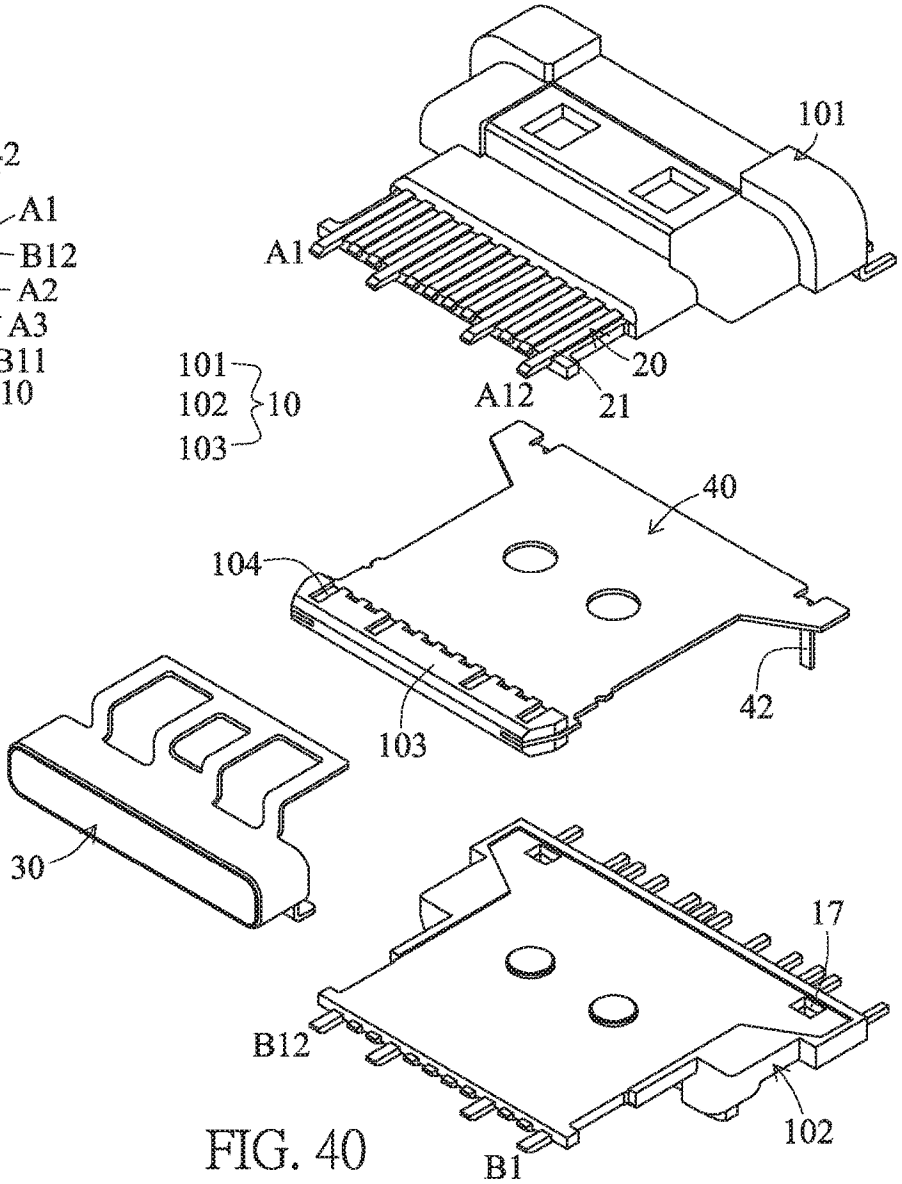
FIG. 40 is a partially pictorially exploded view showing the twelfth modification of the first embodiment of the invention.
Figure 41:
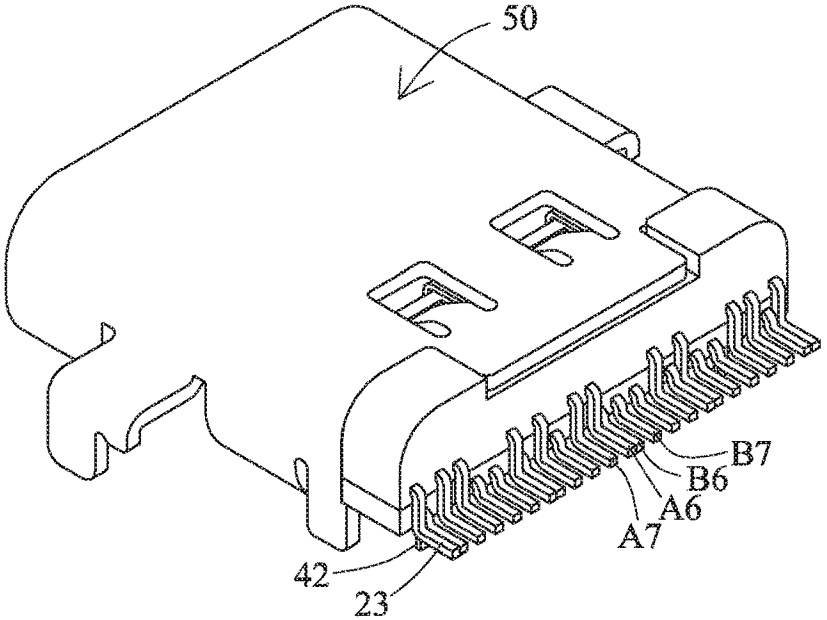
FIG. 41 is a pictorial view showing the twelfth modification of the first embodiment of the invention.

Referring to FIGS. 40 and 41, the twelfth modification of this embodiment is substantially the same as the FIG. 36, and the difference resides in that the tongue's front seat 103 has not been embedded and plastic injection molded, and fixedly provided with the resting sheet. That is, the terminals A7 and B7 are not provided with the resting portions 29 to resiliently contact the resting sheets to form the electrical connection. So, the rear ends of the terminals A7 and B7 are provided with the pins 23.

the upper and lower seats 101 and 102 are provided with top-bottom preload negative angle structures at the tongue of the front end to tightly resting against the metal partition plate 40.

Referring to FIGS. 42 to 46, the second embodiment of the invention provides a plate-depressed type bidirectional duplex USB TYPE-C 2.0 electrical connection socket, which is provided with an insulation seat 10, two rows of terminals 20, and a metal housing 50.

The insulation seat 10 is made of a plastic material and integrally provided with a base seat 11 and a tongue 12, the front end of the base seat 11 is projectingly provided with the tongue 12, the inner end of the tongue 12 is connected to the base seat 11, the thickness of the base seat 11 is greater than that of the tongue 12, the top and bottom surfaces of the tongue 12 are two connection surfaces with larger plate surfaces, the rear section of the tongue 12 is thicker than the front section of the tongue 12 so that the rear sections 122 of the two connection surfaces project much more than the front sections 121 of the two connection surfaces, the left and right sides of the tongue 12 are provided with concave portions 123, and the left and right sides of the rear section of the base seat 11 are provided with convex portions 13.

Figure 43:
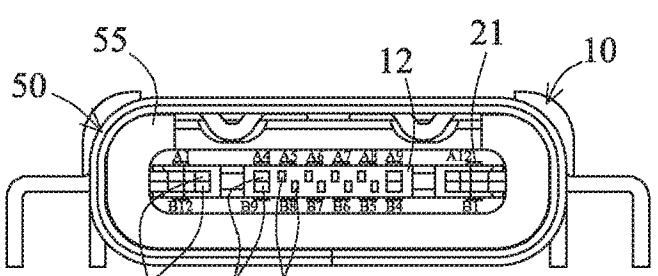
FIG. 43 is a front view showing the second embodiment of the invention.
Figure 44:
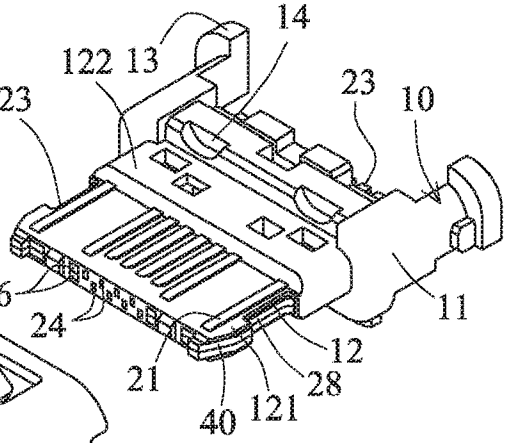
FIG. 44 is a pictorially exploded view showing the second embodiment of the invention.
Figure 44:
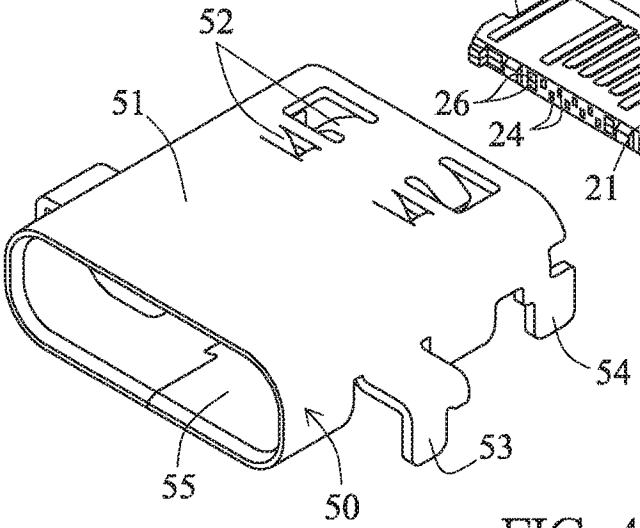
Figure 42:
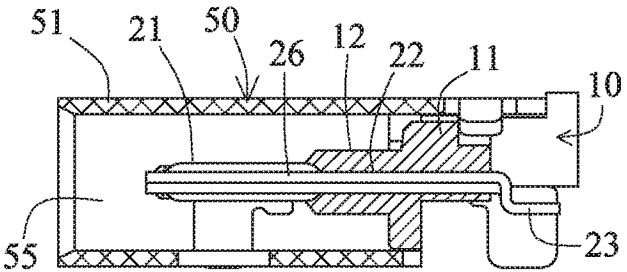
FIG. 42 is a cross-sectional side view showing the second embodiment of the invention.

The two rows of terminals 20 and the insulation seat 10 are embedded into and plastic injection molded with each other. Each of the two rows of terminals 20 has eight terminals, as shown in FIG. 43, wherein the upper row of terminals are represented by "A", the connection points have the circuit serial numbers sequentially arranged, from left to right, as A1, A4, A5, A6, A7, A8, A9 and A12, the lower row of terminals is represented by "B", and the connection points have the circuit serial numbers sequentially arranged, from left to right, as B12, B9, B8, B7, B6, B5, B4 and B1. Each terminal 20 is integrally provided with a contact 21, an extension 22, a pin 23 from front to rear. The contact 21 is in flat surface contact with the tongue 12, is elastically non-movable and is exposed to slightly project beyond the front sections 121 of the two connection surfaces, The pin 23 extends out of the rear end of the base seat 11 and has a horizontal distal section. The extension 22 is disposed between the pin 23 and the contact 21. The contacts 21 of the two rows of terminals 20 are respectively exposed at the front sections 121 of the two connection surfaces of the tongue 12 and are vertically aligned. The contacts 21 of the two rows of terminals are the same contact interface and are vertically aligned. The contacts of the two rows of terminals are arranged in an equally spaced manner according to the connection points of the circuit serial numbers. Two rows of contacts have connection points with the same serial numbers arranged reversely. In addition, the contacts 21 of the two rows of terminals are respectively arranged in two rows having different lengths. That is, four long ones and four short ones are provided. This embodiment also follows the USB TYPE-C connection points specified by USB Association have circuit serial numbers to be described in the following. However, this embodiment only has the low-speed transmission specification, and lacks of (2, 3) one pair of high differential signal terminals (TX+, TX−) and (10, 11) the other one pair of high differential signal terminals (RX+, RX−). So, each of the two rows of terminals 20 has eight terminals. The vertically aligned ground terminals A1/B12, A12/B1 and power terminal A4/B9, A9/B4 can be bridged. So, the front section of each terminal of the four pairs of terminals are provided with a resting portion 26. The resting portions 26 are metal plate sheets. Each pair of the four pairs of terminals has two resting portions (metal plate sheets) 26, which have respective plate surfaces in flat surface contact with and connected to each other. The two contacts 21 of each of the pairs of terminals are prodded to project from respective other plate surfaces of the two resting portions (metal plate sheets) 26. The extensions 22 of the four pairs of terminals also have plate surfaces in flat surface contact with and connected to each other. A step is formed between the resting portion 26 and the contact 21. The front end of the resting portion 26 is connected to the material tape 60. After the material tape 60 has been broken, the front end of the resting portion 26 is in the form of an electroplate-layer-free section 25, the pins 23 of the four pairs of terminals are horizontally flush with each other and combined together or adjacent and close to each other. The outer sides of the resting portions 26 of the ground terminals (A1, A12, B12, and B1) of two sides of the two rows of terminals 20 are provided with depressed snaps 28. In the two pairs of vertically aligned ground terminals (A1/B12, A12/B1), the two resting portions (metal plate sheets) 26 of each pair of ground terminals have respective surfaces resting against each other directly in a top-bottom manner to form a metal plate structure 90. The two resting portions (metal plate sheets) 26 have respective other surfaces, each of which is integrally provided with a ground contact 21. The outer sides of the two resting portions (metal plate sheets) vertically stacked are provided with a depressed snap structure to form a snap 91. That is, each of the top and bottom surfaces of the metal plate structure 90 is integrally provided with a ground contact 21, and an outer side of the metal plate structure is provided with the snap 91. As shown in FIG. 42 to FIG. 43, the two ground contacts 21 are respectively flush with the contacts 21 of the two rows of terminals 20. The thickness of the snap 91 is the same as the maximum thickness of the metal plate structure 90. That is, the thickness of the snap 91 is the same as the stack thickness of the two resting portions (metal plate sheets) 26. That is, the two pairs of ground terminals (A1/B12, A12/B1) form two metal plate structures 90, and each of the two snap 91 of the metal plate structure 90 is provided with a depressed surface 92 and a locking surface 93, which are of metal material. The depressed surfaces 92 and the locking surfaces 93 of the two snaps 91 are exposed at the left and right sides of the tongue 12, as showed in FIG. 47.

In addition, four pairs of vertically aligned terminals (A5/B8, A6/B7, A7/B6, A8/B5) do not have the same circuit, and thus cannot be provided with resting portions mutually in flat surface contact with and connected with each other. The front end of the contact 21 thereof is connected to a connection portion 24. A bent segment is formed between the connection portion 24 and the contact 21 so that the connection portion 24 is lower than the front sections 121 of the two connection surfaces and embedded into the tongue 12. The connection portion 24 is connected to the material tape 60. After the material tape 60 has been broken, the front end of the connection portion 24 is in the form of an electroplate-layer-free section 25, and the connection portions 24 of four pairs of vertically aligned terminals (A5/B8, A6/B7, A7/B6, A8/B5) are staggered in a left-to-right manner. Regarding the pins of the rear ends 21 (exclusive of A6 and B6 that are horizontally flush with each other and combined together or adjacent and close to each other), the pins of the other terminals are horizontally flush with each other and separately arranged. The front ends of the connection portions 24 of the two rows of terminals 20 and the front ends of the resting portions 26 are in the form of aligned electroplate-layer-free sections 25.

With the above-mentioned design, because the pins 23 of the five pairs of terminals (A1/B12, A12/B1A, A4/B9, A9/B4, A/6B6) are horizontally flush with each other and combined together or adjacent and close to each other, five pins may be reduced from the two rows of terminals 20 (16 terminals in total) and arranged in horizontal flush one row of 11 pins, so that it is easy to make one row of horizontally flush arrangements within the width range of the insulation seat 10, and the pins 23 of the terminals have substantially equal widths. Thus, the total width of the horizontally flush two pins resting against each other and combined together is wider than the single pin.

The rear sections of the extensions 22 of at least one pair or two pairs of terminals (ground terminal, power terminal, high differential terminal, low-high differential terminal and detection terminal) of the two rows of terminals 20 are turned to left and right sides and transversally and outwardly extended relatively to the contacts 21, so that the arrangement width of the pins 23 of each row of terminals is greater than the arrangement widths of the contacts 21. In this embodiment, the rear sections of the extensions 22 of other terminals than a low differential terminal A7 and a detection terminal A8 in the upper row of terminals are turned to left and right sides and transversally and outwardly extended relatively to the contacts 21, and the rear sections of the extensions 22 of other terminals than a low differential terminal B7 and a detection terminal B8 in the lower row of terminals are turned to left and right sides and transversally and outwardly extended relatively to the contacts 21, so that the gaps between the arranged pins are enlarged to be at least greater than the gaps between the horizontal or longitudinal pins by 0.6 or 0.8 mm.

The metal housing 50 covers the insulation seat 10 and rests against and engages with the base seat 11. The metal housing 50 is formed by bending a metal plate sheet and has a front section provided with a four-sided main housing 51/The top of the rear section of the metal housing 50 is provided with two engaging sheets 52 engaging with two engagement holes 14 of the base seat 11. Two sides of the rear end thereof are provided with two left-right symmetrical rear plate connecting members 54. The plate surface of the four-sided main housing 51 is prodded and bent to form two left-right symmetrical front plate connecting members 53. The four-sided main housing 51 and the front end of the base seat 11 form a connection slot 55 in the four-sided main housing 51. The tongue 12 is horizontally suspended over the middle height of the connection slot 16 and extends frontwards. The insert port of the connection slot 55 faces frontwards. The connection slot 55 and the tongue 12 form a docking structure to be reversibly and dual-positionally inserted by an electrical connection plug for electrical connecting and positioning. The front end of the tongue 12 is close to the insert port of the connection slot 55. The two connection surfaces of the tongue 12 form the symmetrical space. The connection slot 55 has a top-bottom symmetrical and left-right symmetrical shape and has two arced sides to approach a rectangular shape.

Figure 46:
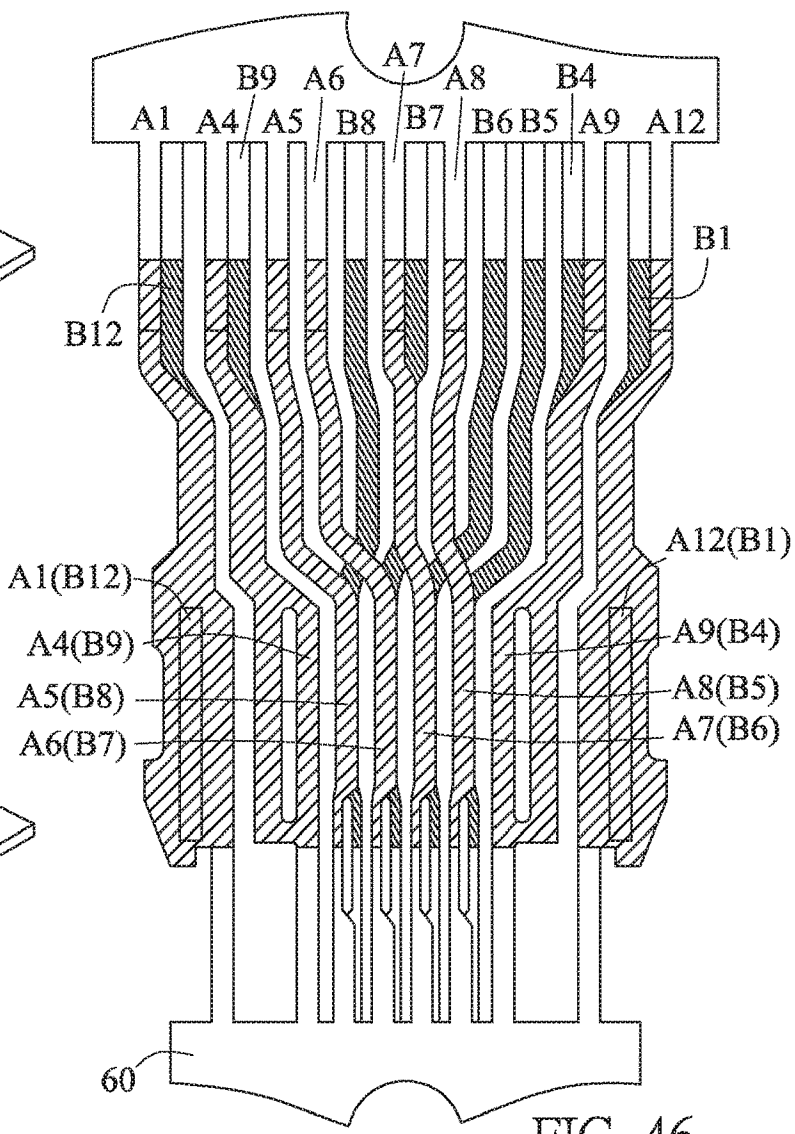
FIG. 46 is a top view showing two rows of terminals of the second embodiment of the invention.
Figure 45:
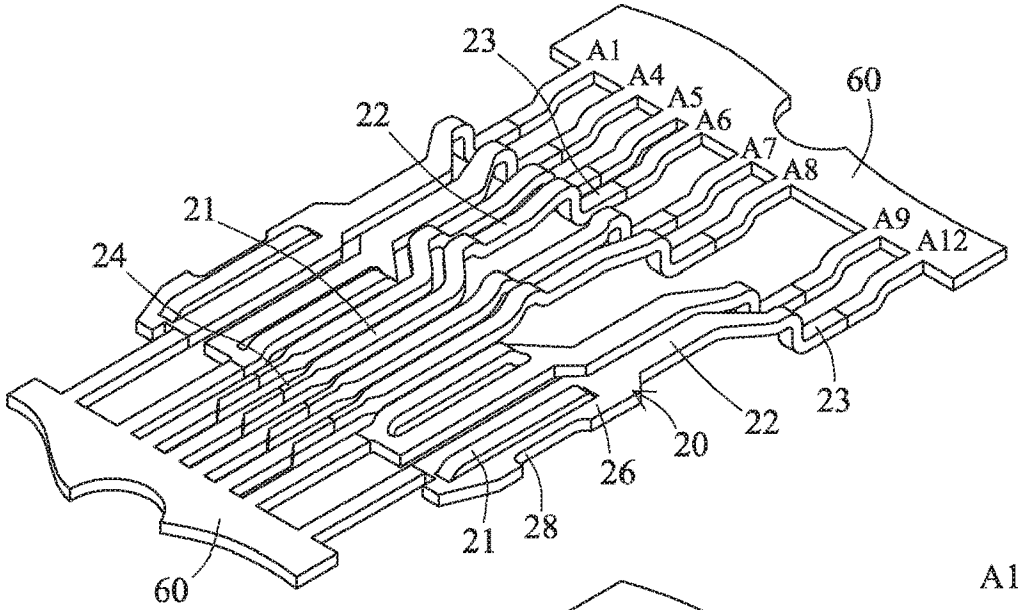
FIG. 45 is a pictorially exploded view showing two rows of terminals of the second embodiment of the invention.
Figure 45:
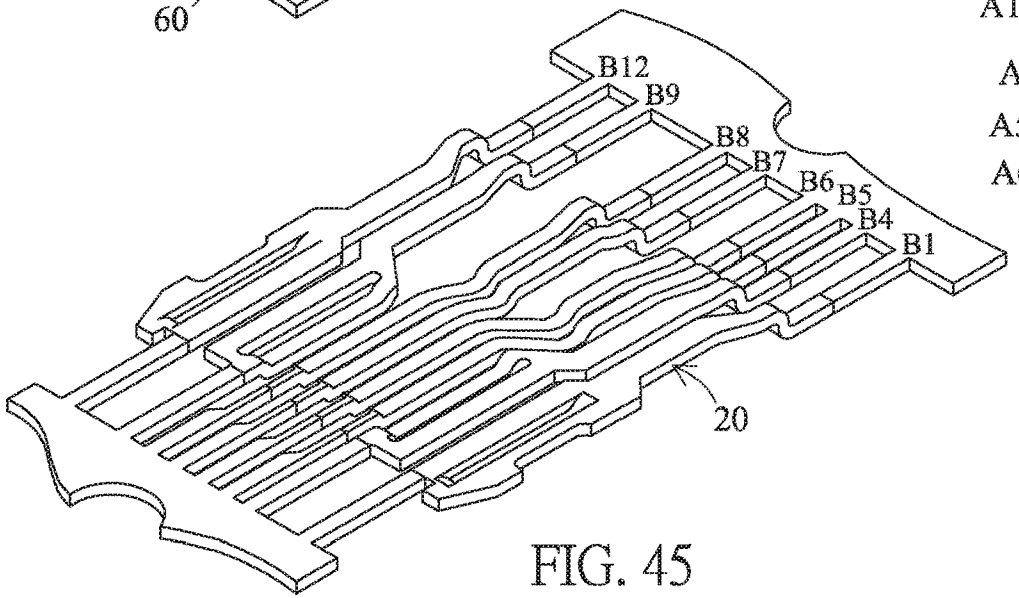
Figure 48:
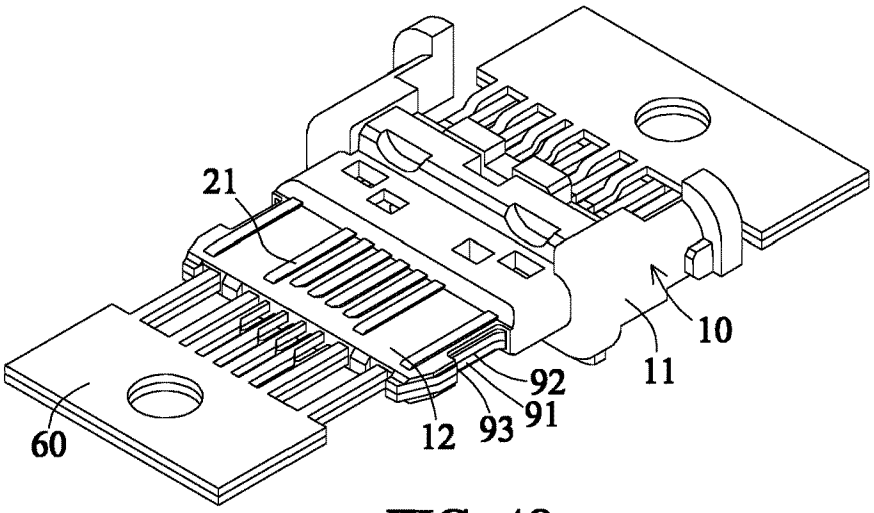
FIG. 48 is a pictorial view showing the manufacturing process of the second embodiment of the invention.
Figure 47:
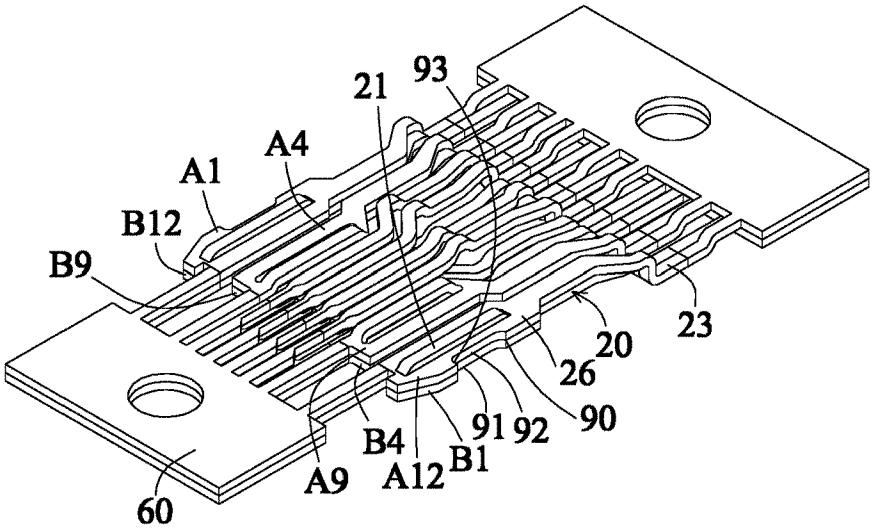
FIG. 47 is a pictorial view showing the manufacturing process of the second embodiment of the invention.
Figure 49:
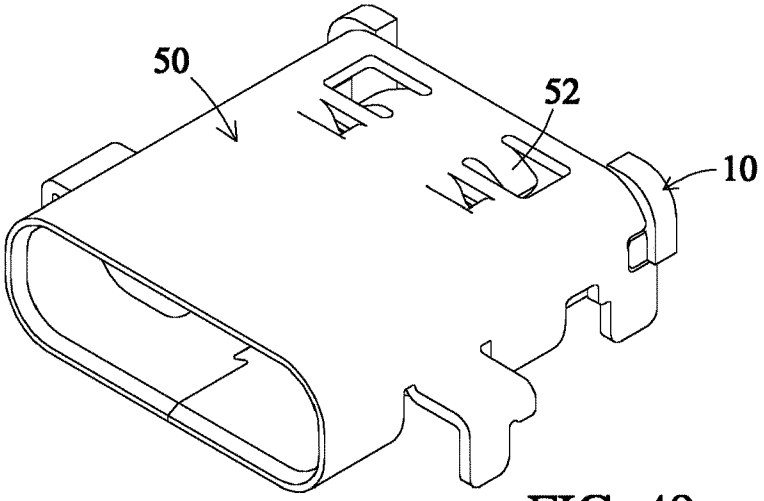
FIG. 49 is a pictorial view showing the manufacturing process of the second embodiment of the invention.

The manufacturing processes of this embodiment will be described in the following. Referring to FIG. 45, when the two rows of terminals 20 are manufactured by way of stamping, the front and rear ends of each terminal 20 are connected to a material tape 60. Therefore, the extension 22 of each of the terminals 20 has same thickness. Referring to FIGS. 46 and 47, under the operation of the automatic machine, the two rows of terminals 20 are stacked in an aligned manner by aligning the positioning holes. Referring to FIG. 48, the two rows of terminals 20 are embedded into the plastic material at a time to form the insulation seat 10 by way of injection molding. The depressed surfaces 92 and the locking surfaces 93 of the two snaps 91 are exposed at the left and right sides of the tongue 12. Referring to FIG. 49, after the material tape 60 is removed, the metal housing 50 is assembled from front to rear to cover the insulation seat 10.

The snaps 28 of this embodiment are directly disposed on the resting portions 26 of the ground terminals (A1, A12, B12, B1) of two sides of the two rows of terminals 20 without the provision of the metal partition plate, so that the structure is further simplified.

The upper and lower rows of opposite power and grounding contacts are integrally connected to the upper and lower rows of extensions. The ground contacts facing each other in a vertical direction are prodded to project the vertically stacked resting portions 26. The vertically stacked resting portions 26 have the structure formed by stacking upper and lower metal flat plate portions. One side of the stacked upper and lower flat plate portions is provided with stacked snap notches. The structure of the upper and lower metal flat plate portions has the doubled cross-sectional area of those of the two metal plates to allow the high current transmission. The snap notch has the thickness of the two vertically stacked metal plates and has the doubled structural strength to withstand the wearing and plugging-and-playing.

Figure 50:
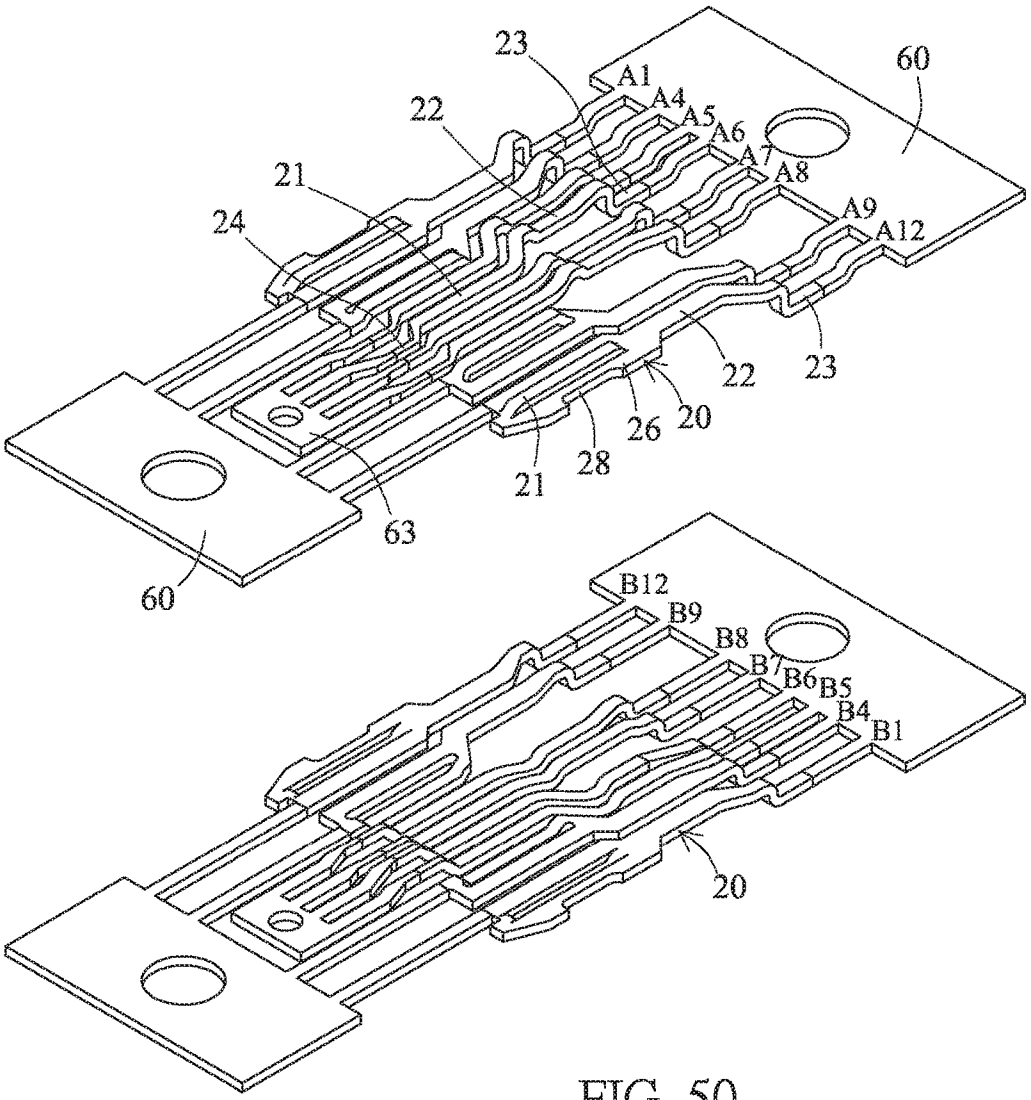
FIG. 50 is a pictorially exploded view showing the first modification of the second embodiment of the invention.
Figures 54, 54A, 55, 56, 57:
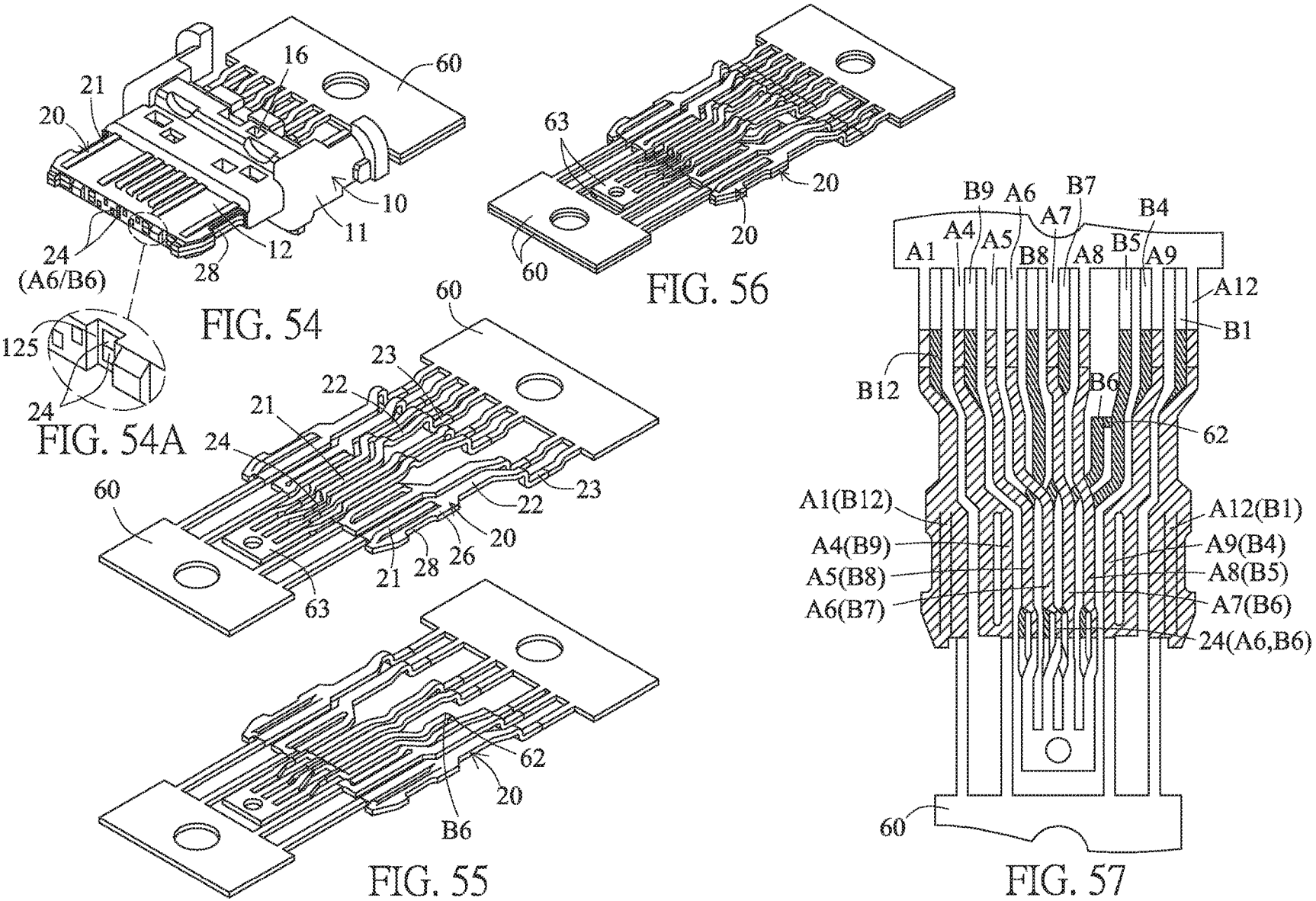
FIG. 54 is a pictorial view showing the fourth modification of the second embodiment of the invention.
FIG. 54A is a pictorial view showing another implementation of the fourth modification of the second embodiment of the invention.
FIG. 55 a pictorially exploded view showing two rows of terminals of the fourth modification of the second embodiment of the invention.
FIG. 56 is a pictorially assembled view showing two rows of terminals of the fourth modification of the second embodiment of the invention.
FIG. 57 is an assembled top view showing two rows of terminals of the fourth modification of the second embodiment of the invention.

Referring to FIG. 50, the first modification of this embodiment is substantially the same as the FIGS. 42 to 46, and the difference resides in that bent segments are formed between the connection portions 24 and the contacts 21 of the four pairs of vertically aligned terminals (A5/B8, A6/B7, A7/B6, A8/B5), so the connection portions 24 of four terminals of the two rows of terminals 20 are connected to an inner material tape 63, the inner material tape 63 is separated from the material tape 60, and the inner material tape 63 is disposed in the material tape 60, so that the material pulling cannot be caused due to the bent segment between the connection portion 24 and the contact 21 when the terminal is being stamped.

Figure 51:
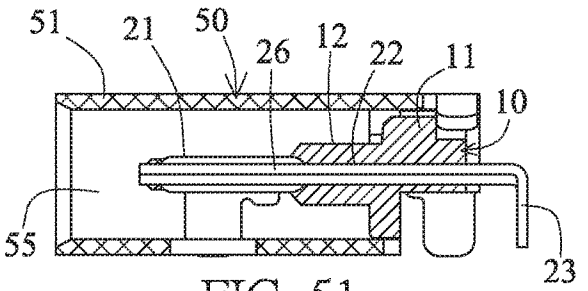
FIG. 51 is a cross-sectional side view showing the second modification of the second embodiment of the invention.
Figure 52:
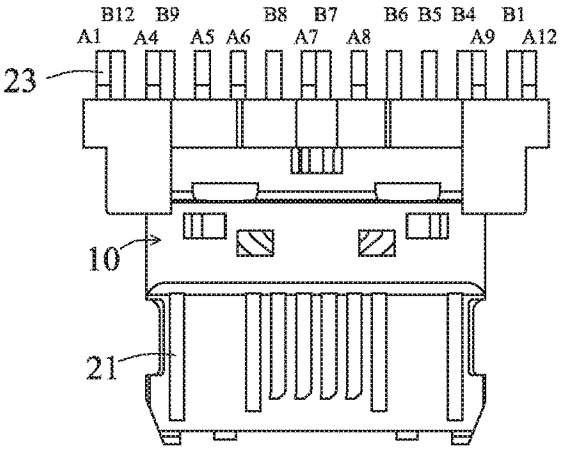
FIG. 52 is a cross-sectional top view showing the second modification of the second embodiment of the invention.

Referring to FIG. 51 and FIG. 52 showing the second modification of this embodiment substantially the same as the FIGS. 42 to 46, the difference resides in that the two rows of terminals 20 are in the form of longitudinal pins 23.

Figure 53:
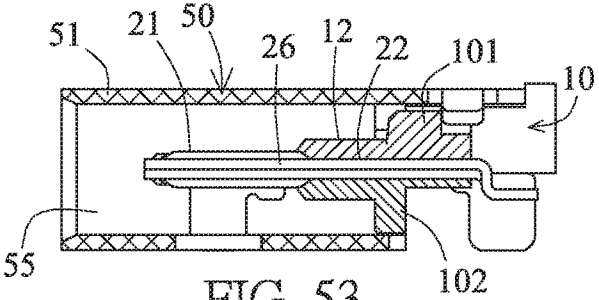
FIG. 53 is a cross-sectional side view showing the third modification of the second embodiment of the invention.

Referring to FIG. 53 showing the third modification of this embodiment substantially the same as the FIG. 50, the difference resides in that the insulation seat 10 is provided with an upper seat 101 and a lower seat 10, which are vertically stacked. The upper row of terminals are embedded into, plastic-injected molded with and fixed to the upper seat 101. The lower row of terminals are embedded into, plastic-injected molded with and fixed to the upper seat 102.

Referring to FIGS. 54 to 57 showing the fourth modification of this embodiment substantially the same as the FIGS. 42 to 46, the difference resides in that the connection portions 24 of the upper and lower rows of terminals A6 and B6 are vertically stacked with and rest against each other. In addition, similar to the structure of FIG. 4, only A6 is backwardly extended with the pin, and B6 is not backwardly extended with the pin, so that one pin of B6 may further be decreased. Thus, six pins may be reduced from the two rows of terminals 20 (16 terminals in total) so that one row of ten pins are arranged in a horizontal flush manner. In addition, referring to FIG. 54A showing another implementation of this modification, the positions at the front end of the tongue 12 corresponding to the contacts 21 of the terminals A4, B9, A9 and B4 can be provided with concave portions 125, so that the connection portions 24 of the 4 power terminals can be retracted inwardly to prevent the short-circuited condition from occurring when the plug is improperly inserted.

Figure 59:
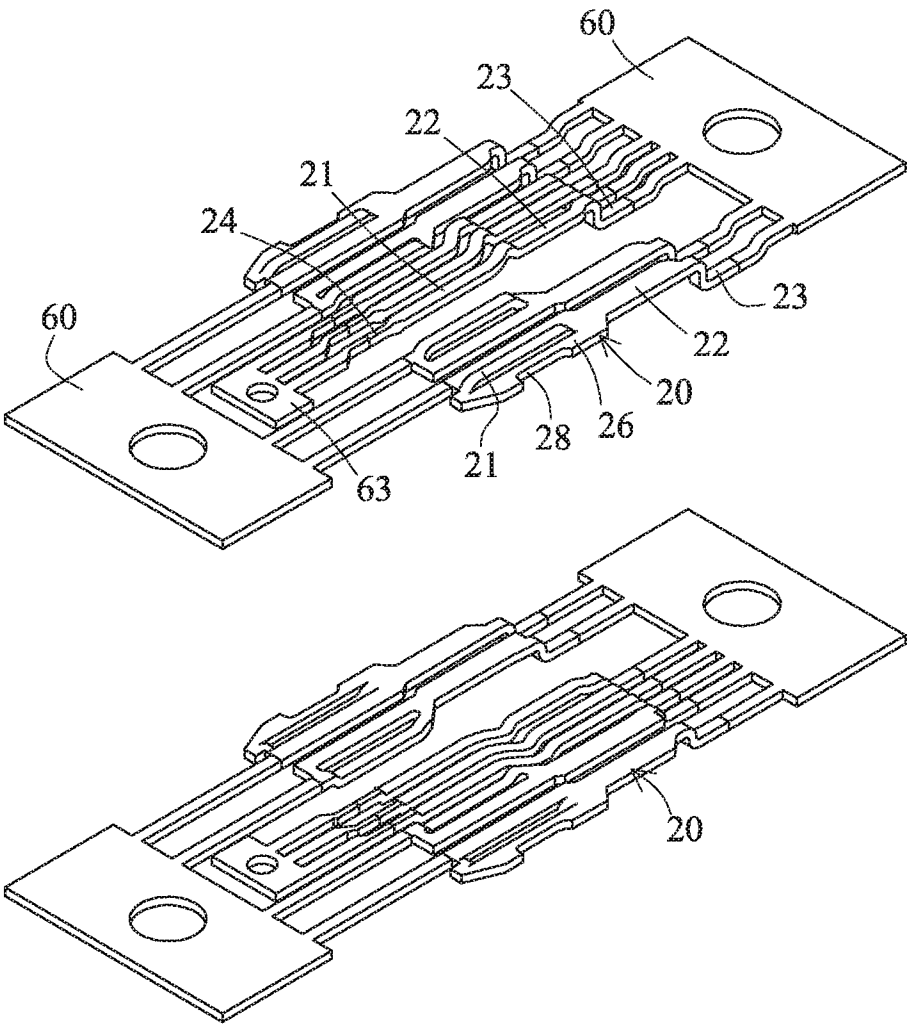
FIG. 59 a pictorially exploded view showing two rows of terminals of the fifth modification of the second embodiment of the invention.
Figure 58:
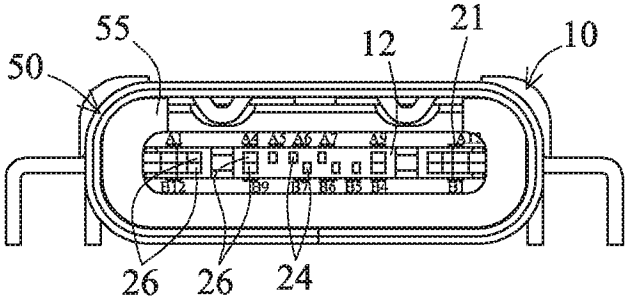
FIG. 58 is a front view showing the fifth modification of the second embodiment of the invention.

Referring to FIGS. 58 and 59 showing the fifth modification of this embodiment substantially the same as the FIGS. 42 to 46, the difference resides in that each of the two rows of terminals 20 is one row of seven terminals, and the terminals A8 and B8 are removed.

Referring to FIGS. 60 to 66 showing the sixth modification of this embodiment substantially the same as the FIGS. 42 to 49, the difference resides in that each of the front ends of two rows of terminals 20 is provided with a rustproof layer 251 (see FIG. 64), the rustproof layer 251 may be a tin layer, the plate surfaces of the resting portions 26 of the two side ground terminals of the two rows of terminals 20 are vertically stacked, and each of the outer edges of the upper and lower resting portions 26 of the front end of the snap 28 is provided with a chamfer ramp (chambered sloped surface) 204 (see FIGS. 61 and 62) or may also be provided with a downward concave step. The chamfer ramps 204 of the upper and lower resting portions 26 are covered by the plastic material, so that the plate bodies of the two stacked resting portions 26 have the smaller side view thickness, and can satisfy the dimensions specified by USB Association.

Figure 63:
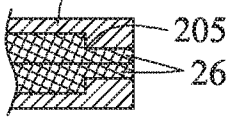
FIG. 63 is a partially cross-sectional view showing the sixth modification of the second embodiment of the invention.

Referring to FIG. 63, in order to make the plate bodies of the two stacked resting portions 26 have the smaller side view thickness, the outer edges of the upper and lower resting portions 26 of the front end of the snap 28 may also be depressed to form a downward concave step 205.

Figure 60:
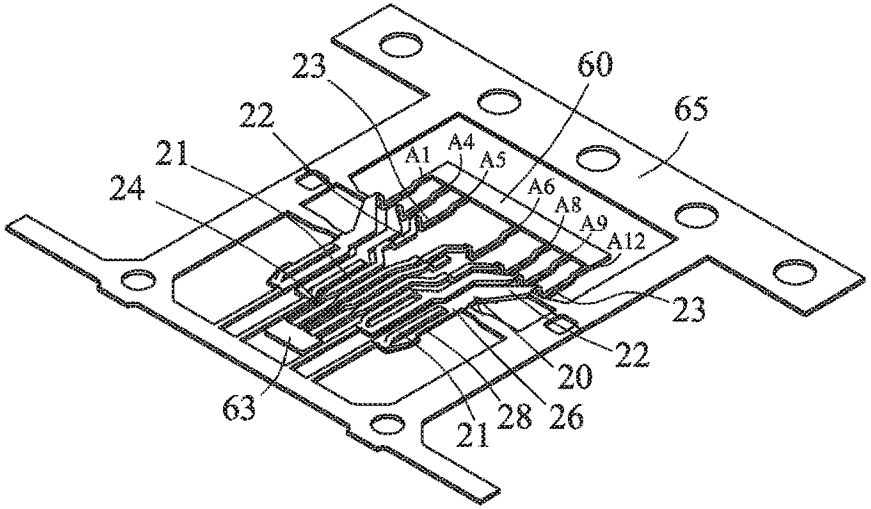
FIG. 60 is a pictorial view showing the manufacturing process of the sixth modification of the second embodiment of the invention.
Figure 60:
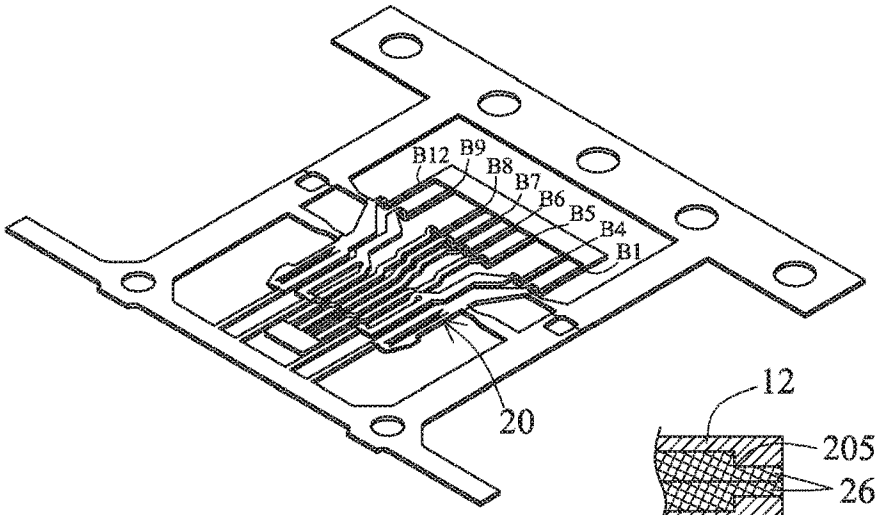

The manufacturing processes of this embodiment will be described in the following. Referring to FIG. 60, when the two rows of terminals 20 are manufactured by way of stamping, the rear end of each terminal is connected to the material tape 60, and the plate surfaces of the extensions 22 of the two side terminals are provided with wider portions connected to an outer material tape 65. The front ends of the middle four terminals of the two rows of terminals 20 are connected to an inner material tape 63.

Figure 61:
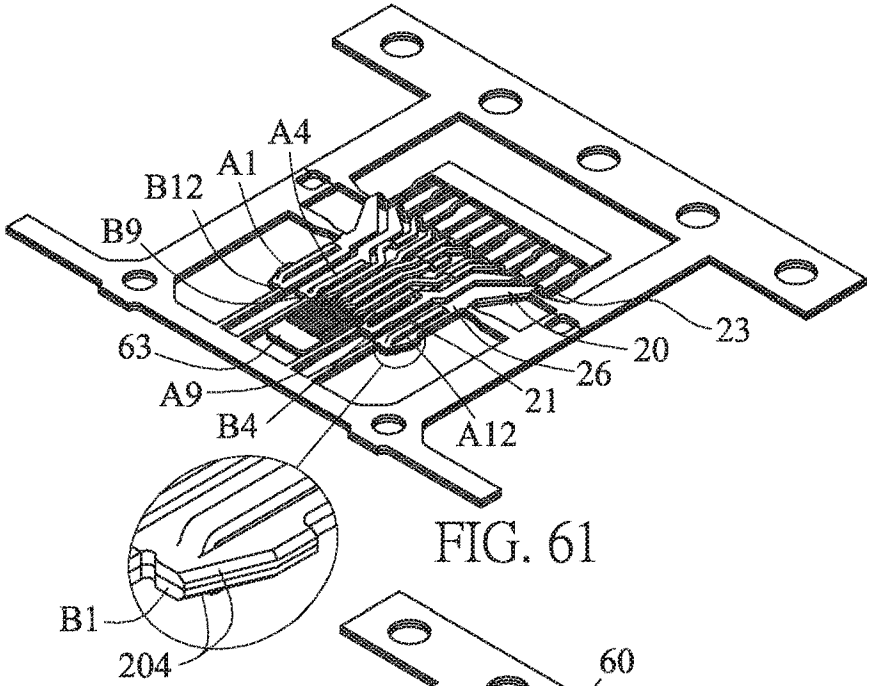
FIG. 61 is a pictorial view showing the manufacturing process of the sixth modification of the second embodiment of the invention.
Figure 62:
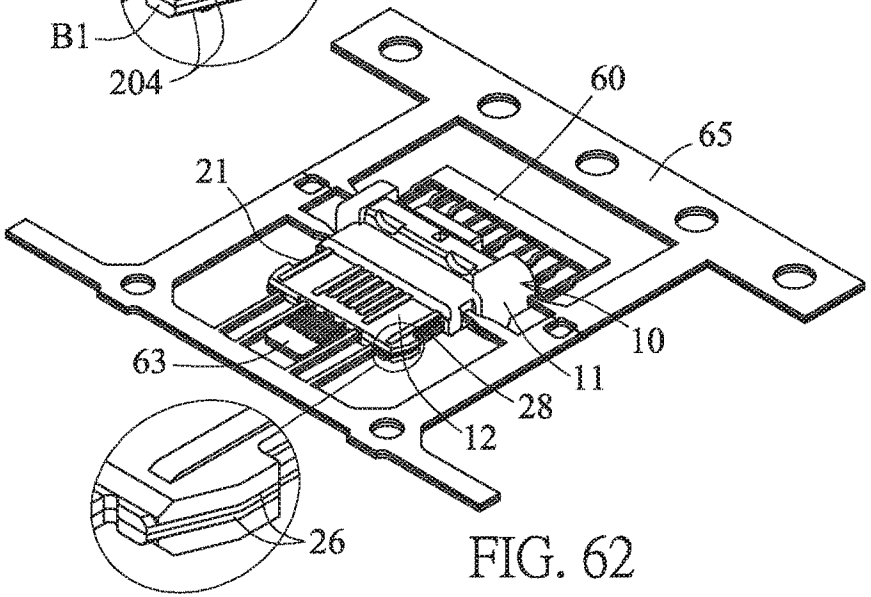
FIG. 62 is a pictorial view showing the manufacturing process of the sixth modification of the second embodiment of the invention.
Figure 64:
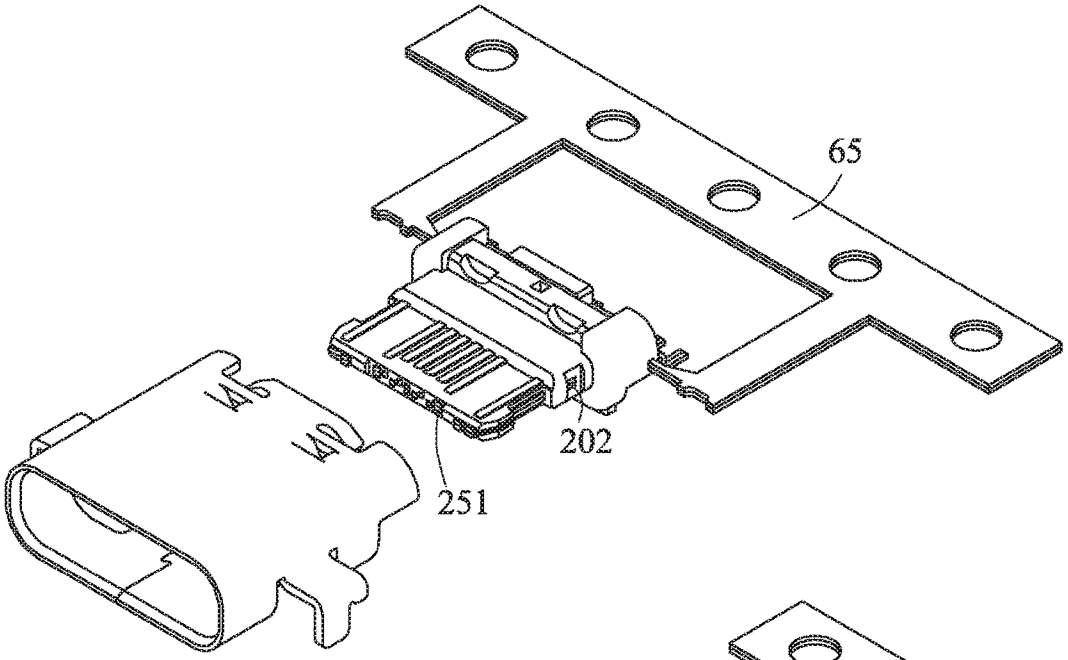
FIG. 64 is a pictorial view showing the manufacturing process of the sixth modification of the second embodiment of the invention.
Figure 65:
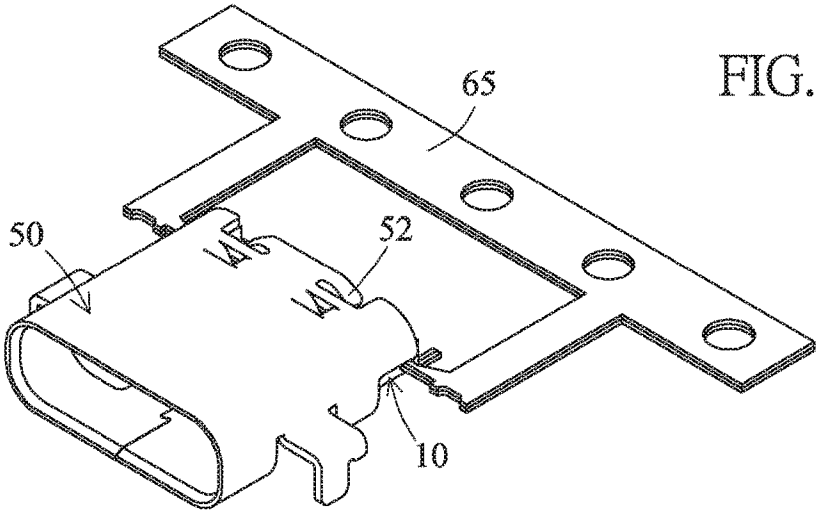
FIG. 65 is a pictorial view showing the manufacturing process of the sixth modification of the second embodiment of the invention.
Figure 66:
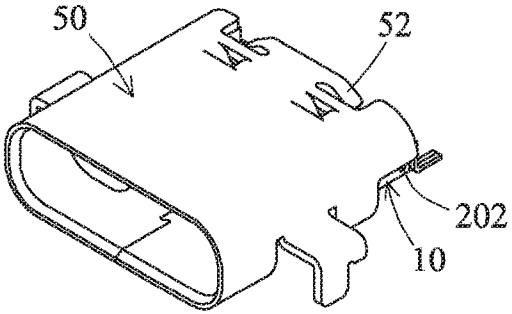
FIG. 66 is a pictorial view showing the manufacturing process of the sixth modification of the second embodiment of the invention.

Referring to FIG. 61, under the operation of the automatic machine, the two rows of terminals 20 are stacked in an aligned manner through the positioning holes, the extensions 22 and the resting portions 26 of the ground terminals and the power terminals on two sides of the two rows of terminals 20 are vertically stacked. Referring to FIG. 62, the two rows of terminals 20 are embedded into the plastic material at a time to form the insulation seat 10 by way of injection molding. Referring to FIG. 64, after the front sections of the material tape 60, the inner material tape 63 and the outer material tape 65 are removed, the metal housing 50 is to be assembled from front to rear. The front ends of the two rows of terminals 20 forms electroplate-layer-free sections. The broken portions of the extensions 22 of the two side terminals are in the form of an electroplate-layer-free section 27 exposed at the left and right sides of the base seat of the insulation seat 10. At this time, the front end of the tongue is dipped with tin so that the electroplate-layer-free sections of the front ends of two rows of terminals 20 are attached with tin to form the rustproof layers 251. Referring to FIG. 65, the metal housing 50 is assembled, from front to rear, to cover the insulation seat 10. Referring to FIG. 66, the rear section of the outer material tape 65 is removed at lest, the other broken portions of the extensions 22 of the two side terminals are in the form of an electroplate-layer-free section 27 exposed at the left and right sides of the base seat of the insulation seat 10.

Figure 67:
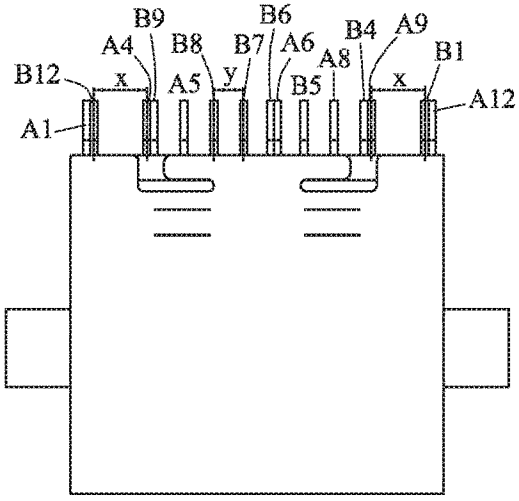
FIG. 67 is a top view showing the seventh modification of the second embodiment of the invention.

Referring to FIG. 67 showing the seventh modification of this embodiment substantially the same as the FIGS. 42 to 49 and the sixth modification, the rear sections of the extensions 22 of at least one pair or two pairs of terminals (ground terminal, power terminal, high differential terminal, low-high differential terminal, and detection terminal) in the two rows of terminals 20 are also turned to left and right sides and transversally and outwardly extended relatively to the contacts 21 in this modification, so that the arrangement width of the pins 23 of each row of terminals is greater than the arrangement widths of the contacts 21, so that the gaps between the arranged pins are enlarged to be larger than the gaps between the horizontal pins by at least 0.6 or 0.8 mm.

The difference resides in that the gap x between the pins of the adjacent ground terminal B12 and power terminal A4 of this modification is greater than the gap y between other adjacent pins, and the gap x between the adjacent pins of the ground and power terminals is greater than the pin gap of the maximum horizontal 0.525 mm of USB C TYPE standard socket, the safety clearance greater than the maximum horizontal 0.525 mm may be the horizontal pin gap greater than or equal to 0.60 or 0.80 mm.

In this modification, the pin gap y has been enlarged by the expansion of the extensions of the two rows of terminals, and the gap x between the pins of the adjacent ground terminal B12 and power terminal A4 is further greater than the gap y between other adjacent pins, and the safety is further ensured.

Figure 68:
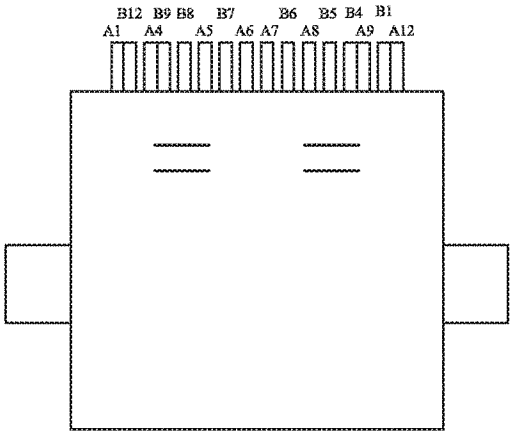
FIG. 68 is a top view showing the conventional bidirectional duplex USB TYPE-C 2.0 electrical connection socket.

Referring to FIG. 68 showing the currently known bidirectional duplex USB TYPE-C 2.0 electrical connection socket, two rows of pins are arranged into one row. However, the extensions of the two rows of terminals are not outwardly expanded to achieve the enlargement of the pin gap, and the pin gap between the adjacent ground terminal B12 and power terminal A4 is equal to the gap y between other adjacent pins, so that the ground terminal B12 and power terminal A4 tend to be short-circuited to cause danger.

Figure 69:
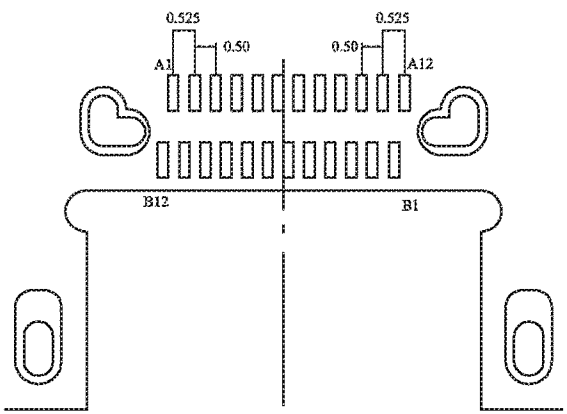
FIG. 69 is an arrangement diagram showing bonding pads of two rows of horizontal pins of the bidirectional duplex USB TYPE-C 3.1 circuit board currently published by USB Association.

Referring to FIG. 69, which is an arrangement diagram showing bonding pads of two rows of horizontal pins of the bidirectional duplex USB TYPE-C 3.1 circuit board currently published by USB Association, the maximum gap between the bonding pads disposed on two sides is equal to 0.525 mm, and the gap between the other bonding pads is equal to 0.5 mm.

Figure 70:
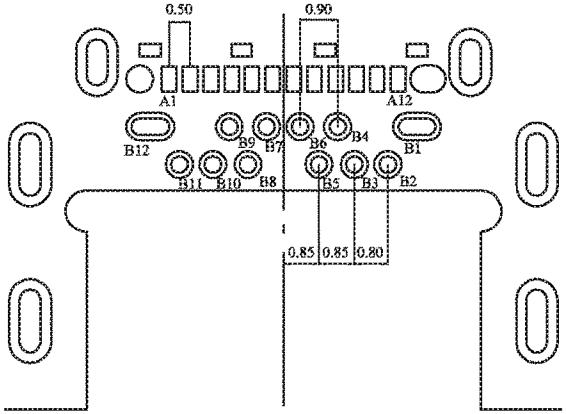
FIG. 70 is an arrangement diagram showing the bonding pads for one row of horizontal pins and the holes for one row of longitudinal pins of the bidirectional duplex USB TYPE-C 3.1 circuit board currently published by USB Association.

Referring to FIG. 70 showing the arrangement of the bonding pads for one row of horizontal pins and the holes for one row of longitudinal pins of the bidirectional duplex USB TYPE-C 3.1 circuit board currently published by USB Association, the gaps between the bonding pads are equal to 0.5 mm, the maximum gap between the holes is equal to 0.9 mm, the gap between the other holes on two sides is equal to 0.85 mm, and the other gap between the bonding pads is equal to 0.5 mm.

Figure 71:
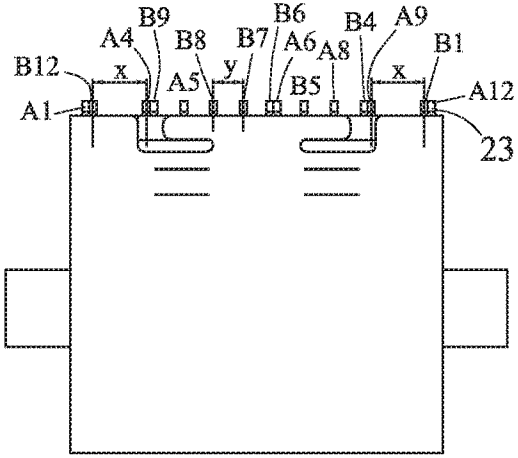
FIG. 71 is a top view showing the eighth modification of the second embodiment of the invention.
Figure 72:
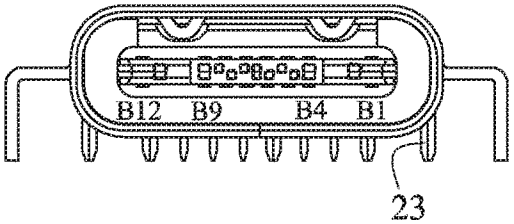
FIG. 72 is a front view showing the eighth modification of the second embodiment of the invention.

Referring to FIG. 71 and FIG. 72 showing the eighth modification of this embodiment substantially the same as the seventh modification, the rear sections of the extensions 22 of at least one pair or two pairs of terminals (ground terminal, power terminal, high differential terminal, low-high differential terminal, and detection terminal) in the two rows of terminals 20 of this modification are similarly turned to left and right sides and transversally and outwardly extended relatively to the contacts 21, so that the arrangement width of the pins 23 of each row of terminals is greater than the arrangement widths of the contacts 21, and that the gaps between the arranged pins are enlarged to be larger than the gap between the longitudinal pins by at least 0.8 mm.

In this modification, the gap x between the pins of the adjacent ground terminal B12 and power terminal A4 is greater than the gap y between other adjacent pins, and the gap x between the adjacent pins of the ground and power terminals is greater than the pin gap of the maximum hole of 0.9 mm of the USB C TYPE standard socket, the safety clearance greater than the maximum hole of 0.9 mm may be the gap (greater than or equal to 1.0 or 1.2 mm) between the longitudinal pins.

In this modification, the pin gap y is enlarged by outwardly expanding the extensions of the two rows of terminals, and the gap x between the pins of the adjacent ground terminal B12 and power terminal A4 is further greater than the gap y between other adjacent pins, so the safety is further ensured.

Figure 74:
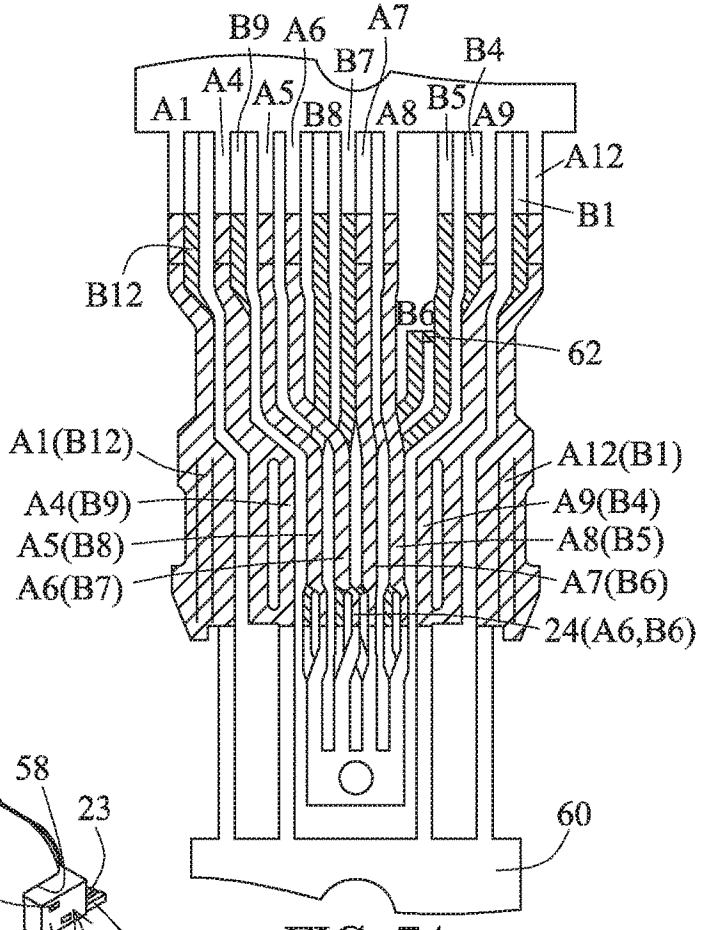
FIG. 74 is an assembled top view showing two rows of terminals of the ninth modification of the second embodiment of the invention.
Figure 73:
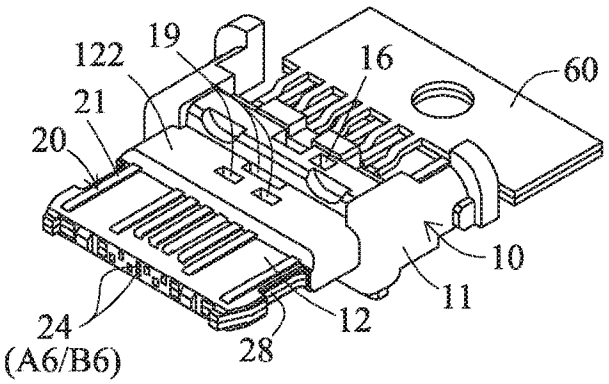
FIG. 73 is a partially pictorial view showing the ninth modification of the second embodiment of the invention.

Referring to FIG. 73 and FIG. 74, the ninth modification of this embodiment is substantially the same as the FIGS. 35 to 38 (third modification) except for the following difference. The extensions 22 of middle four terminals (A5, A6, A7, A8 and B5, B6, B7, B8) of the two rows of terminals 20 of this modification are not overlapped in the top-bottom direction and are staggered in the left-right direction. Thus, when the two rows of terminals 20 are embedded and plastic injection molded, the push needle can push and position the top and bottom ends of the extensions 22 of the 8 terminals, thereby achieving the precise embedding and plastic injection molding. Thus, the insulation seat 10 are formed with push needle holes 19 on the rear sections 122 of the two connection surfaces of the tongue 12 corresponding to the extensions 22 of the 8 terminals.

Figure 76:
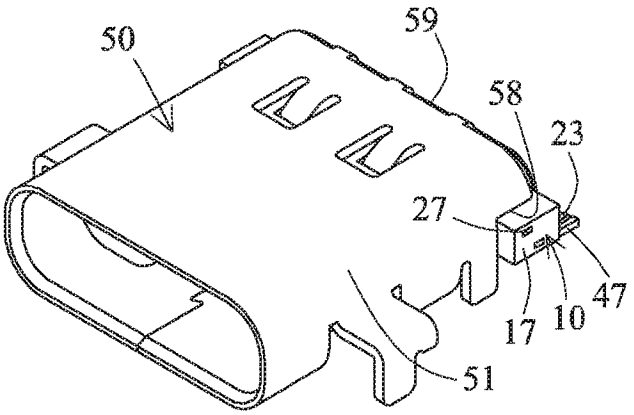
FIG. 76 is a pictorial view showing the tenth modification of the second embodiment of the invention.
Figure 75:
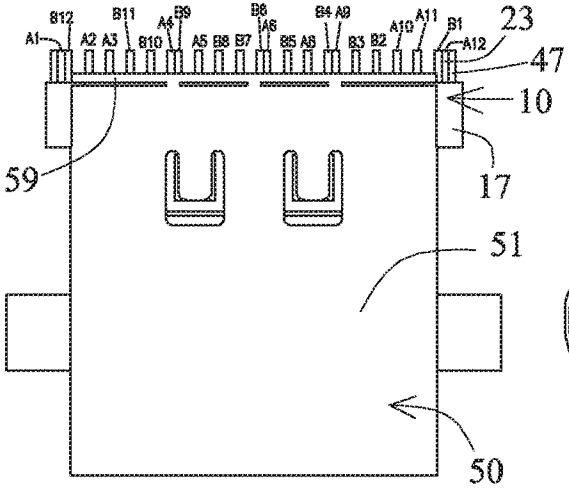
FIG. 75 is a top view showing the tenth modification of the second embodiment of the invention.
Figure 79:
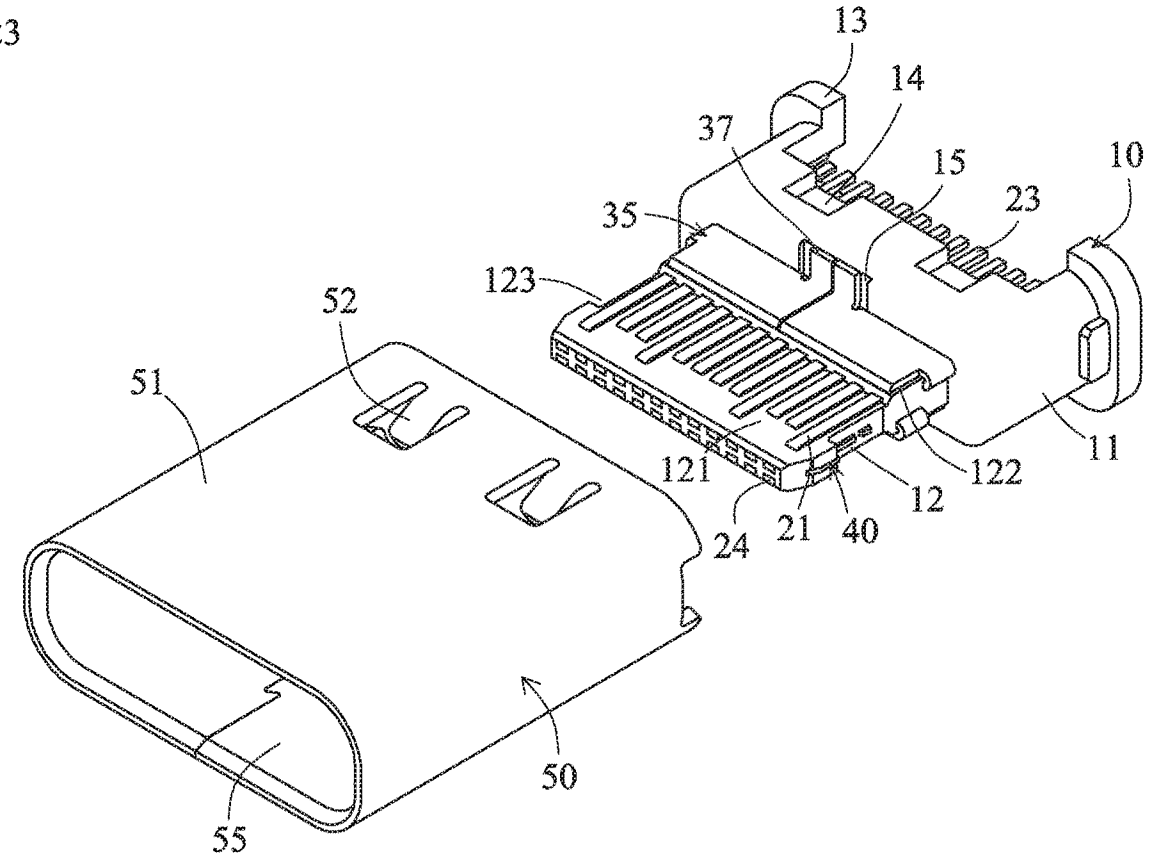
FIG. 79 is a pictorially exploded view showing the third embodiment of the invention.

Referring to FIG. 75 and FIG. 76, the tenth modification of this embodiment is substantially the same as the first embodiment and each modification thereof except for the following difference. Each of the left and right sides of the rear section of the insulation seat 10 of this modification are provided with a convex portion 17 outwardly projecting beyond the left and right sides of the four-sided main housing 51 of the metal housing 50, so that the extensions of the two rows of terminals obtain the larger area for the outward expansion toward the left and right sides. Each of the left and right sides of the rear end of the metal housing 50 is provided with a space providing notch 58 so that the convex portion 17 can project toward the left and right sides.

Referring to FIGS. 77 to 80, the third embodiment of the invention provides a plate holding type bidirectional duplex USB TYPE-C 3.1 electrical connection socket, which is substantially the same as the first embodiment and is provided with an insulation seat 10, two rows of terminals 20, a ground shielding member, a metal partition plate 40, two insulating layers 70 and a metal housing 50.

The insulation seat 10 is made of a plastic material and integrally provided with a base seat 11 and a tongue 12. The front end of the base seat 11 is projectingly provided with the tongue 12. The inner end of the tongue 12 is connected to the base seat 11. The thickness of the base seat 11 is greater than that of the tongue 12. The top and bottom surfaces of the tongue 12 are two connection surfaces with larger plate surfaces. The rear section of the tongue 12 is thicker than the front section of the tongue 12 so that the rear sections 122 of the two connection surfaces project much more than the front sections 121 of the two connection surfaces. The left and right sides of the tongue 12 are provided with concave portions 123. The left and right sides of the rear section of the base seat 11 are provided with convex portions 13, the top surface of the front section of the base seat 11 is provided with two engagement holes 14, and the top and bottom surfaces of the front section extending to the tongue 12 are provided with concave surfaces 15.

The two rows of terminals 20, a metal partition plate 40, two insulating layers 70 and the insulation seat 10 are embedded into and plastic injection molded with. Each of the two rows of terminals 20 has 12 terminals. As shown in FIG. 2, the upper row of terminals are represented by "A", the connection points with the circuit serial numbers sequentially arranged, from left to right, as A1, A2, A3 . . . A12, the lower row of terminals are represented by "B", and the connection points with the circuit serial numbers sequentially arranged, from left to right, as B12, B11, B10 . . . B1. Each terminal 20 is integrally provided with, from front to rear, a connection portion 24, a contact 21, an extension 22 and a pin 23. The contact 21 is in flat surface contact with the tongue 12 and elastically non-movable, and is exposed to slightly project beyond the front sections 121 of the two connection surfaces. The pin 23 extends out of the rear end of the base seat 11 and has a horizontal distal section. The distal sections of the pins 23 of the two rows of terminals are in the form of two rows of horizontal pins with a height difference, so that they can clamp and rest against the connection points of the top and bottom surfaces of a circuit board. The extension 22 is disposed between the pin 23 and the contact 21. A bent segment is formed between the connection portion 24 and the contact 21 so that the connection portion 24 is lower than the front sections 121 of the two connection surfaces and embedded into the tongue 12. The connection portions 24 of the two rows of terminals 20 are vertically aligned and have a height gap. The front end of the connection portion 24 is an electroplate-layer-free section 25. The contacts 21 of the two rows of terminals 20 are respectively exposed on the front sections 121 of the two connection surfaces of the tongue 12 and are vertically aligned. The contacts 21 of the two rows of terminals are the same contact interface and are vertically aligned. The contacts of the two rows of terminals are arranged in an equally spaced manner according to the connection points of the circuit serial numbers, and two rows of contacts have connection points with the same serial numbers are arranged reversely. In addition, the contacts 21 of the two rows of terminals are respectively arranged in two rows having different lengths. That is, four long terminals and eight short terminals are provided.

Each of the front sections of the left and right sides of the metal partition plate 40 is provided with a depressed snap 41. Each of the left and right sides of the rear end of the metal partition plate 40 is provided with a pin 42. The middle of the metal partition plate 40 is provided with four opening holes 43. The two insulating layers 70 are in flat surface contact with the top and bottom surfaces of the metal partition plate 40. The contacts 21 and extension 22 of the two rows of terminals 20 are respectively in flat surface contact with and rest against the two insulating layers 70. The bent segments of the two rows of terminals 20 are bent toward a middle of the insulation seat 10 so that the connection portions 24 are disposed in front of the two insulating layers 70 and the metal partition plate 40.

The ground shielding member includes four grounding sheets 35. Each of the two side ground terminal A1, A12, B1 and B12 of the two rows of terminals 20 is integrally connected to the grounding sheet 35. The grounding sheet 35 is provided with a vertical engaging plate sheet 36 and an extension sheet 37. The engaging plate sheet 36 is bent and in flat surface contact with the rear section 122 of the two connection surfaces of the insulation seat 10. The extension sheet 37 is bonded or connected to the concave surface 15 of the base seat 11.

The metal housing 50 covers the insulation seat 10 and rests against and engages with the base seat 11. The metal housing 50 is formed by bending a metal plate sheet and has a front section provided with a four-sided main housing 51. The top of the rear section of the metal housing 50 is provided with two engaging sheets 52 engaging with two engagement holes 14 of the base seat 11. The four-sided main housing 51 and the front end of the base seat 11 form a connection slot 55 in the four-sided main housing 51. The tongue 12 is horizontally suspended at the middle height of the connection slot 55 and extends frontwards. The insert port of the connection slot 55 faces frontwards. The connection slot 55 and the tongue 12 form a docking structure to be reversibly and dual-positionally inserted by an electrical connection plug for electrical connecting and positioning. The front end of the tongue 12 is close to the insert port of the connection slot 55. The two connection surfaces of the tongue 12 form the symmetrical space. The connection slot 55 has a top-bottom symmetrical and left-right symmetrical shape and has two arced sides to approach a rectangular shape.

Figure 83:
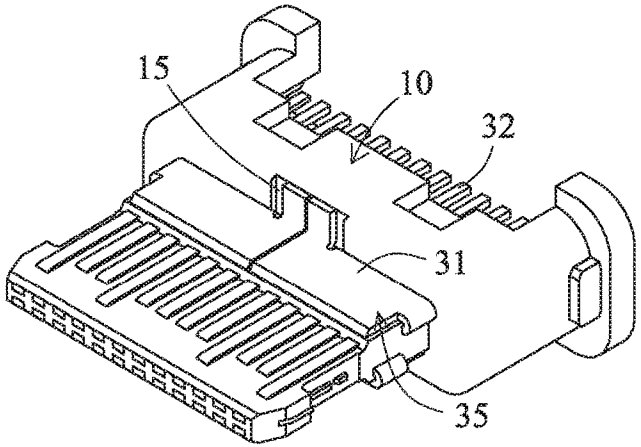
FIG. 83 is a pictorial view showing the manufacturing process of the third embodiment of the invention.
Figure 84:
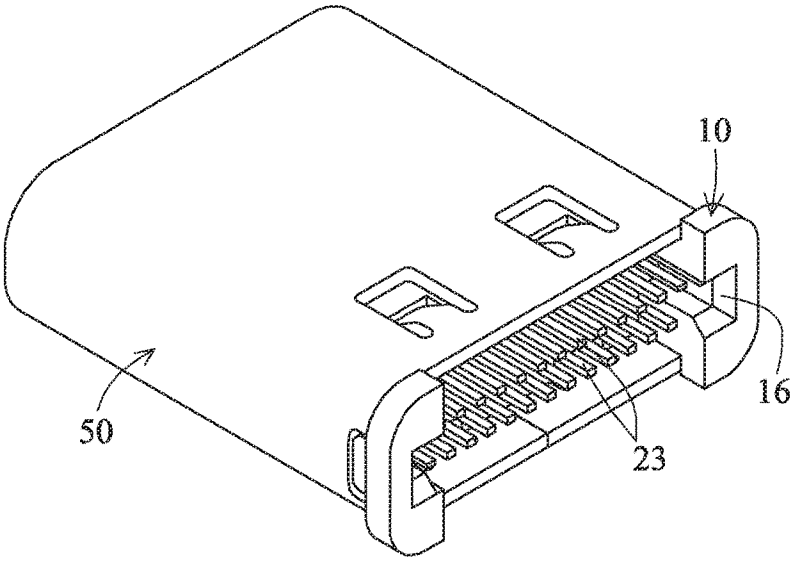
FIG. 84 is a pictorial view showing the manufacturing process of the third embodiment of the invention.
Figure 81:
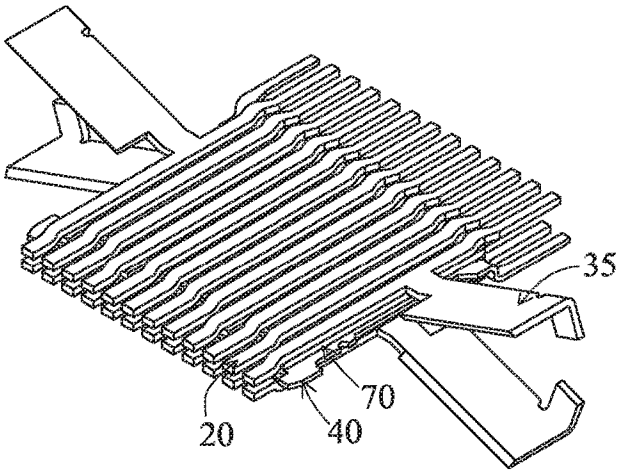
FIG. 81 is a pictorial view showing the manufacturing process of the third embodiment of the invention.
Figure 82:
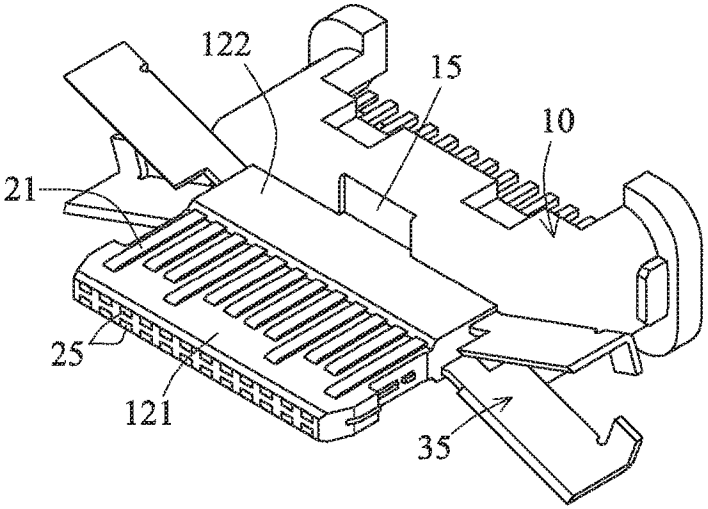
FIG. 82 is a pictorial view showing the manufacturing process of the third embodiment of the invention.

Upon manufacturing, the two rows of terminals 20, two insulating layers 70 and the metal partition plate 40 are substantially the same as the those of FIG. 11, and are individually connected to a material tape. Referring to FIG. 81, under the operation of the automatic machine, the two rows of terminals 20, two insulating layers 70 and the metal partition plate 40 are stacked in an aligned manner through the positioning hole of the material tape (not shown). The two rows of terminals 20 are separated from the metal partition plate 40 through the two insulating layers 70. Referring to FIG. 82, the insulation seat 10 is formed by way of embedding and plastic injection molding. Referring to FIG. 83, the four grounding sheets 35 of the ground shielding member are bent toward the tongue, the engaging plate sheet 36 is bent and in flat surface contact with the rear section 122 of the two connection surfaces of the insulation seat 10, and the extension sheet 37 is bonded or connected to the concave surface 15 of the base seat 11. Referring to FIG. 84, the metal housing 50 is assembled from front to rear assemble to cover the insulation seat 10 at last.

Figure 77:
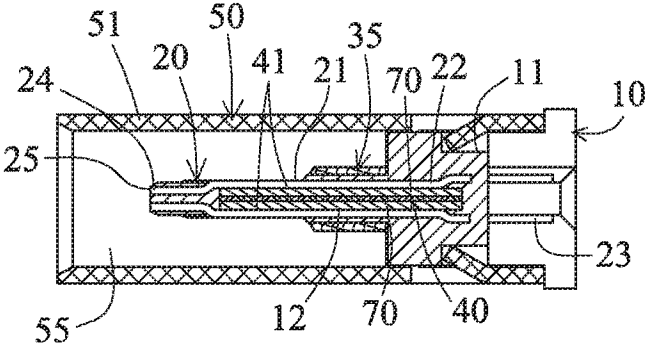
FIG. 77 is a cross-sectional side view showing the third embodiment of the invention.
Figure 78:
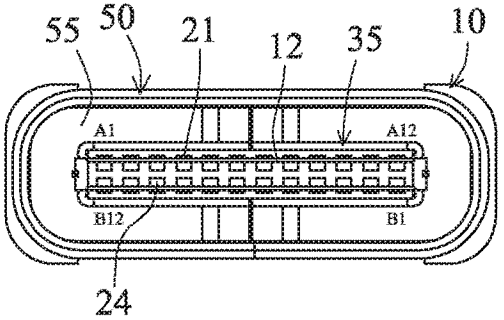
FIG. 78 is a front view showing the third embodiment of the invention.
Figure 80:
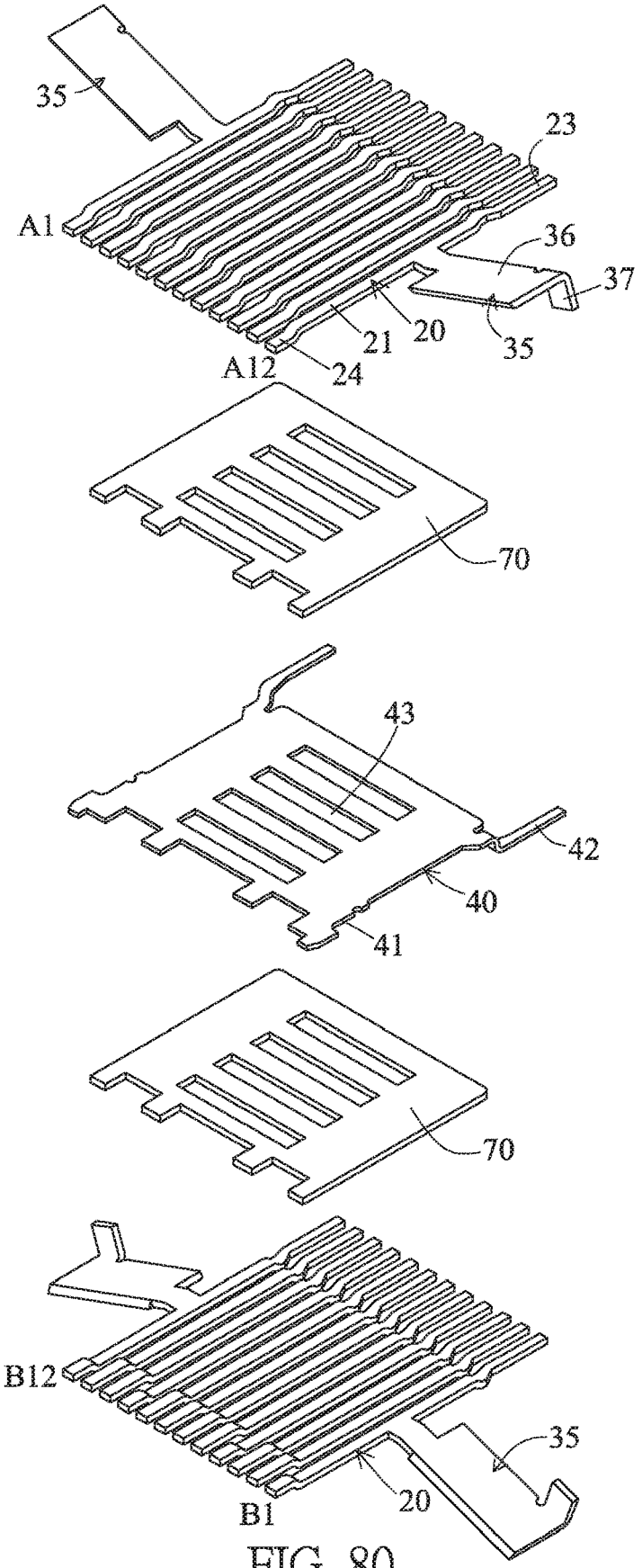
FIG. 80 is a pictorially exploded view showing the third embodiment of the invention.
Figure 85:
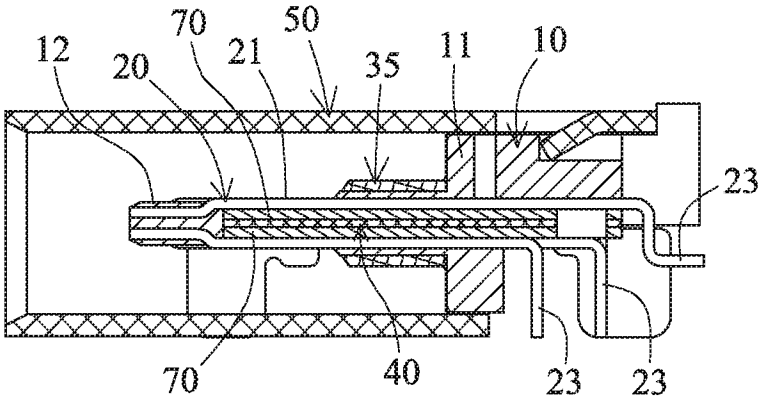
FIG. 85 is a cross-sectional side view showing the first modification of the third embodiment of the invention.

Referring to FIG. 85, the first modification of this embodiment is substantially the same as the FIG. 77, and the difference resides in that the pins 23 of the lower row of terminals 20 are arranged in two rows of longitudinal insert pins. Two sides of the rear end of the metal housing 50 are provided with two left-right symmetrical rear plate connecting members 54.

Figure 86:
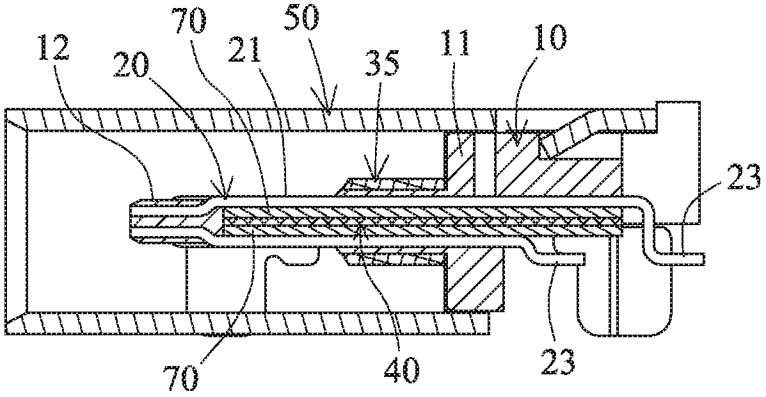
FIG. 86 is a cross-sectional side view showing the second modification of the third embodiment of the invention.

Referring to FIG. 86 showing the second modification of this embodiment substantially the same as the FIG. 85, the difference resides in that the distal sections of the pins 23 of the two rows of terminals 20 are arranged in front and rear (two) rows of horizontal pins.

Figure 87:
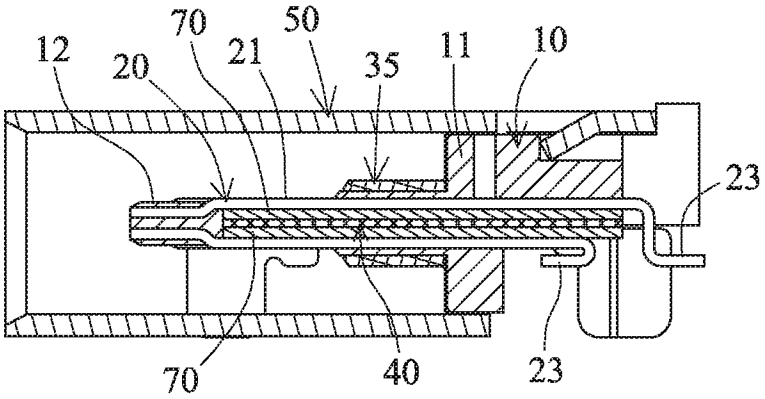
FIG. 87 is a cross-sectional side view showing the third modification of the third embodiment of the invention.

Referring to FIG. 87 showing the third modification of this embodiment substantially the same as the FIG. 86, the difference resides in that the distal sections of the pins 23 of the lower row of terminals 20 are bent frontwardly to become horizontal.

The electrical connection socket of the above-mentioned embodiment pertains to the horizontal type. That is, the insert port of the connection slot 55 faces frontwards, and the tongue 12 horizontally extends frontwards. However, a side-standing (the insert port of the connection slot faces frontwards, and the tongue vertically extends frontwards) or an upright (the insert port of the connection slot faces upwards, and the tongue vertically extends upwards) electrical connection socket implemented according to the technical characteristics of the invention still pertains to the modification of the invention. In addition, any multilayer or hybrid layer or sunk-plate or elevated product structure implemented adopting the technical characteristics of the invention still pertains to the modification of the invention.

Figure 88:
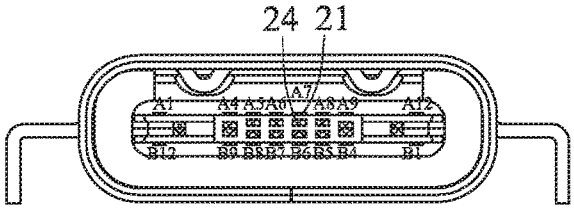
FIG. 88 is a front view showing the fourth embodiment of the invention.
Figure 89:
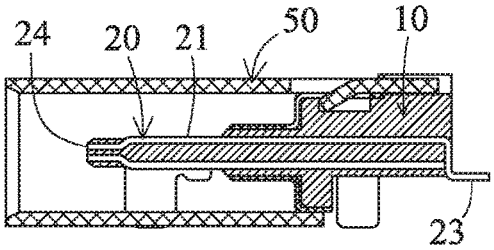
FIG. 89 is a cross-sectional side view showing the fourth embodiment of the invention.

Referring to FIG. 88 and FIG. 89, the fourth embodiment of the invention is substantially the same as the second embodiment, in which two pairs of ground terminals A1/B12, A12/B1 and two pairs of power terminals A4/B9, A9/B4 are provided with resting portions vertically stacked, and the difference resides in that the connection portions 24 of the middle four terminals (one pair of low differential signal terminals 6 and 7 and two detection terminals 5 and 8) of the two rows of terminals 20 of this embodiment are vertically aligned with a gap formed between adjacent ones of the connection portions.

Figure 90:
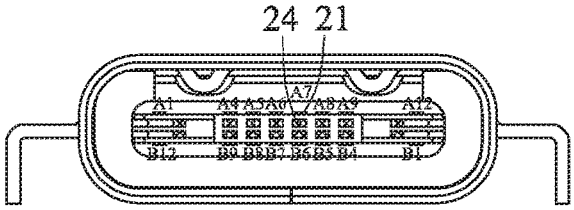
FIG. 90 is a front view showing the fifth embodiment of the invention.
Figure 91:
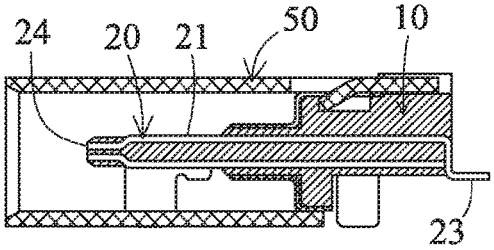
FIG. 91 is a cross-sectional side view showing the fifth embodiment of the invention.

Referring to FIG. 90 and FIG. 91, the fifth embodiment of the invention is substantially the same as the second embodiment, in which two pairs of ground terminals A1/B12, A12/B1 and two pairs of power terminals A4/B9, A9/B4 are provided with resting portions vertically stacked, and the difference resides in that all connection portions 24 of the two rows of terminals 20 of this embodiment are vertically aligned with a gap formed between adjacent two of them.

Figure 92:
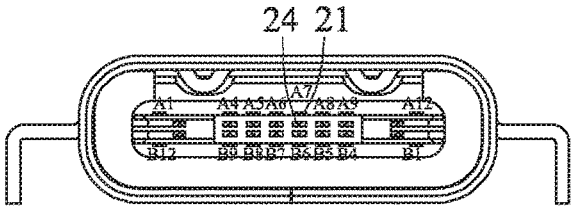
FIG. 92 is a front view showing the sixth embodiment of the invention.
Figure 93:
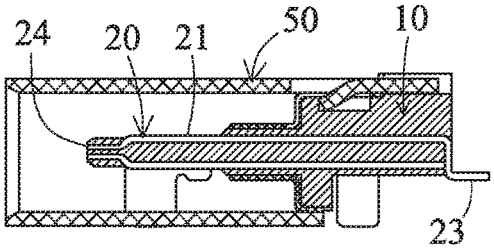
FIG. 93 is a cross-sectional side view showing the sixth embodiment of the invention.

Referring to FIG. 92 and FIG. 93, the sixth embodiment of the invention is substantially the same as the fifth embodiment, and the difference resides in that the connection portions 24 of the two rows of terminals 20 of this embodiment are thinned designs thinner than the thickness of the contact.

Figure 94:
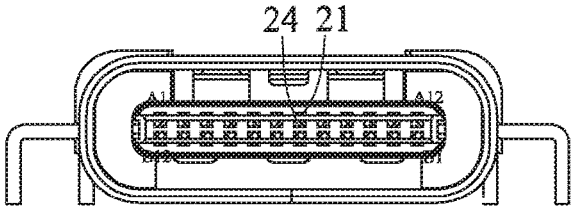
FIG. 94 is a front view showing the seventh embodiment of the invention.
Figure 95:
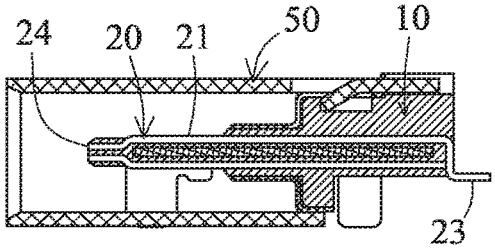
FIG. 95 is a cross-sectional side view showing the seventh embodiment of the invention.

Referring to FIG. 94 and FIG. 95, the seventh embodiment of the invention is substantially the same as the first embodiment, and the difference resides in that all connection portions 24 of the two rows of terminals 20 of this embodiment are vertically aligned with a gap formed between adjacent two of them.

Figure 39:
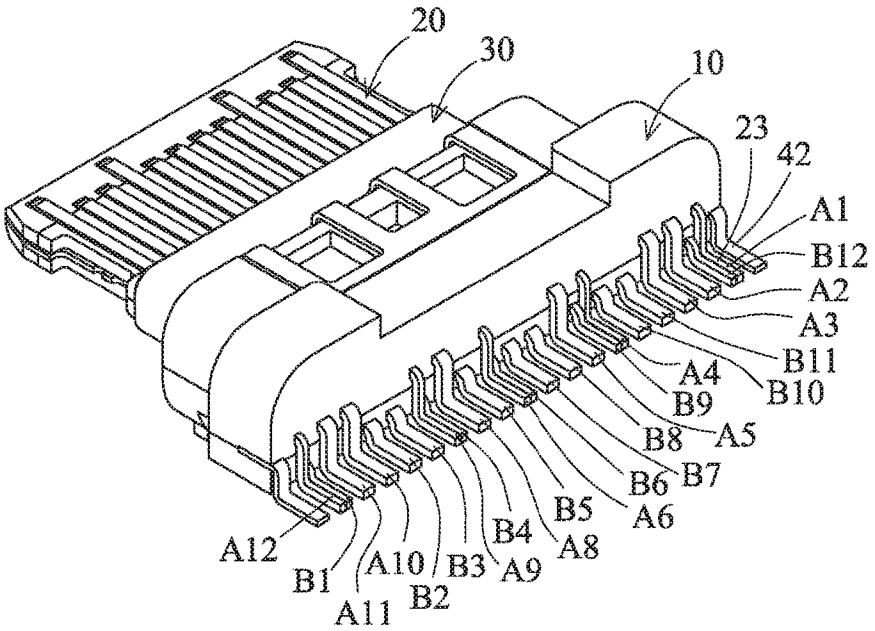
FIG. 39 is a pictorial view showing the eleventh modification of the first embodiment of the invention.
Figure 97:
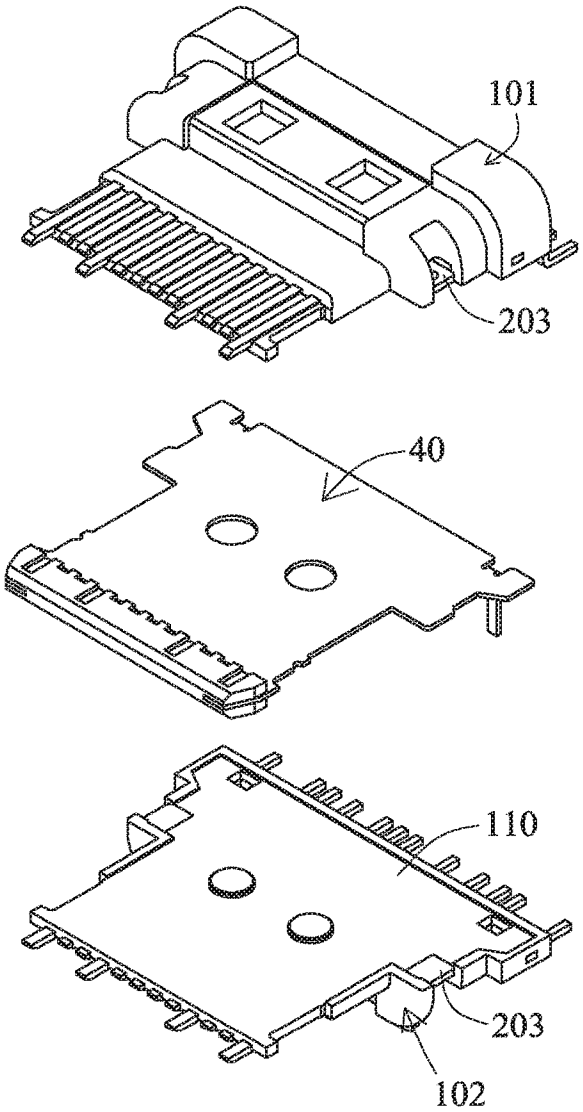
FIG. 97 is a partially pictorially exploded view showing the eighth embodiment of the invention.
Figure 96:
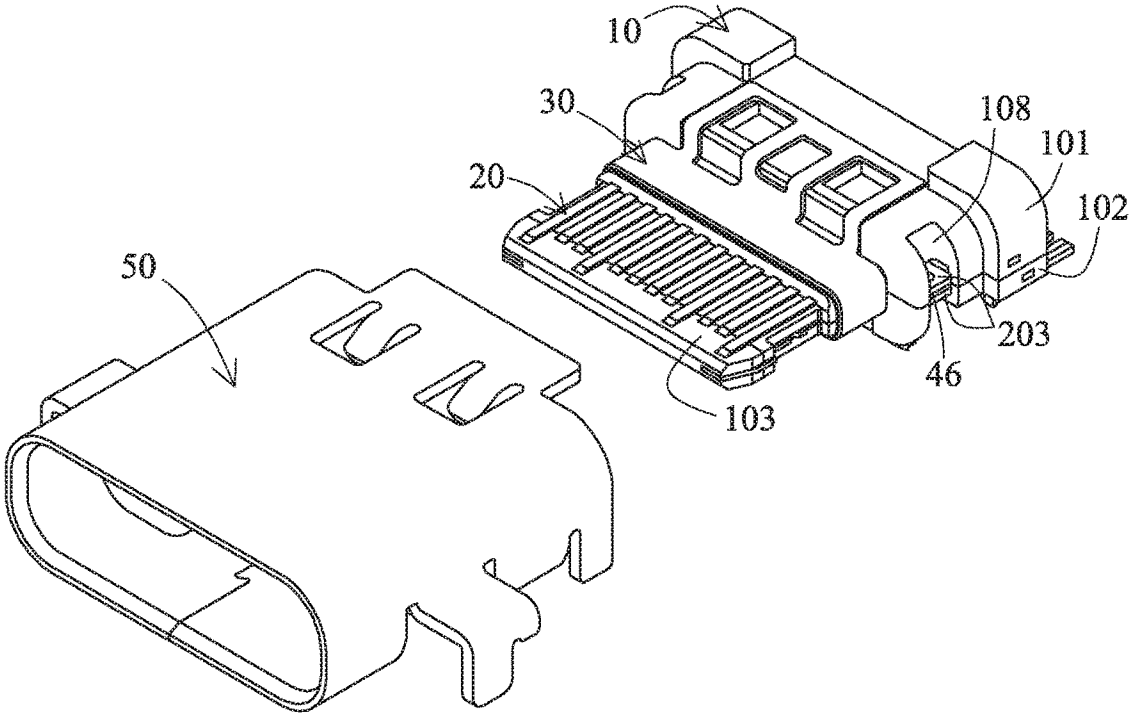
FIG. 96 is a pictorially exploded view showing the eighth embodiment of the invention.
Figure 98:
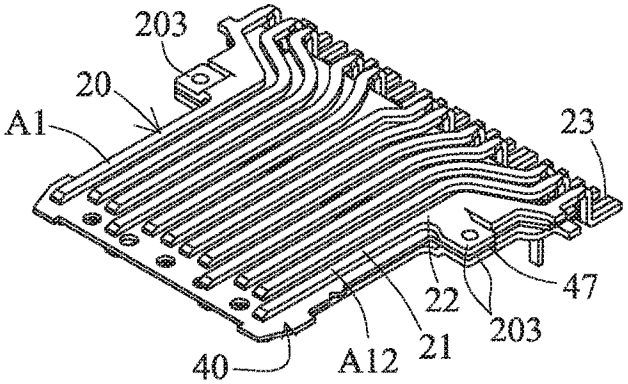
FIG. 98 is a pictorial view showing the two rows of terminals and the metal partition plate vertically stacked according to the eighth embodiment of the invention.

Referring to FIGS. 96 to 98, the eighth embodiment of the invention provides a plate-depressed type bidirectional duplex USB TYPE-C 3.1 electrical connection socket, which is substantially the same as the FIGS. 39 and 40 of the first embodiment, and the difference resides in that the extensions 22 of the ground terminals on two sides of the two rows of terminals 20 of this embodiment are provided with convex portions 203 each projecting outwards and being bent to form a step. The convex portion 203 is flush with the connection surface 110 of the insulation seat 10 connected to the metal partition plate 40. the metal partition plate 40 is provided with outwardly projecting convex portions 47 vertically corresponding to the convex portion 203. Each of the left and right sides of the insulation seat 10 is provided with a space providing slot 108. The convex portions 203 of the ground terminals on two sides of the two rows of terminals 20 and the convex portion 47 of the metal partition plate 40 are vertically stacked with and rest against each other and are disposed in the space providing slot 108 of the insulation seat 10. It is possible to perform spot welding on the convex portions 203 of the ground terminals on two sides of the two rows of terminals 20 and the convex portion 47 of the metal partition plate 40 from the space providing slot 108 to ensure electrical connection and mounting.

Figure 99:
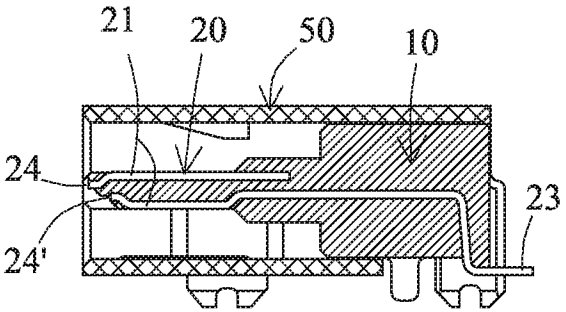
FIG. 99 is a cross-sectional side view showing the ninth embodiment of the invention.
Figure 100:
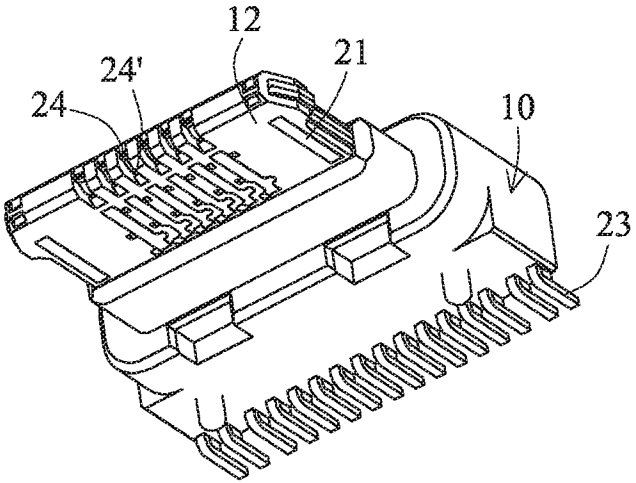
FIG. 100 is a partially pictorial view showing the ninth embodiment of the invention.

Referring to FIGS. 99 and 100, the ninth embodiment of the invention is substantially the same as the second embodiment, and the difference resides in that the connection portions 24 of the two rows of terminals 20 of this embodiment are staggered in one-front and one-rear manner but not staggered in the left-right direction.

Figure 101:
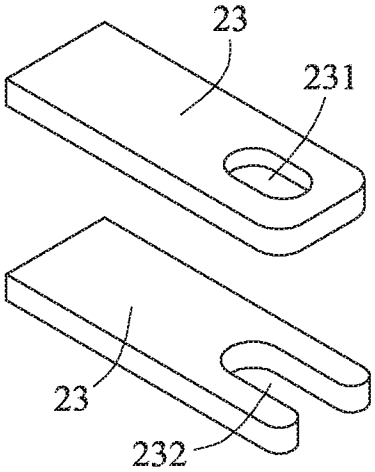
FIG. 101 is a pictorial view showing the separated pins of the one pair of upper and lower terminals of the tenth embodiment of the invention.
Figure 102:
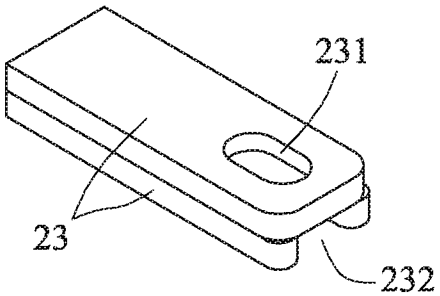
FIG. 102 is a pictorial view showing the vertically stacked pins of the one pair of upper and lower terminals of the tenth embodiment of the invention.

Referring to FIGS. 101 to 102 showing the tenth embodiment of the invention, one pair of vertical flush and combined horizontal pins 23 of each of the above-mentioned embodiments may also be designed into vertically stacked configurations, wherein the lower pin is provided with a notch 232, the upper pin is provided with a downward convex 231 fit into the notch 232, and this configuration is applicable surface mount technology (SMT).

Figure 103:
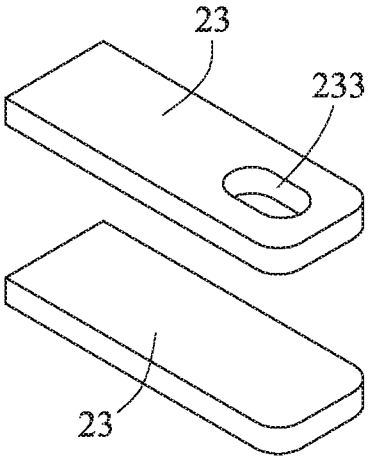
FIG. 103 is a pictorial view showing the separated pins of the one pair of upper and lower terminals of the eleventh embodiment of the invention.
Figure 104:
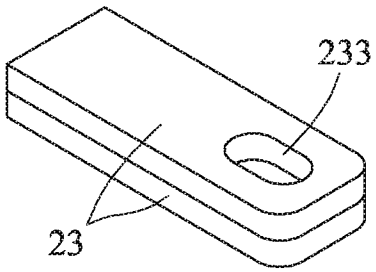
FIG. 104 is a pictorial view showing the vertically stacked pins of the one pair of upper and lower terminals of the eleventh embodiment of the invention.

Referring to FIGS. 103 to 104 showing the eleventh embodiment of the invention, one pair of vertical flush and combined horizontal pins 23 of each of the above-mentioned embodiments may also be designed into vertically stacked configurations, wherein the upper pin is provided with a through hole 233, and the configuration is applicable to the wire bonding type.

Figure 105:
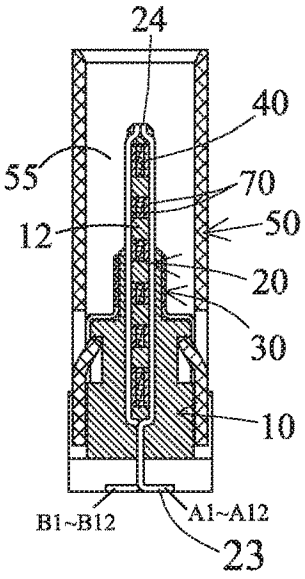
FIG. 105 is a cross-sectional side view showing the twelfth embodiment of the invention.
Figure 106:
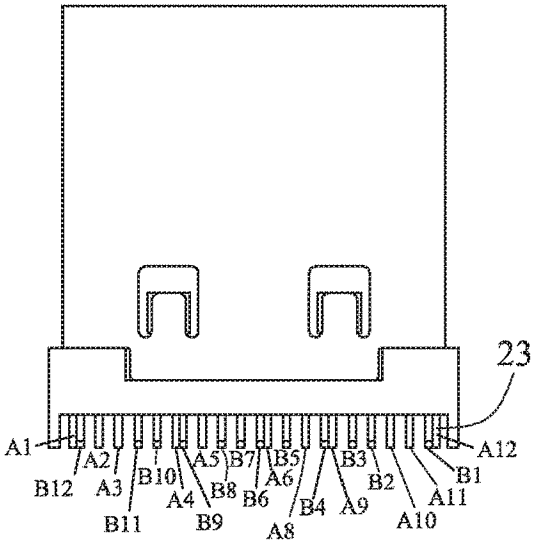
FIG. 106 is a front view showing the twelfth embodiment of the invention.
Figure 107:
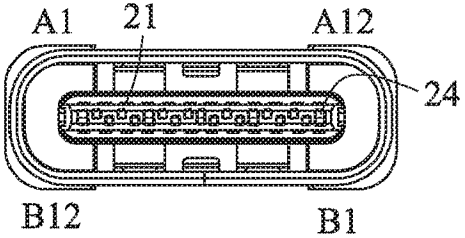
FIG. 107 is a top view showing the twelfth embodiment of the invention.

Referring to FIGS. 105 to 107, the twelfth embodiment of the invention provides an upright type bidirectional duplex USB TYPE-C 3.1 electrical connection socket substantially the same as the FIGS. 1 to 15 of the first embodiment, and the difference resides in that the insert port of the connection slot 55 of this embodiment face frontwards, the tongue 12 vertically extends upwards, the pins 23 of the two rows of terminals 20 are respectively bent toward two sides to become horizontal.

Figure 108:
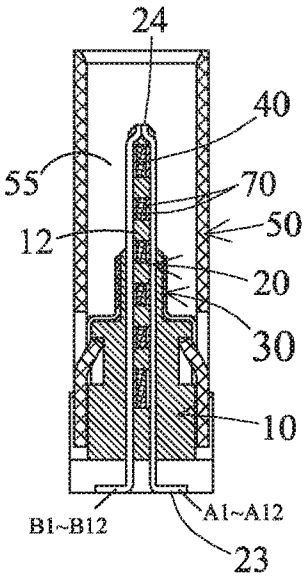
FIG. 108 is a cross-sectional side view showing the thirteenth embodiment of the invention.
Figure 109:
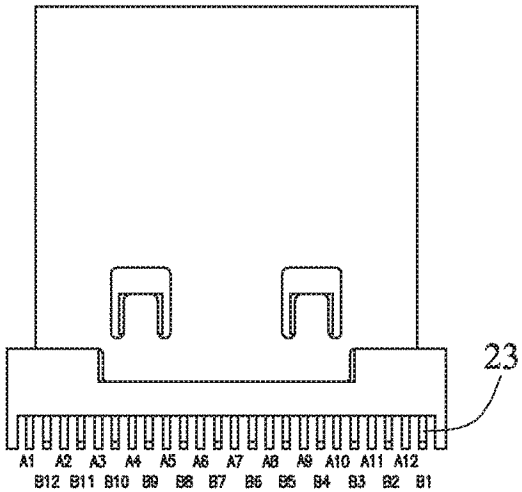
FIG. 109 is a front view showing the thirteenth embodiment of the invention.
Figure 110:
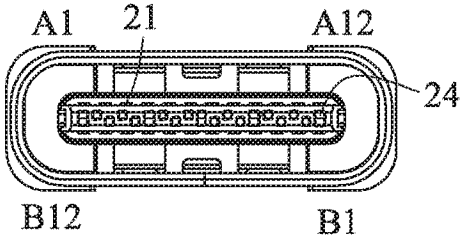
FIG. 110 is a top view showing the thirteenth embodiment of the invention.

Referring to FIGS. 108 to 110, the thirteenth embodiment of the invention is substantially the same as the twelfth embodiment, and the difference resides in that the pins 23 of the two rows of terminals of this embodiment are not combined together or adjacent and close to each other, and the terminals A7 and B7 have output pins.

Figure 111:
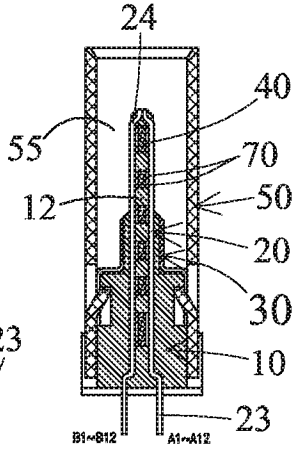
FIG. 111 is a cross-sectional side view showing the 14th embodiment of the invention.
Figure 112:
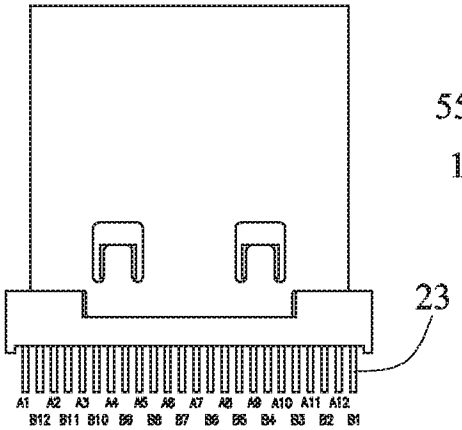
FIG. 112 is a front view showing the 14th embodiment of the invention.
Figure 113:
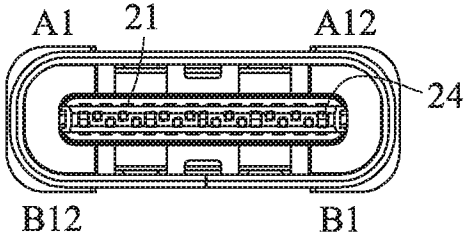
FIG. 113 is a top view showing the 14th embodiment of the invention.

Referring to FIGS. 111 to 113, the 14th embodiment of the invention is substantially the same as the thirteenth embodiment, and the difference resides in that the pins 23 of the two rows of terminals of this embodiment are directly longitudinal without being bent to become horizontal.

Figure 114:
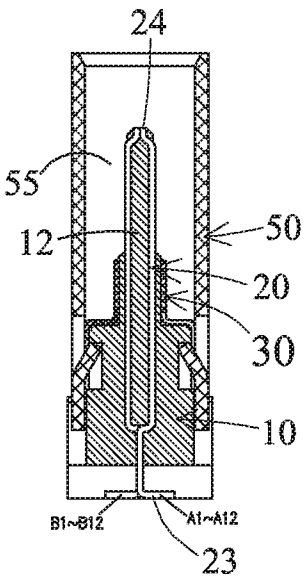
FIG. 114 is a cross-sectional side view showing the 15th embodiment of the invention.
Figure 115:
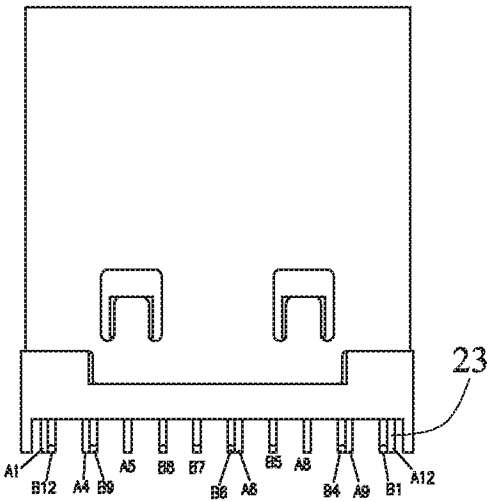
FIG. 115 is a front view showing the 15th embodiment of the invention.
Figure 116:
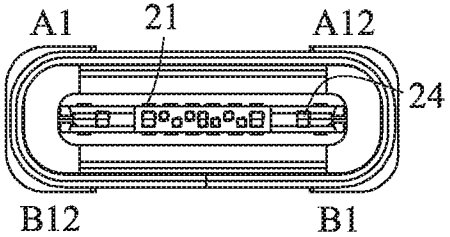
FIG. 116 is a top view showing the 15th embodiment of the invention.

Referring to FIGS. 114 to 116, the 15th embodiment of the invention provides an upright type bidirectional duplex USB TYPE-C 2.0 electrical connection socket substantially the same as the FIGS. 54 to 57 of the third modification of the second embodiment, and the difference resides in that the insert port of the connection slot 55 of this embodiment face frontwards, the tongue 12 vertically extends upwards, the pins 23 of the two rows of terminals 20 are respectively bent toward two sides to become horizontal.

Figure 117:
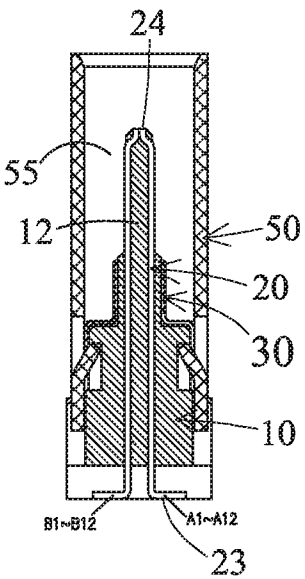
FIG. 117 is a cross-sectional side view showing the 16th embodiment of the invention.
Figure 118:
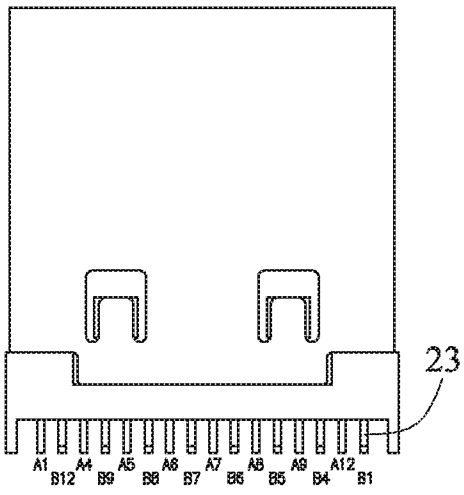
FIG. 118 is a front view showing the 16th embodiment of the invention.
Figure 119:
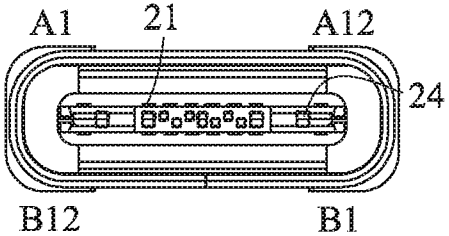

Referring to FIGS. 117 to 119, the 16th embodiment of the invention is substantially the same as the 15th embodiment, the difference resides in that the pins 23 of the two rows of terminals of this embodiment are not combined together or adjacent and close to each other, and the terminals A7 and B7 have output pins.

Figure 120:
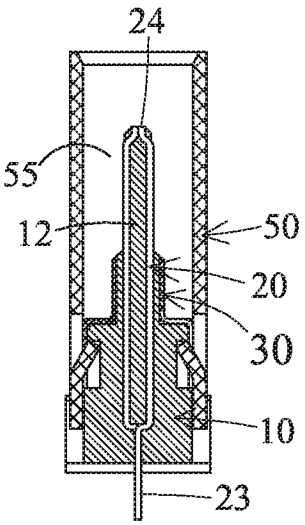
Figure 121:
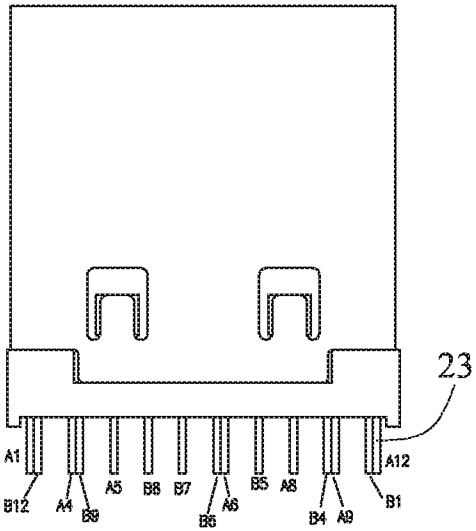
Figure 122:
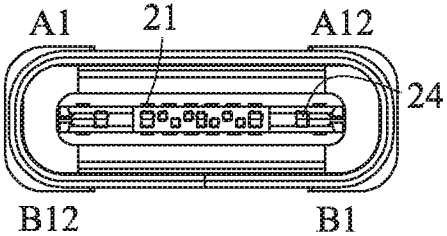

Referring to FIGS. 120 to 122, the 17th embodiment of the invention is substantially the same as the 15th embodiment, and the difference resides in that the pins 23 of the two rows of terminals of this embodiment are directly longitudinal without being bent to become horizontal.

Figure 123:
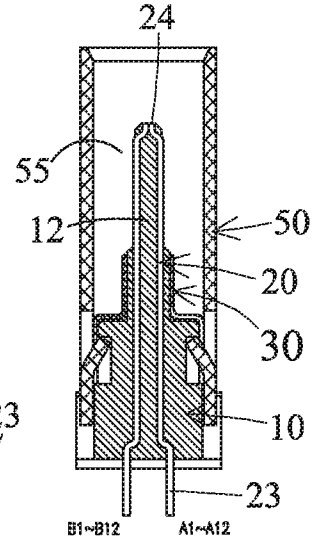
Figure 125:
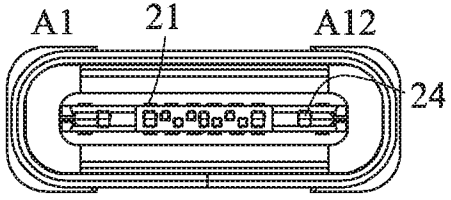
Figure 124:
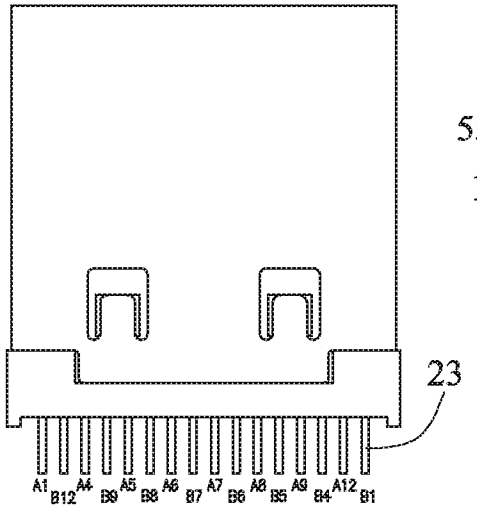

Referring to FIGS. 123 to 125, the 18th embodiment of the invention is substantially the same as the 16th embodiment, and the difference resides in that the pins 23 of the two rows of terminals of this embodiment are directly longitudinal without being bent to become horizontal.

Figure 127:
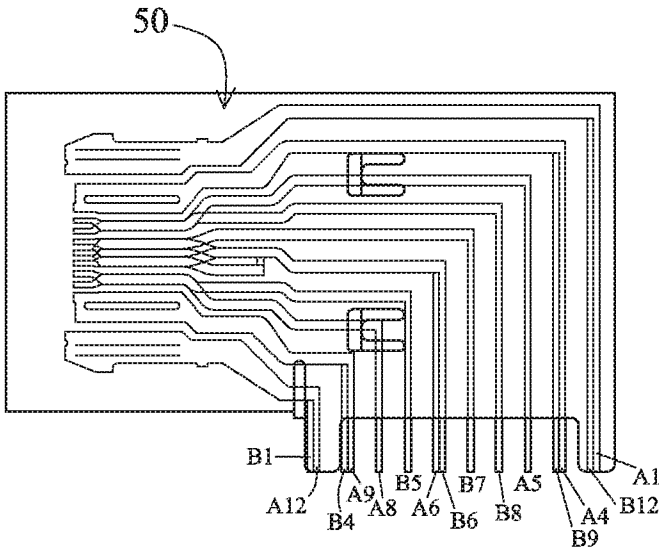
Figure 128:
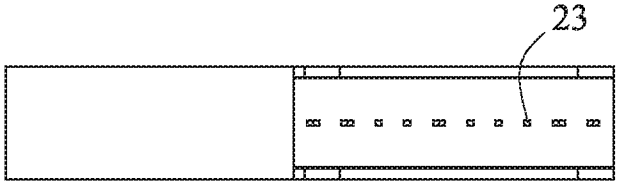
Figure 126:
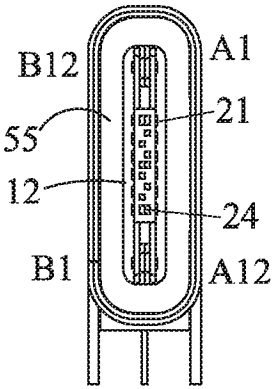

Referring to FIGS. 126 to 128, the 19th embodiment of the invention is substantially the same as the FIGS. 54 to 57 of the third modification of the second embodiment, and the difference resides in that this embodiment provides a side-standing row type. That is, the connection slot 55 and the tongue 12 are disposed in a side-standing manner, the insert port of the connection slot 55 faces frontwards, the tongue 12 extends frontwards in the side-standing manner, and the pins 23 of the two rows of terminals 20 are directed longitudinally downwards.

Figure 130:
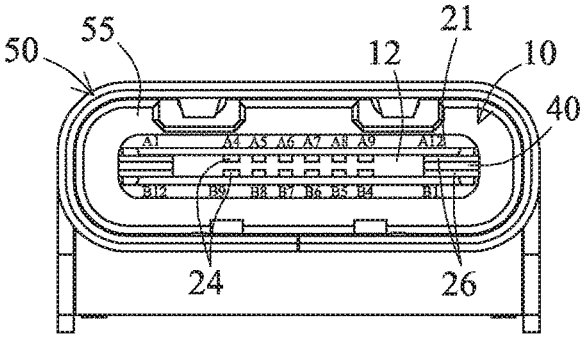
Figure 129:
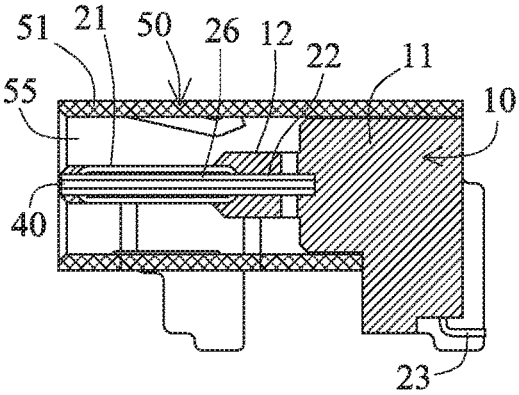

Referring to FIGS. 129 to 131, the 20th embodiment of the invention provides a bidirectional duplex USB TYPE-C 2.0 electrical connection socket substantially the same as the second embodiment, wherein the difference resides in that: this embodiment is further provided with a metal partition plate 40, the metal partition plate 40 includes two separate metal plate bodies, which are embedded into the left and right side positions of the middle thickness of the tongue 12 of the insulation seat 10. As shown by the slant line mark of the tongue 12 of the FIG. 130, the resting portions 26 of the ground terminals (A1, A12, B12, B1) of two sides of the two rows of terminals 20 are vertically stacked with and rest against each other on the top and bottom surfaces of the metal partition plate 40 to form three vertically stacked ground metal plates. The two separate metal plate bodies of the metal partition plate 40 are provided with the snaps 41 of the slots in conjunction with the snaps of the slots of the resting portions 26 of the ground terminals (A1, A12, B12, B1), so that the snap has the structural strength of the three metal plates to enhance the wear withstanding ability of the snap.

The connection portions 24 of the two rows of terminals 20 of this embodiment are separated and do not resting against each other. The pins 23 of the two pairs of ground terminals (A1/A12, B12/B1) of the two rows of terminals 20, the two pairs of power terminals (A1/A12, B12/B1) and A6/B6 are horizontally flush with each other and combined together or adjacent and close to each other.

Referring to FIG. 132, the first modification of the 20th embodiment of the invention is substantially the same as the 20th embodiment, and the difference resides in that: the connection portions 24 of the terminals A6/B6 of this embodiment are stacked and rest against each other, so that the terminals A6/B6 can have only one output pin, thereby decreasing the number of pins.

Referring to FIG. 133, the 21st embodiment of the invention provides a bidirectional duplex USB TYPE-C 3.1 electrical connection socket substantially the same as the first embodiment, and the difference resides in that: the metal plates of the ground terminals (A1, A12, B12, B1) of two sides of the two rows of terminals 20 of this embodiment are thicker than other terminals and are vertically stacked with and rest against each other on the top and bottom surfaces of the metal partition plate 40, thereby forming three vertically stacked ground metal plates.

The metal plates of other terminals (power and signal terminals) have the same thickness and are thinner than the metal plates of the other ground terminals (A1, A12, B12, B1). The other terminals (power and signal terminals) rest against the insulating layers 70 of the top and bottom surfaces of the metal partition plate 40.

Referring to FIGS. 134 to 144, the 22nd embodiment of the invention provides an on-board type bidirectional duplex USB TYPE-C 3.1 electrical connection socket, which is provided with an insulation seat 10, two rows of terminals 20, a ground shielding member 30, a metal partition plate 40, two insulating layers 70 and a metal housing 50, and has the structure substantially the same as the first embodiment and the ninth modification thereof. Similarly, the contacts 21 of the two rows of terminals 20 slightly project beyond the front sections 121 of the two connection surfaces of the tongue, the base seat 11 of the insulation seat 10 is provided with an annular groove 18, and the groove 18 is fitted with a waterproof ring 37, wherein the difference resides in the following.

The two insulating layers 70 are plastic sheets or insulation films.

A second housing 520 covers the four-sided main housing 51 of the metal housing 50, so that the four-sided main housing 51 completely has no prodding hole. The metal housing 50 is provided with a rear plate 58 covering the rear end of the insulation seat 10. Each of left and right sides of the rear plate 58 is perpendicularly bent to form a locking plate 59 locking to the rear plate connecting member 54. The second housing 520 has the plate surface prodded and punched to form two front plate connecting members 521 disposed on the left and right sides of the second housing 520.

The distal sections of the pins 23 of the upper row of terminals are in the form of one row of horizontal pins. The distal sections of the pins 23 of the lower row of terminals are in the form of two rows of upright pins arranged in a front-rear staggered manner. The front sections 235 of the pins of the lower row of terminals extends out of the base seat 11, then flush rest against the insulating layer 70 in the front-rear direction, and are then bent downwards and bent in the one-front-one-rear and equally spaced manner so that the distal sections of the pins 23 are in the form of two rows of upright pins arranged in a front-rear manner.

Thus, the lower row of terminals 20 can have the same material pulling length, so that the ends of the pins can be connected to the same material tape 60.

The connection portions 24 of the two rows of terminals 20 are vertically aligned, and the material-thickness gap of the metal partition plate 40 functions as partition, so that the manufacturing becomes easier.

Referring to FIGS. 138 and 40, a pin positioning seat 19 is additionally provided assembled, from bottom to top, to the bottom end of the base seat of the insulation seat 10. The pin positioning seat 19 is a two-piece structure formed by fitting the first and second seats 191 and 192 with each other. The first and second seats 191 and 192 are provided with serrated joint structures to form front and rear (two) rows of holes 193 and 194, through which the two rows of upright pins of the lower row of terminals pass.

In addition, referring to FIG. 141, the pin positioning seat 19 may also be an integral seat.

In addition, Referring to FIG. 139, the contacts 21 of the two rows of terminals 20 may also be flush with the front sections 121 of the two connection surfaces of the tongue.

The manufacturing processes of this embodiment will be described in the following. Referring to FIG. 142, when the two rows of terminals 20 are manufactured by way of stamping, the front and rear ends of each of the terminals are connected to the material tape 60, and the two material sheets 201 of the extensions 22 of the two side terminals are connected to an outer material tape 65. In addition, the metal partition plate 40 has left and right sides connected to an outer material tape 65, the two insulating layers 70 have left and right sides connected to an outer material tape 75, and the two insulating layers 70 are stacked over the top and bottom surfaces of the metal partition plate 40.

Referring to FIG. 143, under the operation of the automatic machine, the two rows of terminals 20, two insulating layers 70 and the metal partition plate 40 are stacked in an aligned manner through the positioning holes, the connection portions 24 of the ground terminals (A1, A12, B1, B12) of the two sides of the two rows of terminals 20 rest against the top and bottom surfaces of the convex portions 44 of the two sides of the front end of the metal partition plate 40, the two rows of terminals 20 are separated from the metal partition plate 40 through the two insulating layers 70. The two rows of terminals 20 and the material tapes 60 connected to the front end of the metal partition plate 40 are vertically stacked Referring to FIG. 144. The two rows of terminals 20, two insulating layers 70 and the metal partition plate 40 are embedded into the plastic material at a time to form the insulation seat 10 by way of injection molding.

When the two rows of terminals 20 of this embodiment are being manufactured, the connection portion 24 of the terminal 20 is directly connected to the continuously extended continuous plane of one side of the material tape 60. Thus, when the two rows of terminals and the insulation seat 10 are being embedded and injection molded together, the continuous plane of the material tape 60 directly rests against the front end of the tongue 12, and is aligned with and encapsulated with the front edge of the tongue. There is no need to use a mold to fill the gap, so that the injection molding process becomes more convenient.

The two rows of terminals and the front edge of the tongue are aligned and encapsulated with each other. As shown in FIGS. 144 and 144A, the aligned continuous plane of the material tape 60 slightly falls into the front end surface 124 of the tongue 12 (i.e., the two rows of terminals 20 are embedded into the tongue 12 with the alignment line 611 being aligned with the front end surface 124). As shown in FIG. 137, the front end of the tongue is formed with a wider slot 129. The height of the slot 129 is two times that of the electroplate-layer-free section of the connection portion 24, and the width of the slot 129 is at least two times that of the electroplate-layer-free section. Each of the slots 126 is arranged in the slot 129, and is much more slightly depressed than the slot 129. In addition, if the two rows of terminals 20 are embedded into the tongue 12 with the alignment line 612 being aligned with the front end surface 124, then only the separate slots 126 corresponding to the electroplate-layer-free sections of the connection portions 24 is formed without the formation of the wider slot 129.

Referring to FIG. 143, the upper and lower connection portions between the material tape 60 and the connection portions 24 of the two rows of terminals 20 are half-cut structures 68, so that easy breaking can be made. Referring to FIG. 143A, the left and right connection portions between the material tape 60 and the connection portions 24 of the two rows of terminals 20 may also be narrower structures 69, so that the easy breaking can be made.

With the above-mentioned structure, the connection portions 24 of the two rows of terminals 20 are vertically aligned and the material-thickness gap of the metal partition plate 40 functions as separation, so that the manufacturing becomes easier, and the connection portions 24 of the ground terminals (A1, A12, B1, B12) of the two sides of the two rows of terminals 20 rest against the top and bottom surfaces of the convex portions 44 of the two sides of the front end of the metal partition plate 40 to achieve the better grounding effect.

Referring to FIGS. 145 to 150, the first modification of this embodiment is substantially the same as the 22nd embodiment, and the difference resides in that the connection portions 24 of the two rows of terminals 20 are designed to be the same as those of the first embodiment.

That is, A1 and B12 are ground terminals, A12 and B1 are ground terminals, A4 and B9 are power terminals, and A9 and B4 are power terminals, so the connection portions 24 of the four pairs of terminals vertically rest against each other; A2 and B11, A3 and B10, A5 and B8, A6 and B7, A7 and B6, A8 and B5, A10 and B3, A11 and B2 are the terminals with different circuits, so the connection portions 24 of the eight pairs of terminals are staggered in a left-to-right manner. In addition, the connection portion 24 of A7 and B7 vertically rest against each other.

The manufacturing processes of this modified embodiment will be described in the following. Referring to FIG. 148, when the two rows of terminals 20 are manufactured by way of stamping, the front and rear ends of each of the terminals are connected to the material tape 60, and the two material sheets 201 of the extensions 22 of the two side terminals are connected to an outer material tape 65. The metal partition plate 40 and the two insulating layers 70 are formed by stamping a metal sheet having two surfaces each adhered with a mylar layer. The metal partition plate 40 has left and right sides connected to an outer material tape 65, The two insulating layers 70 have left and right sides connected to an outer material tape 75.

Referring to FIG. 149, under the operation of the automatic machine, the two rows of terminals 20, the two insulating layers 70 and the metal partition plate 40 are stacked in an aligned manner through the positioning holes, and the two rows of terminals 20 are separated from the metal partition plate 40 through the two insulating layers 70. Referring to FIG. 150, the two rows of terminals 20, the two insulating layers 70 and the metal partition plate 40 are embedded into the plastic material at a time to form the insulation seat 10 by way of injection molding.

Similarly, this embodiment have the two rows of terminals and the front edge of the tongue, which are aligned and encapsulated with each other.

Referring to FIGS. 151 to 152, the second modification of this embodiment is substantially the same as the first modification, and the difference resides in that the two insulating layers 70 are plastic sheets or insulation films. Each of the two rows of terminals 20 and 20' are individually adhered with an insulating layer 70. Then, the two rows of terminals 20 and 20' are one-time embedded and plastic injection molded with the insulation seat by vertically stacking the two insulating layers 70 with the metal partition plate 40.

Referring to FIGS. 153 to 155, the third modification of this embodiment is substantially the same as the first modification, and the difference resides in that the top and bottom surfaces and the broken surfaces of the metal partition plate 40 (exclusive of the convex portions 44 on two sides of the front end and the pins 42) are coated or sprayed with the insulation paint or other insulation material, so that the top and bottom surfaces of the metal partition plate 40 are formed with the two insulating layers 70. The two insulating layers 70 constitute an inner insulating structure 7. The two rows of terminals 20 and 20' are one-time embedded and plastic injection molded with the insulation seat by vertically stacking the two insulating layers 70 with the metal partition plate 40.

Referring to FIGS. 156 to 157, the fourth modification of this embodiment is substantially the same as the first embodiment, and the difference resides in that the horizontal sections of the pins 23 of the two pairs of high differential signal terminals (B2/B3, B10/B11) of the lower row of terminals are shorter than the horizontal sections of the pins 23 of the two pairs of high differential signal terminals (A2/A3, A10/A11) of the upper row of terminals. This modification is electrically connected to a circuit board 280. The circuit board 280 is a multi-layer plate and is provided with a metal layer 283 therein. The bonding pads bonded to the pins 23 of the two pairs of high differential signal terminals (B2/B3, B10/B11) of the lower row of terminals are electrically connected to the other surface of the circuit board through vias 284, so that the two pairs of high differential signal terminals (B2/B3, B10/B11) and the two pairs of high differential signal terminals (A2/A3, A10/A11) are respectively transmitted on the circuits on two surfaces of the circuit board 280, and the electromagnetic interference can be decreased by the separation of the metal layer 283.

Referring to FIGS. 158 to 159, the fifth modification of this embodiment is substantially the same as the first modification, and the difference resides in that each of the top and bottom surfaces of the metal partition plate 40 is embedded and injection molded with the two insulating layers 70 to form an inner insulating structure. The two rows of terminals 20 and 20' are one-time embedded and plastic injection molded with the insulation seat by vertically stacking the two insulating layers 70 with the metal partition plate 40.

Figure 4:
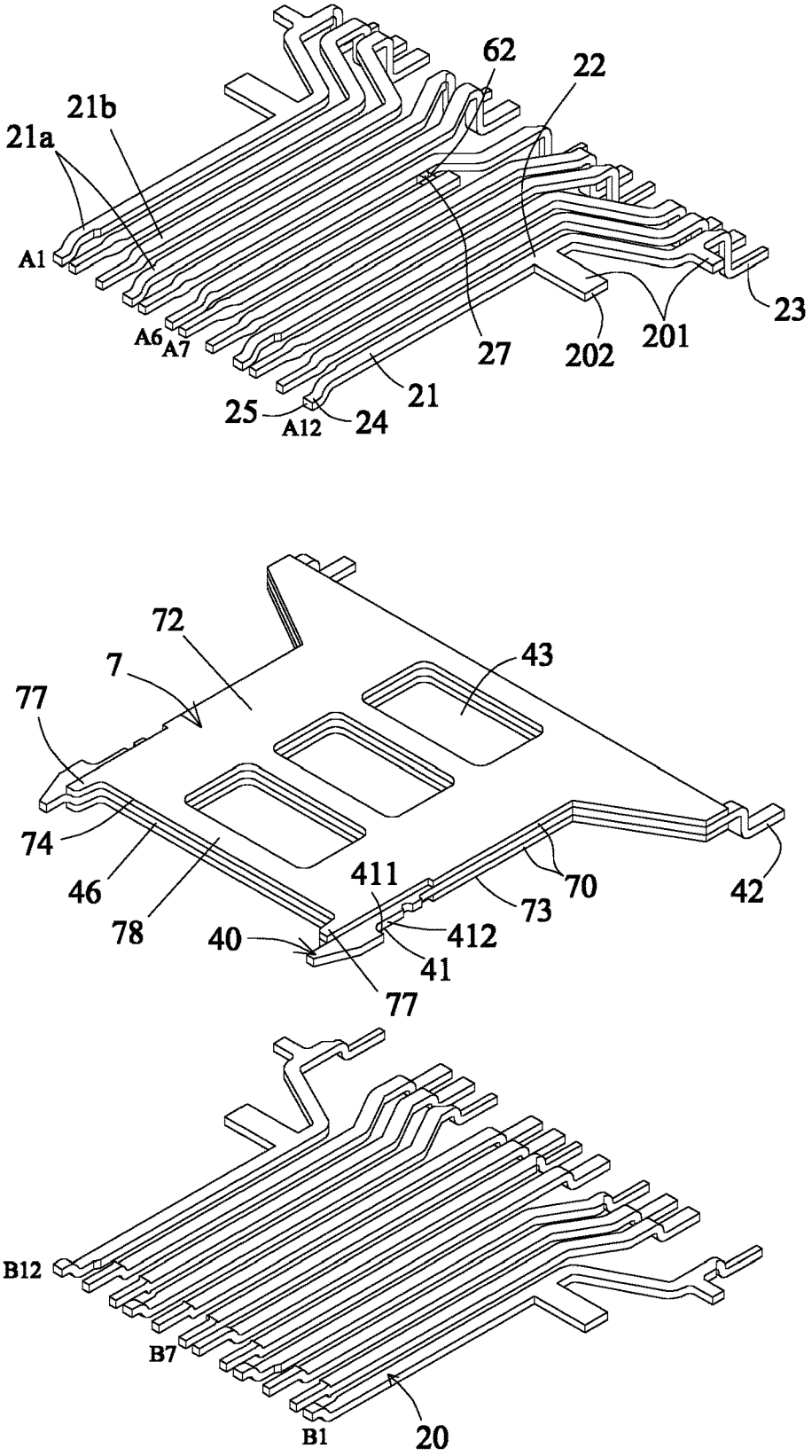
FIG. 4 is a partially pictorially exploded view showing the first embodiment of the invention.
Figure 5:
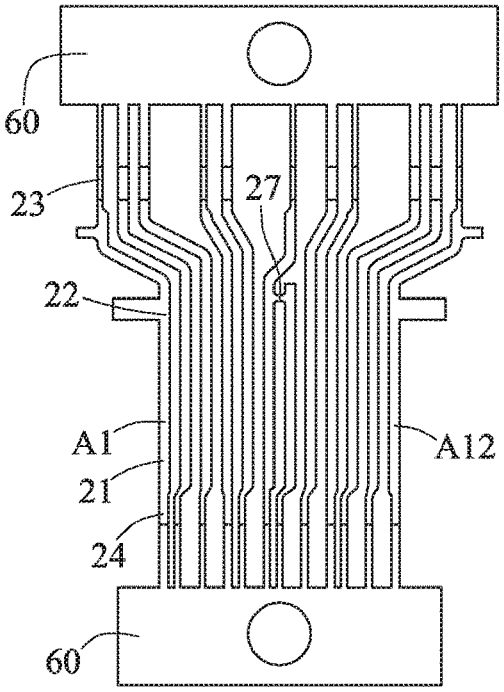
FIG. 5 is a top view showing the upper row of terminals of the first embodiment of the invention.
Figure 6:
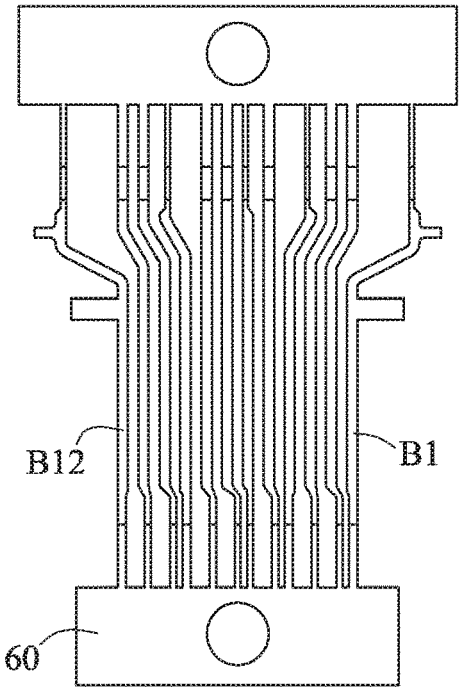
FIG. 6 is a top view showing the lower row of terminals of the first embodiment of the invention.

Referring to FIGS. 160 to 161, the sixth modification of this embodiment is showed, in which the metal snapping plate 40 is substantially the same as that of FIG. 4. Each of the front sections of the left and right sides of the metal snapping plate 40 is integrally provided with a depressed snap 41. A hollow region 46 is provided at the middle of the front section of the metal snapping plate. Each of the two snaps 41 is integrally provided with a depressed surface 411 and a locking surface 412, which are of metal material. The sixth modification of this embodiment is substantially the same as the fifth modification, and the difference resides in that each of the top and bottom surfaces of the metal snapping plate 40 is embedded and injection molded with the two insulating layers 70 and the two rows of terminal positioning slots 17 to form an inner insulating structure 7, which is integrally molded. The inner insulating structure 7 is integrally provided with an upper supporting surface 72 on the upper side of the metal snapping plate 40, and is integrally provided with a lower supporting surface 73 on the lower side of the metal snapping plate. An isolation region 74 is provided in front of the upper and lower supporting surfaces, and the hollow region 46 in front of the metal snapping plate corresponds to the isolation region 74. Each of the upper and lower supporting surfaces 72 and 73 is provided with the one row of terminal positioning slots 17, the two rows of terminals 20 and 20' are one-time embedded and plastic injection molded with the insulation seat by vertically stacking the two insulating layers 70 with the metal partition plate 40 and performing preliminary positioning through the two rows of terminal positioning slots 17.

Referring to FIG. 162, the seventh modification of this embodiment is substantially the same as the 22nd embodiment, and the difference resides in that the base seat 11 of the insulation seat 10 is coated with a circle of waterproof adhesive 38.

Referring to FIGS. 163 and 164, the eighth modification of this embodiment is substantially the same as the 22nd embodiment and the first modification, and the difference resides in that the metal housing is replaced by a plastic housing 39. That is, the outside of the insulation seat 10 is embedded and injection molded with the plastic housing 39, so that the plastic housing 39 is tightly combined with the insulation seat 10 to achieve the better waterproof effect.

Referring to FIG. 165, the ninth modification of this embodiment is substantially the same as the first modification, the difference resides in that the rear end of the insulation seat 10 is provided with an engaging slot 106 into which a circuit board can be inserted for connection, and the distal sections of the pins 23 of the two rows of terminals are in the form of two rows of horizontal pins with a height difference so as to clamp the connection points resting against the top and bottom surfaces of the circuit board.

Referring to FIG. 166, the tenth modification of this embodiment is substantially the same as the first modification, the difference resides in that this modification is an upright design, a positioning member 107 is disposed below the insulation seat 10, the insert port of the connection slot 55 face frontwards, the tongue 12 vertically extends upwards, and the pins 23 of the two rows of terminals 20 are respectively bent toward two sides to become horizontal.

Referring to FIGS. 167 and 168, the eleventh modification of this embodiment is substantially the same as the 22nd embodiment, and the difference resides in that the distal sections of the pins 23 of the two rows of terminals 20 of this modification are arranged in front and rear rows.

Referring to FIGS. 169 and 170, the twelfth modification of this embodiment is substantially the same as the 22nd embodiment, and the difference resides in that the distal sections of the pins 23 of the two rows of terminals 20 of this modification are arranged in one row.

Referring to FIGS. 171 to 177, the bidirectional duplex USB TYPE-C 2.0 electrical connection socket of the 23rd embodiment of the invention provides an on-board type is provided with an insulation seat 10, two rows of terminals 20, and a metal housing 50, and is substantially the same as the second embodiment and its first modification and ninth modification except for the following difference.

The base seat 11 of the insulation seat 10 of this embodiment is provided with an annular groove 18, the groove 18 is fitted with a waterproof ring 37, the distal sections of the pins 23 of the two rows of terminals 20 are arranged in two (front and rear) rows of upright pins. In addition, a pin positioning seat 19 is provided and assembled, from bottom to top, to the bottom end of the base seat of the insulation seat 10.

The connection portions 24 of the middle four pairs of terminals (A5/B8, A6/B7, A7/B6, A8/B5) of the two rows of terminals 20 are vertically aligned with a material thickness gap functioning as partition.

Referring to FIG. 176A, the extensions 22 of the two rows of terminals 20 are staggered in the left-right direction, and the front sections 235 of the horizontal pins 23 change from being staggered in the left-right direction turning to being aligned in the front-rear direction, so that the pins 23 of the two rows of terminals 20 are arranged in two rows being aligned in the front-rear direction.

The contacts 21 of the two rows of terminals 20 slightly project beyond the front sections 121 of the two connection surfaces of the tongue. In addition, as shown in FIG. 173A, the contacts 21 of the two rows of terminals 20 may also be flush with the front sections 121 of the two connection surfaces of the tongue.

The manufacturing processes of this embodiment will be described in the following. Referring to FIG. 175, when the two rows of terminals 20 are manufactured by way of stamping, the rear end of each terminal is connected to an inner material tape, the plate surfaces of the extensions 22 of the two side terminals are provided with wider portions connected to an outer material tape 65, the front ends of the middle four terminals of the two rows of terminals 20 are connected to an inner material tape 63, the inner material tapes 63 of the upper row of terminals 20 are bent reversely and stacked to form the structure with the two-material thickness.

Referring to FIG. 176, under the operation of the automatic machine, the two rows of terminals 20 are stacked in an aligned manner through the positioning hole of the outer material tape, and the resting portions 26 of the ground terminals and the power terminals on two sides of the two rows of terminals 20 are vertically stacked. Referring to FIG. 177, the two rows of terminals 20 are embedded into the plastic material at a time to form the insulation seat 10 by way of injection molding.

This embodiment is similar to the 22nd embodiment, and two rows of terminals and the front edge of the tongue are aligned and encapsulated with each other.

With the above-mentioned structure, the connection portions 24 of the middle four pairs of terminals (A5/B8, A6/B7, A7/B6, A8/B5) of the two rows of terminals 20 are vertically aligned with a material thickness gap functioning to separate the connection portions 24 of the four pairs of terminals 20, so that the manufacturing becomes easier.

Referring to FIGS. 178 to 182, the first modification of this embodiment is substantially the same as the 23rd embodiment, as shown in FIG. 178, any terminal of the two rows of terminals is not provided between the two pairs of power contacts (A4/B9, A9/B4) and the two pairs of ground contacts (A1/B12, A12/B1), and the difference resides in that this embodiment is further provided with a metal partition plate, or metal snapping plate, 40. As shown in FIG. 180, the metal snapping plate 40 has a middle section, which is cut-out to form a hollow region, and is provided with two side plates 45 extending in front-rear directions. The length of the hollow region of the metal snapping plate 40 along the extending direction of the side plates 45 is greater than half the length of the metal snapping plate 40. The two side plates 45 are two metal plate sheets separating from each other, being entirely plate without pins. The side plates 45 are provided only on the tongue 12 and are simply retracted plates. The outer side of each side plate (metal plate sheet) 45 is provided with a snap 41, as showed in FIG. 4. Each of the two snaps 41 is provided with a depressed surface 411 and a locking surface 412, which are of metal material. Each of the two snaps 41 is fixedly disposed at the left and right sides of the tongue 12. The depressed surfaces 411 and the locking surfaces 412 of the two snaps are exposed at the left and right sides of the tongue 12. The two side plates (metal plate sheets) 45 and the two pairs of power contacts (A4/B9, A9/B4) are not at all overlapped in the top-bottom direction, and the two side plates (metal plate sheets) 45 and the two pairs of ground contacts (A1/B12, A12/B1) are overlapped in the top-bottom direction.

The manufacturing processes of this embodiment will be described in the following. Referring to FIG. 180, when the two rows of terminals 20 are manufactured by way of stamping, the rear end of each terminal is connected to an inner material tape, the plate surfaces of the extensions 22 of the two side terminals are provided with wider portions connected to an outer material tape 65, the front ends of the middle four terminals of the two rows of terminals 20 are connected to an inner material tape 63, and the two side plates 45 of the metal partition plate 40 are connected to an outer material tape 75.

Referring to FIG. 181, under the operation of the automatic machine, the two rows of terminals 20 and the metal snapping plate 40 are stacked in an aligned manner through the positioning hole of the outer material tape, the two pairs of resting portions (metal plate sheets) 26 of the two pairs of ground terminals on two sides of the two rows of terminals 20 have respective surfaces, which rest against and are stacked with the top and bottom surfaces of the two side plates 45 of the metal snapping plate 40 in a top-bottom manner respectively to form two metal plate structures 90. The two pairs of resting portions (metal plate sheets) 26 have respective other surfaces, each of which is integrally provided with a ground contact 21. The outer sides of the two resting portions (metal plate sheets) 26 of each metal plate structure 90 and the outer side of a side plate 45 of the metal snapping plate are provided with depressed snap structures to form a snap 91. That is, each of the top and bottom surfaces of the metal plate structure 90 is integrally provided with a ground contact 21, and an outer side of the metal plate structure 90 is provided with the snap 91. Each of the two snaps 91 of the metal plate structure 90 is provided with a depressed surface 92 and a locking surface 93, which are of metal material. Referring to FIG. 182, the two rows of terminals 20 and the metal snapping plate 40 are embedded into the plastic material at a time to form the insulation seat 10 by way of injection molding. The depressed surfaces 92 and the locking surfaces 93 of the two snaps 91 are exposed at the left and right sides of the tongue 12 such that each snap 91 has the thickness of the three vertically stacked metal plates and has triple structural strength to withstand the wearing and plugging-and-playing.

This modified embodiment is similar to the 23rd embodiment, and two rows of terminals and the front edge of the tongue are aligned and encapsulated with each other.

Referring to FIGS. 183 and 184, the second modification of this embodiment is substantially the same as the first modification, and the difference resides in that each of two sides of the metal partition plate 40 has two separate side plates 45 and a hollow middle section. When the metal partition plate 40 has been stamped, the two side plates 45 of the two sides are firstly connected together through a dummy material sheet 62. After beings embedded and injection molded with the insulation seat 10, the dummy material sheet is cut off from the accommodating hole of the insulation seat 10 thereabove.

The resting portions 26 of the ground terminals on two sides of the two rows of terminals 20 (A1/B12, A12/B1) and the resting portions 26 of the power terminals (A4/B9, A9/B4) rest against and are stacked with the top and bottom surfaces of the two side plates 45 on two sides of the metal partition plate 40 in a top-bottom manner.

Referring to FIGS. 185 to 190, the third modification of this embodiment is substantially the same as the 23rd embodiment, and the difference resides in that the connection portions 24 of the middle four terminals of the two rows of terminals 20 are designed to be the same as those of the first embodiment. That is, A5/B8, A6/B7, A7/B6 and A8/B5 are the terminals with different circuits, so the connection portions 24 of the four pairs of terminals are staggered in the one-left-one-right manner. In addition, the connection portions 24 of A7 and B7 vertically rest against each other.

The manufacturing processes of this embodiment will be described in the following. Referring to FIG. 188, when the two rows of terminals 20 are manufactured by way of stamping, the rear end of each terminal is connected to an inner material tape, the plate surfaces of the extensions 22 of the two side terminals are provided with wider portions connected to an outer material tape 65, and the front ends of the middle four terminals of the two rows of terminals 20 are connected to an inner material tape 63.

Referring to FIG. 189, under the operation of the automatic machine, the two rows of terminals 20 are stacked in an aligned manner through the positioning hole of the outer material tape, the resting portions 26 of the ground terminals and the power terminals on two sides of the two rows of terminals 20 are vertically stacked. Referring to FIG. 190, the two rows of terminals 20 are embedded into the plastic material at a time to form the insulation seat 10 by way of injection molding.

This modification is similar to the 22nd embodiment, and two rows of terminals and the front edge of the tongue are aligned and encapsulated with each other.

Referring to FIG. 191, the fourth modification of this embodiment is substantially the same as the third modification, and the difference resides in that: the distal sections of the pins 23 of the upper row of terminals 20 are bent backwards to become horizontal, and the distal sections of the pins 23 of the lower row of terminals 20 are bent frontwards to become horizontal, so that they are arranged in front and rear (two) rows of horizontal pins.

Referring to FIG. 192, the fifth modification of this embodiment is substantially the same as the third modification, and the difference resides in that: the distal sections of the pins 23 of the two rows of terminals 20 are bent backwards to become horizontal and are arranged in one front row and one rear row (two rows).

Referring to FIGS. 193 and 194, the sixth modification of this embodiment is substantially the same as the third modification, and the difference resides in that the rear end of the insulation seat 10 is provided with an engaging slot 106 into which a circuit board can be inserted for connection, and the distal sections of the pins 23 of the two rows of terminals are in the form of two rows of horizontal pins with a height difference so as to clamp the connection points resting against the top and bottom surfaces of the circuit board.

Referring to FIGS. 195 and 196, the seventh modification of this embodiment is substantially the same as the third modification, and the difference resides in that this modification is upright, wherein the insert port of the connection slot 55 faces frontwards, the tongue 12 vertically extends upwards, a positioning member 107 is provided below the insulation seat 10, and the distal sections of the pins 23 of the two rows of terminals 20 are arranged in two rows of upright pins.

Referring to FIGS. 197 and 198, the eighth modification of this embodiment is substantially the same as the seventh modification, and the difference resides in that the pins 23 of the two rows of terminals 20 are respectively bent toward two sides to become horizontal.

Referring to FIGS. 199 and 200, the 24th embodiment of the invention provides an on-board type bidirectional duplex USB TYPE-C 3.1 electrical connection socket substantially the same as the 22nd embodiment, wherein the difference resides in that: the base seat 11 of the insulation seat 10 of this embodiment is integrally provided with a rear plate 135, and the rear plate 135 is integrally connected to two side plates 136, so that the rear end of the base seat 11 is in the closed structure, the distal sections of the pins 23 of the two rows of terminals 20 are bent to become horizontal and are bent in one-front-one-rear manner, and the front sections 235 of the vertical pins of the upper row of terminals are embedded into, injection molded with and fixed to the rear plate 135. In addition, the front end of the tongue 12 covers the front end of the connection portions 24.

Referring to FIG. 201, the first modification of this embodiment is substantially the same as the 22nd and 24th embodiments, and the difference resides in that: the base seat 11 of the insulation seat 10 of this embodiment is integrally provided with a rear plate 135, and the rear plate 135 is integrally connected to two side plates 136, so that the rear end of the base seat 11 is in the closed structure, the distal sections of the pins 23 of the upper row of terminals 20 are bent to become horizontal, the distal sections of the pins 23 of the lower row of terminals 20 are bent to become vertical, the front sections of the vertical pins of the upper row of terminals are embedded into, injection molded with and fixed to the rear plate 135.

Referring to FIG. 202, the 25th embodiment of the invention provides an on-board type bidirectional duplex USB TYPE-C 2.0 electrical connection socket substantially the same as the 23rd embodiment, wherein the difference resides in that: the base seat 11 of the insulation seat 10 of this embodiment is integrally provided with a rear plate 135, and the rear plate 135 is integrally connected to two side plates 136, so that the rear end of the base seat 11 is in the closed structure.

Referring to FIGS. 203 to 205, the 26th embodiment of the invention provides an on-board type bidirectional duplex USB TYPE-C 2.0 electrical connection socket substantially the same as the 23rd embodiment, wherein the difference resides in that: the distal sections of the pins 23 of the two rows of terminals 20 of this embodiment are arranged in one row upright pin, wherein A1 and B12 are ground terminals, A12 and B1 are ground terminals, A4 and B9 are power terminals and A9 and B4 are power terminals. So, the resting portions 26 of the four pairs of terminals are vertically stacked, and the distal sections of the pins 23 of the rear ends are vertically combined together or adjacent and close to each other. The connection portions 24 of the two rows of terminals 20 middle four pairs of terminals (A5/B8, A6/B7, A7/B6, A8/B5) are vertically aligned with a material thickness gap functioning as partition, wherein the distal sections of the pins 23 of the rear ends of A6 and B6 are vertically combined together or adjacent and close to each other.

The left and right sides of the rear section of the insulation seat 10 of this embodiment are provided with convex portions 17 outwardly projecting beyond the left and right sides of the four-sided main housing 51 of the metal housing 50, so that the extensions of the two rows of terminals 20 obtain the larger area to outwardly expand toward the left and right sides. Each of the left and right sides of the rear end of the metal housing 50 is provided with a space providing notch 58 so that the convex portion 17 can project toward the left and right sides.

Referring to FIG. 206, the first modification of this embodiment is substantially the same as the 26th embodiment, wherein the difference resides in that: two pairs of terminals (the power terminals A4/B9 and A9/B4) of the two rows of terminals 20 of this embodiment are not provided with resting portions 26 vertically stacked, but are the same as the connection portions 24 of the middle four pairs of terminals (A5/B8, A6/B7, A7/B6, A8/B5), which are vertically aligned with a material thickness gap functioning as partition, wherein the contact 21 is directly bent to form a bent segment with the connection portion 24. Thus, the directly bent contacts 21 of the two pairs of terminals A4/B9 and A9/B4 may be smoother and stabler, wherein the contacts 21 of the two pairs of terminals A4/B9 and A9/B4 in the 26th embodiment are prodded from one side of the plate surface of the resting portion 26 to form the projecting structure type, which is less stable.

Referring to FIG. 207 showing the second modification of this embodiment substantially the same as the first modification of the 26th embodiment, the difference resides in that: this embodiment is provided with a metal partition plate 40 and similar to the first modification of the 23rd embodiment, the resting portions 26 of the ground terminals on two sides of the two rows of terminals 20 rest against and are stacked with the top and bottom surfaces of the two side plates of the metal partition plate 40 in a top-bottom manner.

Referring to FIG. 208 showing the third modification of this embodiment substantially the same as the first modification of the 26th embodiment, the difference resides in that: the two rows of terminals of this embodiment wherein the connection portions 24 of the two pairs of terminals (A4/B9 and A9/B4) are vertically aligned are stacked, and the connection portions 24 of the middle four pairs of terminals (A5/B8, A6/B7, A7/B6, A8/B5) are staggered in the left-right direction.

The first to third modifications of this embodiment may be applied to the other embodiments.

Referring to FIG. 209, the 27th embodiment of the invention provides an adapter cable 296, which has one end connected to a bidirectional duplex electrical connector 1 that may be a male plug or a female plug, and the other end adapted into a bidirectional duplex electrical connector 2 and a bidirectional duplex electrical connector 3. The bidirectional duplex electrical connectors 2 and 3 may be male plugs or female plugs.

Referring to FIG. 210, the 28th embodiment of the invention provides an adapter having a circuit board functioning as the transmission medium. The adapter is provided with a housing 295. A circuit board 295 is disposed in the metal housing. At least one connection point switching integrated device 286 is disposed on the circuit board 295. The adapter has one end provided with a bidirectional duplex electrical connector 1, which may be a male plug or a female plug, and the other end provided with a bidirectional duplex electrical connector 2, which may be a male plug or a female plug. The bidirectional duplex electrical connectors 1 and 2 are electrically connected to the circuit board and the connection point integration and mutual switching are performed through the connection point switching integrated device.

The structures of various embodiments of the bidirectional duplex electrical connector (or male socket) or bidirectional duplex electrical connection socket (or female plug) of the invention may be applied to the adapter cable or adapter of the above-mentioned embodiment, wherein the connection point switching integrated device functioning as the connection point integration and mutual switching of different contact interfaces may also be provided therein-side.

In addition, the bidirectional electrical connectors on two ends of either the adapter cable or the adapter may be the male plug (or male socket) or socket (or female plug), and may also have a single contact interface or two contact interfaces.

The pin and the seat structure of the invention may pertain to a plate-depressed type, an upright type, a side-standing type, an elevated type, a multilayer type, an all-in-one multilayer type having different connection interfaces stacked, or an integrated all-in-one structure having the same interfaces combined together.

The connector according to the embodiment of the invention may be disposed in various apparatuses and connected to various apparatuses. The apparatus may be an adapter cable, a transmission cable, a mobile phone, a portable calculator apparatus, a tablet computer, a desktop computer, a laptop computer, an all-in-one computer, a wearable calculator apparatus, cellular phone, a smart phone, a media phone, a storage device, a portable media player, a navigation system, a monitor, a power, an adapter, a remote control apparatus, a charger, a flash drive, a retractable flash drive, a foldable flash drive, a wireless transceiver, an adapted electrical connector, an integrated circuit (IC) controller, a household electric apparatus, a mobile power, a power bank, an expander, a server, smart home and auto parts, AR, VR or the like adapted to electronic apparatuses. This may be used to the transmission compatible with the paths of various signal transmission standards. The standards may be used in all adapted connection interfaces and combinations thereof including a USB-C universal serial bus, a USB standard, a HDMI standard, a DVI standard, a DisplayPort standard, a VGA standard, a Thunderbolt standard and the like, wherein these interconnection paths provided by these connector plugs and sockets can be used to transmit the power, ground and data signals, and detect messages and other voltage, current, data or information. In addition, because the bidirectional duplex male plug or female socket (or female plug) of the invention has two contact interfaces, it is also possible to use anti-overvoltage, anti-overcurrent, anti-overheating, anti-short-circuit or anti-backflow elements, such as the Schottky diode, resistor, sensitive resistor, capacitor or magnetic beads, to function as the circuit safety protection element. However, there may be various methods, such as the provisions of the Schottky diode for anti-short-circuit, the resistor, sensitive resistor, capacitor or magnetic beads for anti-overvoltage, anti-overcurrent and anti-overheating, the anti-backflow electrical element, anti-short-circuit electrical element, circuit safety protection element or safety circuit configuration means, to achieve the circuit safety protection effect. The anti-short-circuit or anti-backflow circuit protection and the circuit safety protection have been described in China Utility Patent Application Nos. 201120320657.8 and 201020547846.4, and detailed descriptions thereof will be omitted herein. In order to facilitate the examination, it is to be noted that claims 4 to 6 and 10 to 12 are implemented in FIGS. 1 to 15, claim 7 is implemented in FIGS. 160 and 161, claim 8 is implemented in FIGS. 1 to 15 and 77, claim 9 is implemented in FIGS. 199 and 200, claim 13 is implemented in FIGS. 180 and 184, claims 14 to 18 are implemented in FIGS. 42 to 46 and 171 to 177, and claims 19 to 23 are implemented in FIGS. 178 to 184.

While the present invention has been described by way of examples and in terms of preferred embodiments, it is to be understood that the present invention is not limited thereto. To the contrary, it is intended to cover various modifications. Therefore, the scope of the appended claims should be accorded the broadest interpretation so as to encompass all such modifications.

What is claimed is:

1. A reversible dual-position electrical connector, comprising:

a metal snapping plate with left side and right side being provided with one depressed snap having a locking surface made of metal material;

an inner insulating structure being integrally molded in a plastic injection molding with the metal snapping plate embedded in the inner insulating structure, the inner insulating structure is provided with an upper supporting surface disposed above the upper side of the metal snapping plate and with a lower supporting surface disposed below the lower side of the metal snapping plate, the upper supporting surface and the lower supporting surface are each provided with one row of terminal positioning slots;

two rows of terminals each being integrally provided with a contact in the front end and an extension in the rear end, the two rows of terminals are positioned at the two rows of terminal positioning slots of the upper and lower supporting surfaces of the inner insulating structure, the two rows of contacts rest against the upper and lower supporting surfaces of the inner insulating structure; and an insulation seat, wherein the insulation seat is integrally plastic injection molded and embedded with the two rows of terminals and the inner insulating structure, the insulation seat is provided with a base seat and a tongue, a front end of the base seat is projectingly provided with the tongue, the tongue is provided with two connection surfaces, the two rows of contacts are in flat surface contact with the tongue and exposed from the two connection surfaces, the locking surfaces of the two depressed snaps are respectively exposed at the left and right sides of the tongue, and the tongue can be bidirectionally docked and positioned with a docking electrical connector in a dual-position manner;

wherein at least one of a front section and a rear section of the metal snapping plate is cut-out to form a hollow region at the middle so that the right side and the left side of the metal snapping plate are respectively formed with two metal plate sheets extending from the front section of the metal snapping plate to the rear section of the metal snapping plate, the length of the hollow region of the metal snapping plate along the direction from the front section of the metal snapping plate to the rear section of the metal snapping plate is greater than half the length of the metal snapping plate, and the snap is provided at the outer side of each of the metal plate sheets.

2. The reversible dual-position electrical connector according to claim 1, wherein a metal housing is provided, the metal housing covers the insulation seat and rests against and positions the base seat, a connection slot is formed in the metal housing, the tongue is disposed at a middle height of the connection slot, the connection slot forms symmetrical two spaces on the two connection surfaces of the tongue, and the docking electrical connector can be bidirectionally inserted into and position with the connection slot in the dual-position manner.

3. The reversible dual-position electrical connector according to claim 1, wherein an isolation region is provided in front of the upper and lower supporting surfaces, each of the terminals is integrally provided with, from front to rear, a connection portion, the contact and the extension, a bent segment is formed between the connection portion and the contact so that a height difference is formed between the connection portion and the contact, the connection portion are disposed on the isolation region, a hollow region corresponding to the isolation region is formed in front of the metal snapping plate, the connection portion and the metal snapping plate are isolated, the two rows of connection portions are embedded and fixed into the tongue, and the depressed surface and the locking surface of the two snaps are exposed at left and right sides of the inner insulating structure.

4. The reversible dual-position electrical connector according to claim 3, wherein an insulating structure is provided between the adjacent connection portions to prevent a short-circuited condition; or wherein front ends of the connection portions are aligned metal sections or are aligned electroplate-free metal sections; or wherein the two rows of connection portions are vertically aligned in a top-down direction; or wherein the two rows of connection portions form a height gap; or wherein the two rows of connection portions are vertically aligned in a top-down direction and form a height gap; or wherein the two rows of connection portions are not exposed from a front end of the tongue.

5. The reversible dual-position electrical connector according to claim 1, wherein the two rows of contacts are vertically aligned in a top-down direction and each of the two rows of contacts are provided with multiple longer contacts and multiple shorter contacts, the multiple longer contacts vertically aligned in the top-down direction are contacts with the same circuit, and the multiple shorter contacts vertically aligned in the top-down direction are contacts with different circuits.

6. The reversible dual-position electrical connector according to claim 5, wherein the multiple longer contacts comprise two grounding contacts and two power contacts, and the multiple shorter contacts comprise one pair of low differential signal contacts and one or two detection contacts; or wherein the multiple longer contacts comprise two grounding contacts and two power contacts, and the shorter contacts comprise one pair of low differential signal contacts, one pair or two pairs of high differential signal contacts and two detection contacts; or wherein the multiple longer contacts comprise two grounding contacts and two power contacts.

7. The reversible dual-position electrical connector according to claim 1, wherein the two rows of contacts of the two rows of terminals are vertically aligned in a top-down direction, the two rows of contacts are provided with two pairs of vertically aligned grounding contacts and two pairs of vertically aligned power contacts; or wherein the two rows of contacts of the two rows of terminals are vertically aligned in a top-down direction, the two rows of contacts are provided with two pairs of vertically aligned grounding contacts and two pairs of vertically aligned power contacts, the two metal plate sheets and the two pairs of power contacts are not overlapped in the top-bottom direction; or wherein two side terminals of the two rows of terminals are two pairs of ground terminals and the two rows of terminals are provided with two pairs of power terminals having the same circuit and contacts vertically aligned in the top-down direction, the two metal plate sheets are not overlapped with the two pairs of power contacts in the top-bottom direction; or wherein the two rows of contacts having the same circuits are arranged reversely; or wherein each of the terminals is integrally provided with, from front to rear, the contact, the extension and a pin; or wherein each of the two snaps is provided with a depressed surface made of metal material with the depressed surface being exposed at the left and right sides of the tongue; or a front section and a rear section of the metal snapping plate is cut-out to form a hollow region at the middle so that the two metal plate sheets are separately disposed at two different sides; or wherein the metal snapping plate is provided with at least one pin.

8. The reversible dual-position electrical connector according to claim 1, wherein the contacts of the two rows of terminals are provided with two pairs of vertically aligned grounding contacts and two pairs of vertically aligned power contacts, the two pairs of vertically aligned grounding contacts are respectively positioned at the left and right sides of the two rows of terminals, the two metal plate sheets and the two pairs of power contacts are not overlapped in a top-bottom direction, the two metal plate sheets and the two pairs of grounding contacts are overlapped in the top-bottom direction, any terminal of the two rows of terminals is not provided between the two pairs of power contacts and the two pairs of ground contacts, and the two metal plate sheets are entirely pin-free and simply retracted plates.

9. The reversible dual-position electrical connector according to claim 8, wherein the two metal plate sheets horizontally extend only along the direction from the front section of the metal plate sheets to the rear section of the metal plate sheets; or wherein the two metal plate sheets are entirely flat; or wherein the two metal plate sheets are provided only on the tongue.

10. A reversible dual-position electrical connector, comprising:

an insulation seat provided with a base seat and a tongue, wherein a front end of the base seat is projectingly provided with the tongue, the tongue is provided with two connection surfaces, and the tongue can be bidirectionally docked and positioned with a docking electrical connector in a dual-position manner;

two rows of terminals being fixed to the insulation seat, each of the two rows of terminals being integrally provided from the front end to the rear end with a contact and an extension, the contacts of the two rows of terminals are in flat surface contact with the tongue and exposed on the two connection surfaces, the contacts of the two rows of terminals are provided with two pairs of vertically aligned grounding contacts and two pairs of vertically aligned power contacts, and the two pairs of vertically aligned grounding contacts are respectively positioned at the left and right sides of the two rows of terminals; and two snaps each having a locking surface made of metal material, and being fixedly disposed at left and right sides of the tongue, respectively;

wherein the two snaps are respectively formed at two metal plate sheets provided separately from the two rows of terminals and disposed respectively on the left side and right side of the tongue, the two metal plate sheets are not overlapped with the two pairs of power contacts in a top-bottom direction, and the two metal plate sheets are overlapped with the two pairs of grounding contacts in the top-bottom direction, the depressed surfaces and the locking surfaces of the two snaps are exposed at the left and right sides of the tongue, any terminal of the two rows of terminals is not provided between the two pairs of power contacts and the two pairs of ground contacts, and the two metal plate sheets are entirely pin-free and simply retracted plates.

11. The reversible dual-position electrical connector according to claim 10, wherein a metal housing is provided, the metal housing covers the insulation seat and rests against and positions the base seat, a connection slot is formed in the metal housing, the tongue is disposed at a middle height of the connection slot, the connection slot forms symmetrical two spaces on the two connection surfaces of the tongue, and the docking electrical connector can be bidirectionally inserted into and position with the connection slot in the dual-position manner; or wherein two side terminals of the two rows of terminals are two pairs of ground terminals; or wherein two side terminals of the two rows of terminals are two pairs of ground terminals and two pairs of power terminals having the same circuit and contacts vertically aligned in the top-down direction are further provided, the two metal plate sheets are not overlapped with the two pairs of power contacts in the top-bottom direction; or wherein two side terminals of the two rows of terminals are two pairs of ground terminals, the two pairs of ground terminals rest against upper and lower surfaces of the two metal plate sheets, or the two pairs of ground terminals do not rest against the upper and lower surfaces of the two metal plate sheets.

12. The reversible dual-position electrical connector according to claim 10, wherein multiple pairs of terminals having different circuits and contacts vertically aligned in the top-down direction are provided in the two rows of terminals, wherein a front end of the contact of each of the multiple pairs of terminals is provided with a bent segment connecting a connection portion so that a height difference is formed between the connection portion and the contact and the connection portion is embedded and fixed into the tongue.

13. The reversible dual-position electrical connector according to claim 10, wherein the two rows of terminals and the insulation seat have an embedded and plastic injection molded at a time structure, the insulation seat has an integrally molded structure in which the two rows of terminals are simultaneously embedded and plastic injection molded at a time; or wherein the two snaps and the insulation seat have an embedded and plastic injection molded at a time structure, the insulation seat has an integrally molded structure in which the two snaps are simultaneously embedded and plastic injection molded at a time; or wherein the two rows of terminals, the two snaps and the insulation seat have an embedded and plastic injection molded structure; or wherein the two rows of terminals, the two snaps and the insulation seat have an embedded and plastic injection molded at a time structure, the insulation seat has an integrally molded structure in which the two rows of terminals and the two snaps are simultaneously embedded and plastic injection molded at a time; or wherein the two snaps are separate; or wherein the two rows of contacts having the same circuits are arranged reversely; or wherein each of the terminals is integrally provided with, from front to rear, the contact, the extension and a pin; or wherein each of the two snaps is provided with a depressed surface made of metal material with the depressed surface being exposed at the left and right sides of the tongue.

14. The reversible dual-position electrical connector according to claim 10, wherein the two metal plate sheets horizontally extend only along the direction from the front section of the metal plate sheets to the rear section of the metal plate sheets; or wherein the two metal plate sheets are entirely flat; or wherein the two metal plate sheets are provided only on the tongue; or wherein the two metal plate sheets are separately disposed at two different sides.

15. A reversible dual-position electrical connector, comprising:

an insulation seat provided with a base seat and a tongue, wherein a front end of the base seat is projectingly provided with the tongue, the tongue is provided with two connection surfaces, and the tongue can be bidirectionally docked and positioned with a docking electrical connector in a dual-position manner;

two rows of terminals being fixed to the insulation seat, each of the two rows of terminals being integrally provided from the front end to the rear end with a contact and an extension, the extension of each of the terminals has same thickness, the contacts of the two rows of terminals are in flat surface contact with the tongue and exposed from the two connection surfaces; and two snaps each having a locking surface made of metal material, being fixedly disposed at left and right sides of the tongue, respectively, with the locking surfaces being exposed at the left and right sides of the tongue, respectively;

wherein the two snaps are respectively formed at outer side of two metal plate structures, the upper and lower surfaces of each of the metal plate structures are each integrally provided with a grounding contact, the grounding contacts are respectively flush with the contacts of the two rows of terminals.

16. The reversible dual-position electrical connector according to claim 15, wherein a metal housing is provided, the metal housing covers the insulation seat and rests against and positions the base seat, a connection slot is formed in the metal housing, the tongue is disposed at a middle height of the connection slot, the connection slot forms symmetrical two spaces on the two connection surfaces of the tongue, and the docking electrical connector can be bidirectionally inserted into and position with the connection slot in the dual-position manner; or wherein two side terminals of the two rows of terminals are two pairs of ground terminals; or wherein two side terminals of the two rows of terminals are two pairs of ground terminals and two pairs of power terminals having the same circuit and contacts vertically aligned in the top-down direction are further provided; or multiple pairs of terminals having different circuits and contacts vertically aligned in the top-down direction are provided in the two rows of terminals, wherein a front end of the contact of each of the multiple pairs of terminals is provided with a bent segment connecting a connection portion so that a height difference is formed between the connection portion and the contact and the connection portion is embedded and fixed into the tongue.

17. The reversible dual-position electrical connector according to claim 15, wherein a metal snapping plate is provided at the middle of the insulation seat, the metal plate structure comprises two metal plate sheets, the two metal plate sheets have respective surfaces, which directly rest against and are stacked with top and bottom surfaces of the metal snapping plate to form the metal plate structure, the two metal plate sheets have respective other surfaces, each of which is integrally provided with the grounding contact, the outer side of the two metal plate sheets vertically stacked and the outer side of the metal snapping plate are provided with depressed structures to form the snap; or wherein a metal snapping plate is provided at the middle of the insulation seat, the metal plate structure comprises two metal plate sheets, the two metal plate sheets have respective surfaces, which directly rest against and are stacked with top and bottom surfaces of the metal snapping plate to form the metal plate structure, the two metal plate sheets have respective other surfaces, each of which is integrally provided with the grounding contact, the outer side of the two metal plate sheets vertically stacked and the outer side of the metal snapping plate are provided with depressed structures to form the snap, a middle section of the metal snapping plate is hollow and in a form of separate and front-rear extending two side plates, or has two sides each having two separate and front-rear extending side plates; or wherein the metal plate structure comprises two metal plate sheets directly resting against each other in a top-down direction, the two metal plate sheets have respective surfaces resting against each other, the two metal plate sheets have respective other surfaces, each of which is integrally provided with the grounding contact, the outer side of the two metal plate sheets vertically stacked are provided with depressed structures to form the snap.

18. The reversible dual-position electrical connector according to claim 17, wherein two side terminals of the two rows of terminals are two pairs of ground terminals, and each ground terminal is provided with the metal plate sheet; or the two grounding contacts are prodded to project from the surfaces of the two metal plate sheets, respectively.

19. The reversible dual-position electrical connector according to claim 15, wherein the two rows of terminals and the insulation seat have an embedded and plastic injection molded at a time structure, the insulation seat has an integrally molded structure in which the two rows of terminals are simultaneously embedded and plastic injection molded at a time; or wherein the two snaps and the insulation seat have an embedded and plastic injection molded at a time structure, the insulation seat has an integrally molded structure in which the two snaps are simultaneously embedded and plastic injection molded at a time; or wherein the two rows of terminals, the two snaps and the insulation seat have an embedded and plastic injection molded structure; or wherein the two rows of terminals, the two snaps and the insulation seat have an embedded and plastic injection molded at a time structure, the insulation seat has an integrally molded structure in which the two rows of terminals and the two snaps are simultaneously embedded and plastic injection molded at a time; or wherein the two metal plate structures are separate; or wherein the two rows of contacts having the same circuits are arranged reversely; or wherein each of the terminals is integrally provided with, from front to rear, the contact, the extension and a pin; or wherein each of the two snaps is provided with a depressed surface made of metal material with the depressed surface being exposed at the left and right sides of the tongue.

20. The reversible dual-position electrical connector according to claim 15, wherein a metal snapping plate is provided at the middle of the insulation seat, the metal plate structure comprises two metal plate sheets, the two metal plate sheets have respective surfaces, which directly rest against and are stacked with top and bottom surfaces of the metal snapping plate to form the metal plate structure, the two metal plate sheets have respective other surfaces, each of which is integrally provided with the grounding contact, the outer side of the two metal plate sheets vertically stacked and the outer side of the metal snapping plate are provided with depressed structures to form the snap, the metal snapping plate is provided with at least one pin.

* * * * *